US012510074B2

(12) United States Patent
Covel et al.

(10) Patent No.: US 12,510,074 B2
(45) Date of Patent: Dec. 30, 2025

(54) ELECTRIC COMPRESSOR WITH INTEGRATED SENSOR(S)

(71) Applicant: MAHLE INTERNATIONAL GMBH, Stuttgart (DE)

(72) Inventors: Christopher Covel, Tonawanda, NY (US); Brett Bowman, Lockport, NY (US); Jonathan Hammond, Churchville, NY (US); Brent Haseley, Niagara Falls, NY (US)

(73) Assignee: MAHLE INTERNATIONAL GMBH (DE)

( * ) Notice: Subject to any disclaimer, the term of this patent is extended or adjusted under 35 U.S.C. 154(b) by 0 days.

(21) Appl. No.: 18/338,335

(22) Filed: Jun. 20, 2023

(65) Prior Publication Data

US 2024/0426297 A1 Dec. 26, 2024

(51) Int. Cl.
*F04C 18/02* (2006.01)
*F04C 29/00* (2006.01)

(52) U.S. Cl.
CPC ..... *F04C 18/0215* (2013.01); *F04C 29/0085* (2013.01); *F04C 2240/803* (2013.01); *F04C 2240/808* (2013.01); *F04C 2240/81* (2013.01); *F04C 2270/095* (2013.01); *F04C 2270/18* (2013.01); *F04C 2270/19* (2013.01); *F04C 2270/42* (2013.01); *F04C 2270/44* (2013.01); *F04C 2270/605* (2013.01)

(58) Field of Classification Search
CPC ..... F04C 18/0215; F04C 23/008; F04C 29/0085; F04C 29/047; F04C 2240/803; F04C 2240/808; F04C 2240/81; F04C 2270/095; F04C 2270/18; F04C 2270/19; F04C 2270/42; F04C 2270/44; F04C 2270/605
See application file for complete search history.

(56) References Cited

U.S. PATENT DOCUMENTS

2016/0146209 A1* 5/2016 Sakai ..... F04C 29/047 417/32
2020/0386230 A1* 12/2020 Kim ..... F04C 29/047
2022/0307500 A1 9/2022 Spies et al.

OTHER PUBLICATIONS

KR20100018233A—Koo et al.—Electric Compressor Having Inverter—Feb. 17, 2010—the English Machine Translation. (Year: 2010).*
DE102020120772—Spies et al.—Compressor Module—Mar. 18, 2021—the English Machine Translation (Year: 2021).*

* cited by examiner

*Primary Examiner* — Craig M Schneider
(74) *Attorney, Agent, or Firm* — Endurance Law Group PLC; James R. Yee

(57) ABSTRACT

An electric compressor includes a housing, refrigerant inlet port, a refrigerant outlet port, an inverter section, a motor section, a compression device and a front cover. The housing defines an intake volume and a discharge volume. The refrigerant inlet port is coupled to the housing and is configured to introduce the refrigerant to the intake volume. The compression device is a scroll-type compression device configured to compress the refrigerant. The refrigerant outlet port is coupled to the housing and is configured to allow compressed refrigerant to exit the scroll-type electric compressor from the discharge volume. The electric compressor includes integral pressure(s) and/or temperatures sensor(s).

43 Claims, 65 Drawing Sheets

ELECTRIC COMPRESSOR WITH INTEGRATED SENSOR(S)

FIELD OF THE INVENTION

The invention relates generally to electric compressor, and more particularly to an electric compressor that compresses a refrigerant using a scroll compression device.

BACKGROUND OF THE INVENTION

Compressors have long been used in cooling systems. In particular, scroll-type compressors, in which an orbiting scroll is rotated in a circular motion relative to a fixed scroll to compress a refrigerant, have been used in systems designed to provide cooling in specific areas. For example, such scroll-type compressors have long been used in the HVAC systems of motor vehicles, such as automobiles, to provide air-conditioning. Such compressors may also be used, in reverse, in applications requiring a heat pump. Generally, these compressors are driven using rotary motion derived from the automobile's engine.

With the advent of battery-powered or electric vehicles and/or hybrid vehicles, in which the vehicle may be solely powered by a battery at times, such compressors must be driven or powered by the battery rather than an engine. Such compressors may be referred to as electric compressors.

In addition to cooling a passenger compart of the motor vehicle, electric compressors may be used to provide heating or cooling to other areas or components of the motor vehicle. For instance, it may be desired to heat or cool the electronic systems and the battery or battery compartment, when the battery is being charged, especially during fast charging modes, as such generate heat which may damage or degrade. the battery and/or other system. It may also be used to cool the battery during times when the battery is not being charged or used, as heat may damage or degrade the battery. Since the electric compressor may be run at various times, even when the motor vehicle is not in operation, such use, obviously, requires electrical energy from the battery, thus reducing the operating time of the battery.

In use, it may be necessary or advantageous to utilize the pressure and/or temperature of the refrigerant at an intake side and/or a discharge side of the compressor to control an electrical compressor. In prior design, generally the pressure and temperature at the intake and discharge side are measured by sensors external to the electrical compressor, e.g., within refrigerant lines to and from the electrical compressor. Use of external sensors may present several disadvantages, e.g., use of outdated sensor technology, additional cost in raw materials and labor and the requirement of an additional wire or wire harness to connect the sensors to an engine control unit (ECU).

Therefore, it may be advantageous to integrate pressure and/or temperature sensors within the electric compressor. Such integration may act to decouple pressure and temperature disturbances that occur between the line and compressor for a more direct measurement. It also enables the compressor to use this measured data for optimized decision making (protection modes, speed changes, etc. . . . ).

It is thus desirable to provide an electric compressor having high efficiency, low-noise and maximum operating life. The present invention is aimed at one or more of the problems or advantages identified above.

BRIEF SUMMARY OF THE INVENTION

In a first aspect of the present invention, a scroll-type electric compressor configured to compress a refrigerant, is provided. The scroll-type electric compressor includes a housing, an inverter module, a motor, a compression device, an internal housing partition and a pressure sensor. The housing defines an intake volume, a discharge volume, and an inverter cavity. The housing has a generally cylindrical shape and a central axis. The inverter module is mounted inside the inverter cavity of the housing and is adapted to convert direct current electrical power to alternating current electrical power. The motor is mounted inside the housing. The compression device is coupled to the motor, receives the refrigerant from the intake volume and compresses the refrigerant as the motor is rotated. The internal housing partition separates the intake volume and the inverter cavity and a passage therethrough for receiving refrigerant from the intake volume. The passage has an intake volume end and an inverter cavity end. The pressure sensor is positioned within the inverter cavity adjacent the inverter cavity end of the passage for sensing a pressure associated with the refrigerant within the passage.

In a second aspect of the present invention, a scroll-type electric compressor configured to compress a refrigerant is provided. The scroll-type electric compressor includes a housing, an inverter module, a motor, a compression device, an internal housing partition, a holder, a pressure sensor, and a temperature sensor. The housing defines an intake volume, a discharge volume and an inverter cavity and has a generally cylindrical shape and a central axis. The housing includes an inverter housing and an inverter back cover. The inverter housing and the inverter back cover define the inverter cavity. The inverter housing includes a holder aperture. The inverter module is mounted inside the inverter cavity of the housing and is adapted to convert direct current electrical power to alternating current electrical power. The inverter module includes a printed circuit board. The motor is mounted inside the housing. The compression device is coupled to the motor, receives the refrigerant from the intake volume and compresses the refrigerant as the motor is rotated. The internal housing partition separates the intake volume and the inverter cavity and includes a passage therethrough for receiving refrigerant from the intake volume. The passage has an intake volume end and an inverter cavity end. The holder is located within the holder aperture and defines at least a portion of the internal housing partition. The passage is located within the holder. The pressure sensor is mounted to the printed circuit board and is positioned within the inverter cavity adjacent the inverter cavity end of the passage for sensing a pressure associated with the refrigerant within the passage. The temperature sensor is positioned within the intake volume and is coupled to the printed circuit board by a plurality of wires.

In a third aspect of the present invention, a scroll-type electric compressor configured to compress a refrigerant is provided. The scroll-type electric compressor includes a housing, an inverter module, a motor, a compression device, an internal housing partition, a pressure sensor housing partition and a pressure sensor. The housing defines an intake volume, a discharge volume and an inverter cavity and has a generally cylindrical shape and a central axis. The housing includes an inverter housing and an inverter back cover. The inverter housing and the inverter back cover define the inverter cavity. The inverter housing includes a pressure sensor module aperture. The inverter module includes a printed circuit board. The inverter module is mounted inside the inverter cavity of the housing and is adapted to convert direct current electrical power to alternating current electrical power. The motor is mounted inside the housing. The compression device is coupled to the motor for receiving the refrigerant from the intake volume and for compressing the refrigerant as the motor is rotated. The internal housing partition separates the intake volume and the inverter cavity and includes a passage therethrough for receiving refrigerant from the intake volume. The passage has an intake volume end and an inverter cavity end. The pressure sensor module housing has a pressure sensor cavity and an intake volume side wall and is located within the pressure sensor module aperture. The intake volume side wall defines at least a portion of the internal housing partition. The passage is located within the intake volume side wall. The pressure sensor module includes a pressure sensor module printed circuit board electrically coupled to the printed circuit board. The pressure sensor is positioned within a pressure sensor cavity and adjacent the inverter cavity end of the passage for sensing a pressure associated with the refrigerant within the passage.

BRIEF DESCRIPTION OF THE SEVERAL VIEWS OF THE DRAWINGS

These and other features and advantages of the present invention will become more readily appreciated when considered in connection with the following detailed description and appended drawings.

DETAILED DESCRIPTION OF THE INVENTION

Figure 1A:
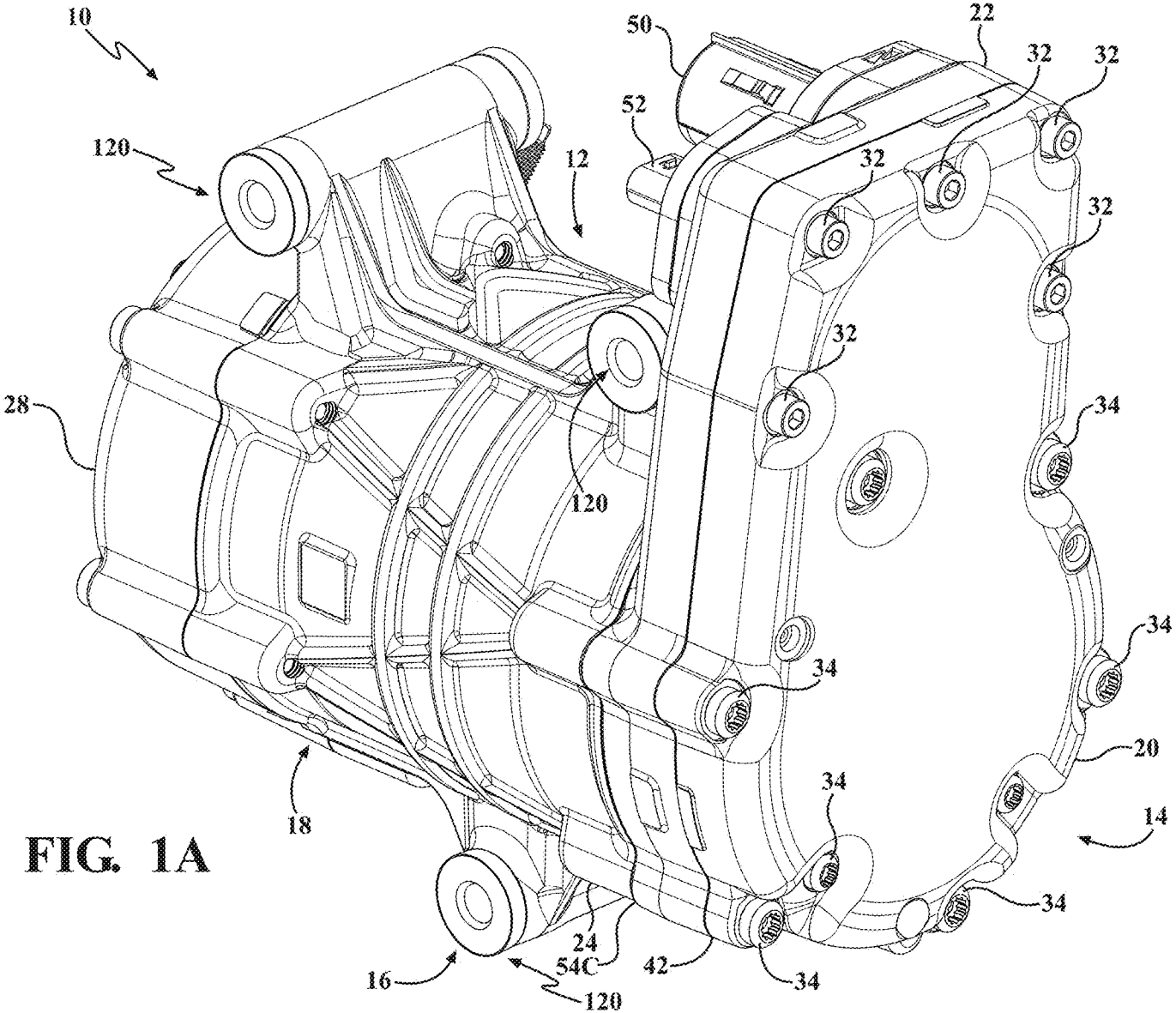
FIG. 1A is first perspective view an electric compressor, according to an embodiment of the present invention.

Referring to the FIGS. 1A-26C, wherein like numerals indicate like or corresponding parts throughout the several views, an electric compressor 10 having an outer housing 12 is provided. The electric compressor 10 is particularly suitable in a motor vehicle, such as an automotive vehicle (not shown). The electric compressor 10 may be used as a cooling device or as a heating pump (in reverse) to heat and/or cool different aspects of the vehicle. For instance, the electric compressor 10 may be used as part of the heating, ventilation and air conditioning (HVAC) system in electric vehicles (not shown) to cool or heat a passenger compartment. In addition, the electric compressor 10 may be used to heat or cool the passenger compartment, on-board electronics and/or a battery used for powering the vehicle while the vehicle is not being operated, for instance, during a charging cycle. The electric compressor 10 may further be used while the vehicle is not being operated and while the battery is not being charged to maintain, or minimize the degradation, of the life of the battery. In the illustrated embodiment, the electric compressor 10 has a capacity of 36 cubic centimeters (cc). The capacity refers to the initial volume captured within the compression device as the scrolls of the compression device initially close or make contact (see below). It should be noted that the electric compressor 10 disclosed herein is not limited to any such volume and may be sized or scaled to meet particular required specifications.

In the illustrated embodiment, the electric compressor 10 is a scroll-type compressor that acts to compress a refrigerant rapidly and efficiently for use in different systems of a motor vehicle, for example, an electric or a hybrid vehicle. The electric compressor includes 10 an inverter section 14, a motor section 16, and a compression device (or compression assembly) 18 contained within the outer housing 12. The outer housing 12 includes an inverter back cover 20, an inverter housing 22, a center housing 24, and a front cover 28 (which may be referred to as the discharge head). The center housing 24 houses the motor section 16 and the compression device 18.

In a first aspect of the electric compressor 10 of the disclosure, an electric compressor 10 having a compression device with a fixed scroll having a modified scroll floor is provided. In a second aspect of the electric compressor 10 of the disclosure, an electric compressor 10 with an isolation and constraint system is provided. In a third aspect of the electric compressor 10 of the disclosure, an electric compressor 10 having a head design having a reed mechanism with three reeds is provided.

In one embodiment, the inverter back cover 20, the inverter housing 22, the center housing 24, and the front cover 28 are composed from machined aluminum. The electric compressor 10 may be mounted, for example, within the body of a motor vehicle, via a plurality of mount points 120.

General Arrangement, and Operation, of the Electric Compressor 10

The inverter back cover 20 and the inverter housing 22 form an inverter cavity 30. The inverter back cover 20 is mounted to the inverter housing 22 by a plurality of bolts 32. The inverter back cover 20 and the inverter housing 22 are mounted to the center housing 24 by a plurality of bolts 34 which extend through apertures 36 in the inverter back cover 20 and apertures 38 in the inverter housing 22 and are threaded into threaded apertures (not shown) in the center housing 24. An inverter gasket 42, positioned between the inverter back cover 20 and the inverter housing 22 keeps moisture, dust, and other contaminants from the internal cavity 30. A motor gasket 54C is positioned between the inverter housing 22 and the center housing 24 to provide and maintain a refrigerant seal to the environment.

Figure 11:
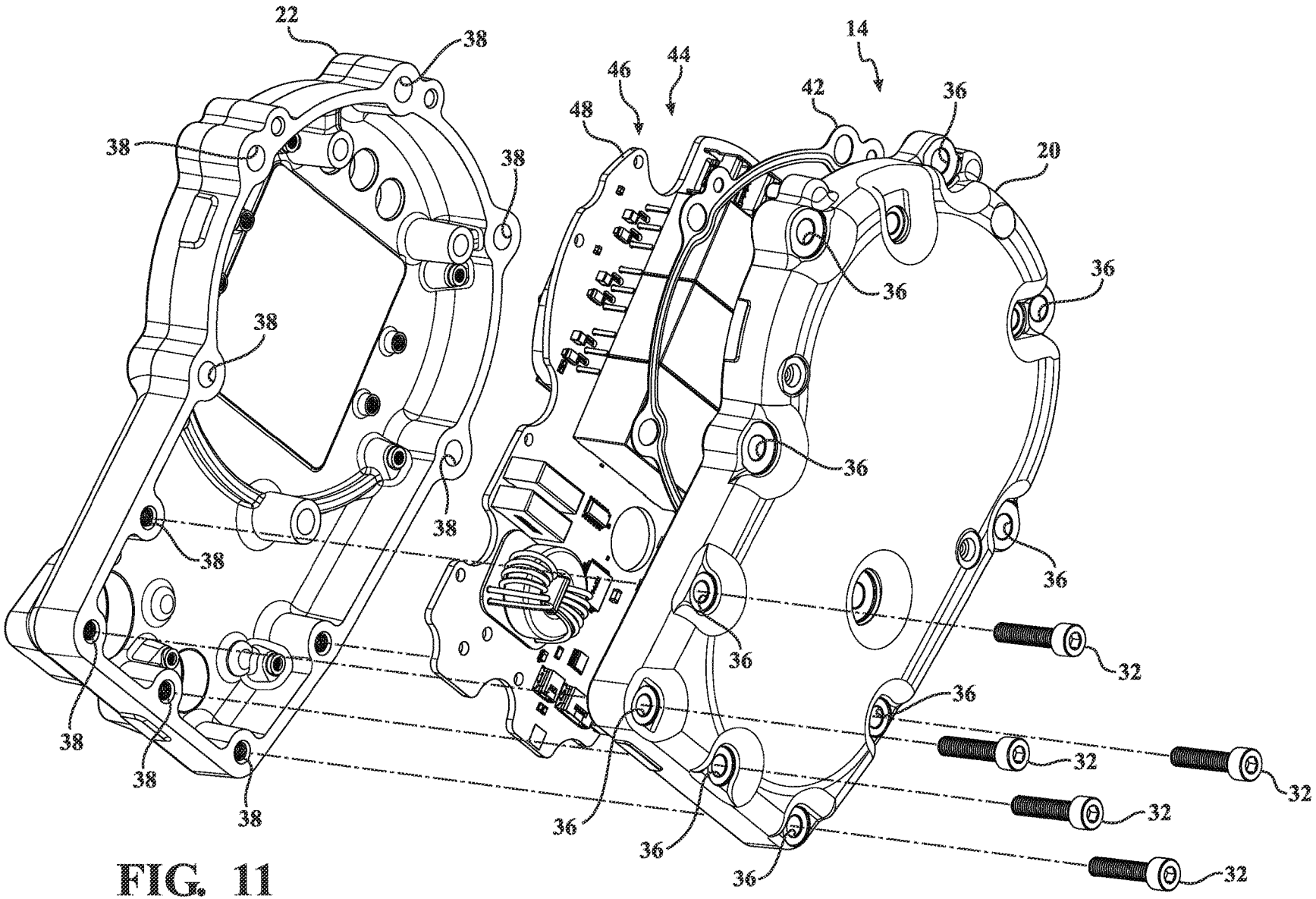
FIG. 11 is an exploded view of an inverter of the electric compressor of FIG. 1A.
Figure 12:
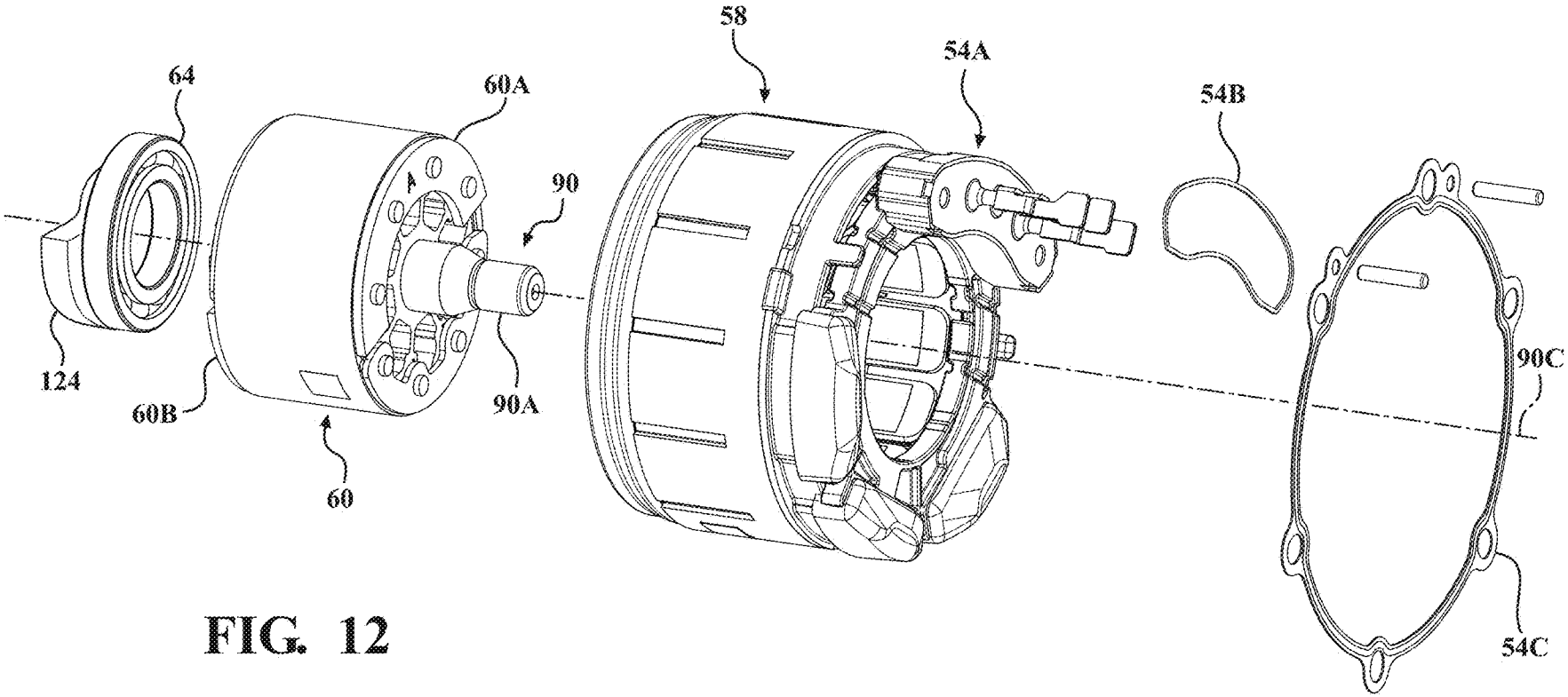
FIG. 12 is an exploded view of a portion of the electric compressor of FIG. 1, including a motor and drive shaft.

With reference to FIG. 11, an inverter module 44 mounted within the inverter cavity 30 formed by the inverter back cover 20 and the inverter housing 22. The inverter module 44 includes an inverter or controller circuit 46 mounted on a printed circuit board 48, which is mounted to the inverter housing 22. The inverter circuit 46 converts direct current (DC) electrical power received from outside of the electric compressor 10 into three-phase alternating current (AC) power to supply/power the motor 54 (see below). The inverter circuit 46 also controls the rotational speed of the electric compressor 10. High voltage DC current is supplied to the inverter circuit 46 via a high voltage connector 50. Low voltage DC current to drive the inverter circuit 46, as well as control signals to control operation of the inverter circuit 46, and the motor section 16, is supplied via a low voltage connector 52.

The center housing 24 forms a motor cavity 56. The motor section 16 includes a motor 54 located within the motor cavity 56. The motor cavity 56 is formed by a motor side 22A of the inverter housing 22 and an inside surface 24C of the center housing 22. With specific reference to FIG. 12, the motor 54 is a three-phase AC motor having a stator 58. The stator 58 has a generally hollow cylindrical shape with six individual coils (two for each phase). The stator 58 is contained within, and mounted to, the motor housing 24 and remains stationary relative to the motor housing 24.

The motor 54 includes a rotor 60 located within, and centered relative to, the stator 58. The rotor 60 has a generally hollow cylindrical shape and is located within the stator 58. The rotor 60 has a number of balancing counterweights 60A, 60B, affixed thereto. The balancing counterweights balance the motor 54 as the motor 54 drives the compression device 18 and may be machined from brass.

Power is supplied to the motor 54 via a set of terminals 54A which are sealed from the motor cavity 56 by an O-ring 54B.

A drive shaft 90 is coupled to the rotor 60 and rotates therewith. In the illustrated embodiment, the draft shaft 90 is press-fit within a center aperture 60C of the rotor 60. The drive shaft 90 has a first end 90A and a second end 90B. The inverter housing 22 includes a first drive shaft supporting member 22B located on the motor side of the inverter housing 22. A first ball bearing 62 located within an aperture formed by the first drive shaft supporting member 22 supports and allows the first end of the drive shaft 90 to rotate. The center housing 24 includes a second drive shaft supporting member 24A. A second ball bearing 64 located within an aperture formed by the second drive shaft supporting member 24A allows the second end 90B of the drive shaft 90 to rotate. In the illustrated embodiment, the first and second ball bearing 62, 64 are press-fit with the apertures formed by the first drive shaft supporting member 22 of the inverter housing 22 and the second drive shaft supporting member 24A of the center housing 24, respectively.

As stated above, the electric compressor 10 is a scroll-type compressor. The compression device 18 includes the fixed scroll 26 and an orbiting scroll 66. The orbiting scroll 66 is fixed to the second end of the rotor 60. The rotor 60 with the drive shaft 90 rotates to drive the orbiting scroll 66 motion under control of the inverter module 44 rotate.

With reference to FIGS. 14A, 14B, 16A and 16B, the drive shaft 90 has a central axis 90C around which the rotor 60 and the drive shaft 90 are rotated. The orbiting scroll 66 moves about the central axis 90C in an eccentric orbit, i.e., in a circular motion while the orientation of the orbiting scroll 66 remains constant with respect to the fixed scroll 26. The center of the orbiting scroll 66 is located along an offset axis 90D of the drive shaft 90 defined by an orbiting scroll aperture (or drive pin location) 90E (see FIG. 14A) located at the second end 90B of the drive shaft 90. As the drive shaft 90 is rotated by the motor 54, the orbiting scroll 66 follows the motion of the orbiting scroll aperture 90E through the drive pin 126 and the drive hub of the swing-link mechanism 124 and bearing 108 as the drive shaft 90 is rotated about the central axis 90C.

Figure 1B:
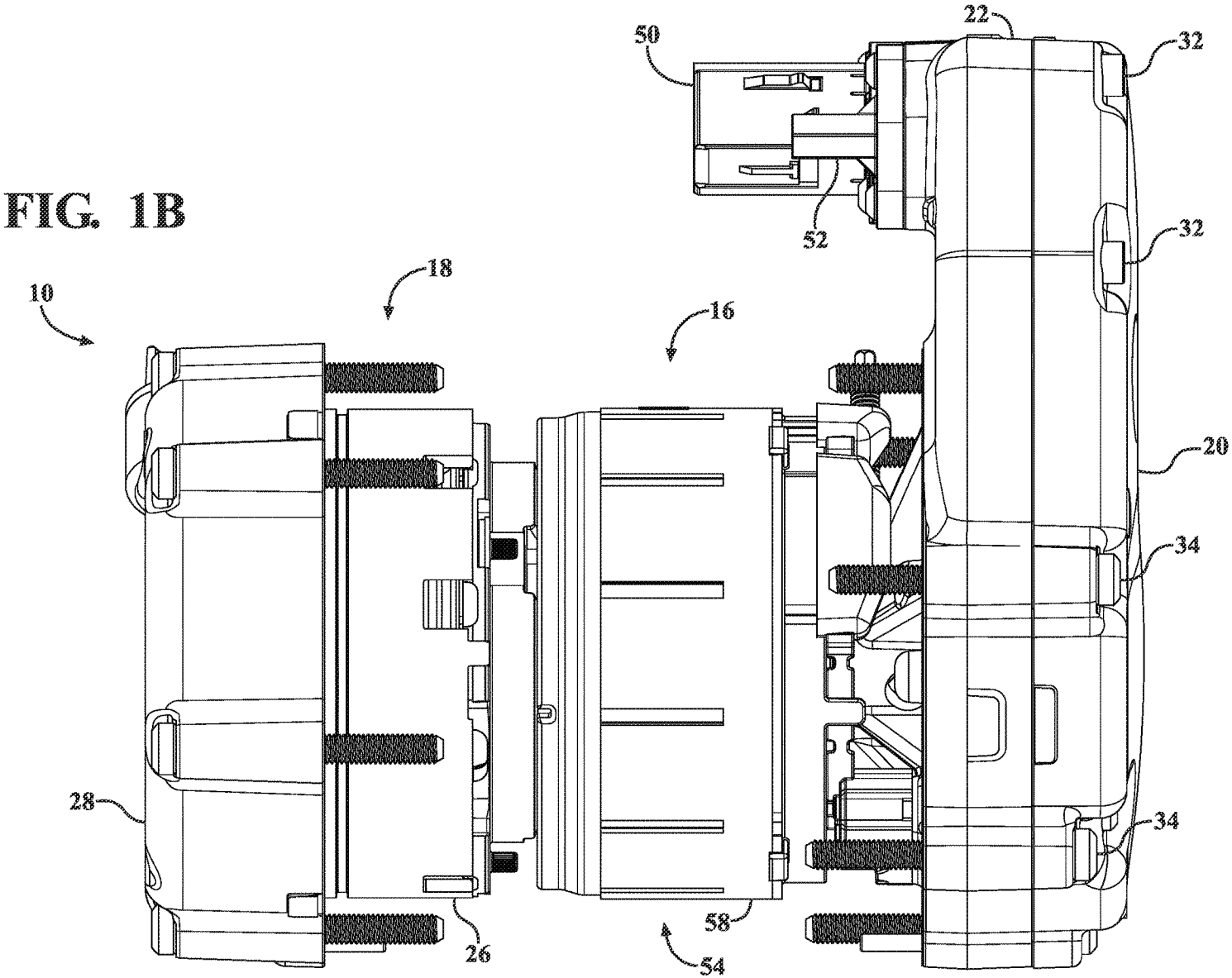
FIG. 1B is a partial view of the electric compressor of FIG. 1A with a center housing removed.
Figure 2:
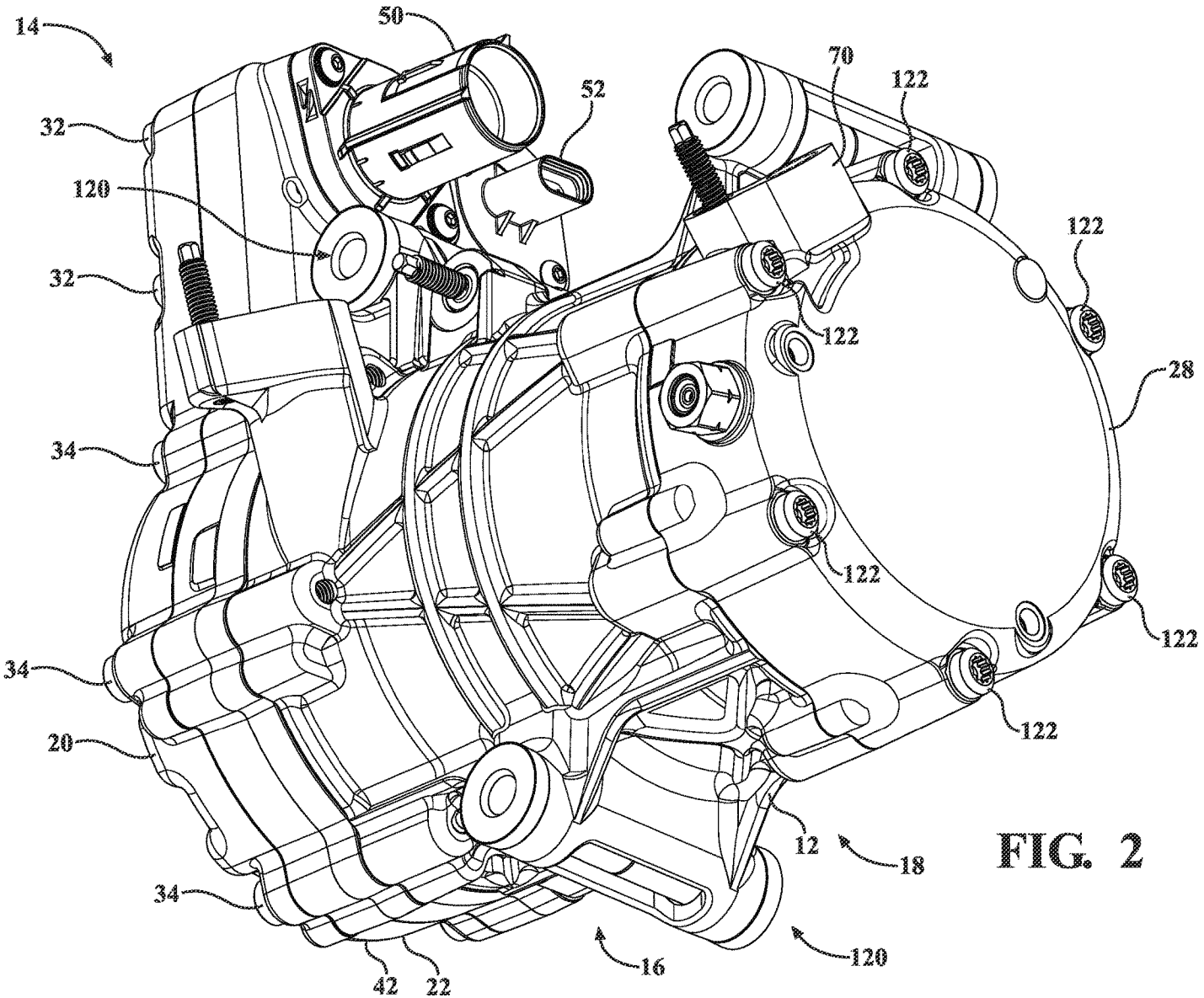
FIG. 2 is a second perspective view of the electric compressor of FIG. 1A.
Figure 9:
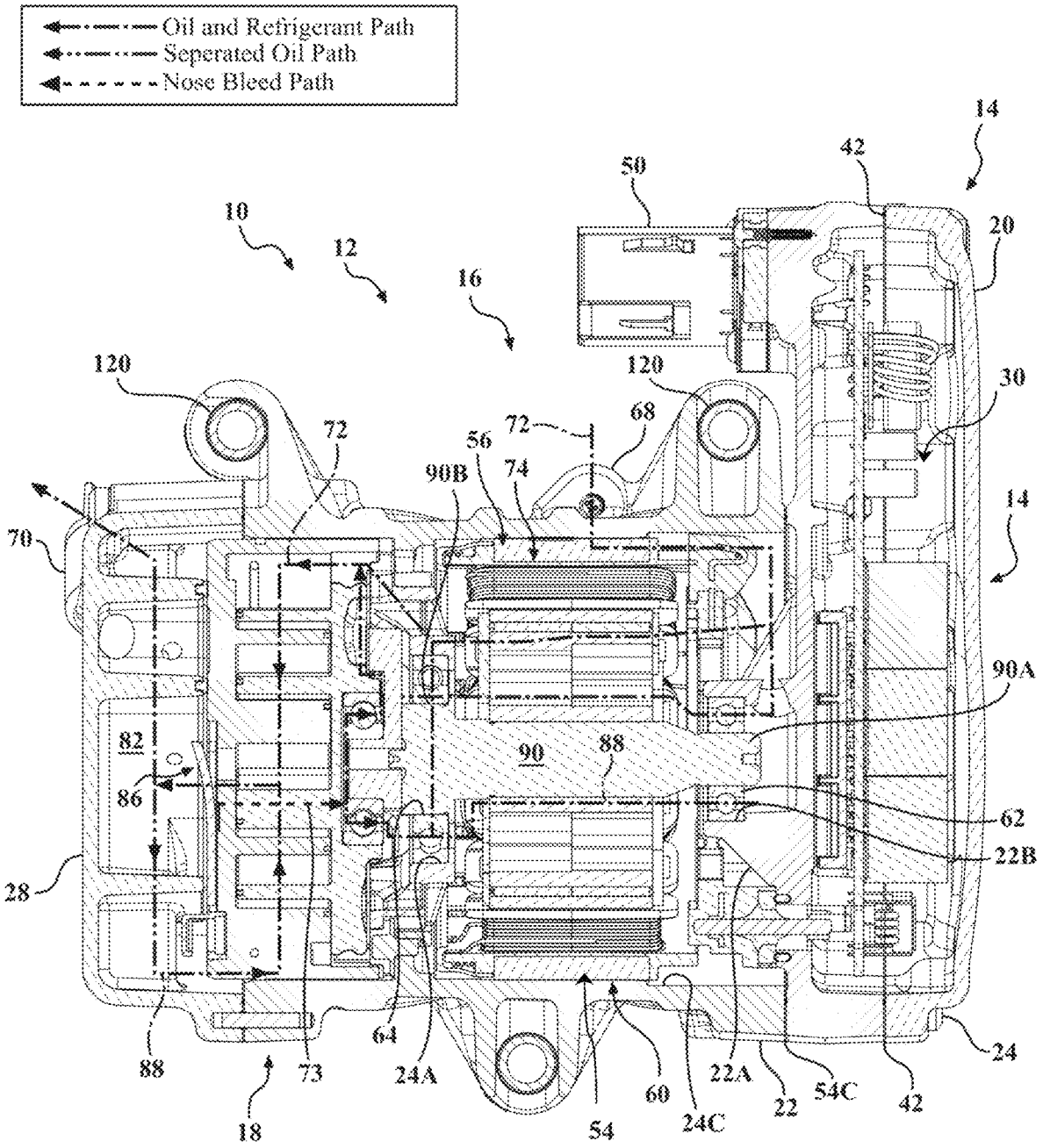
FIG. 9 is a first cross-sectional view of the electric compressor of FIG. 1A.
Figure 10:
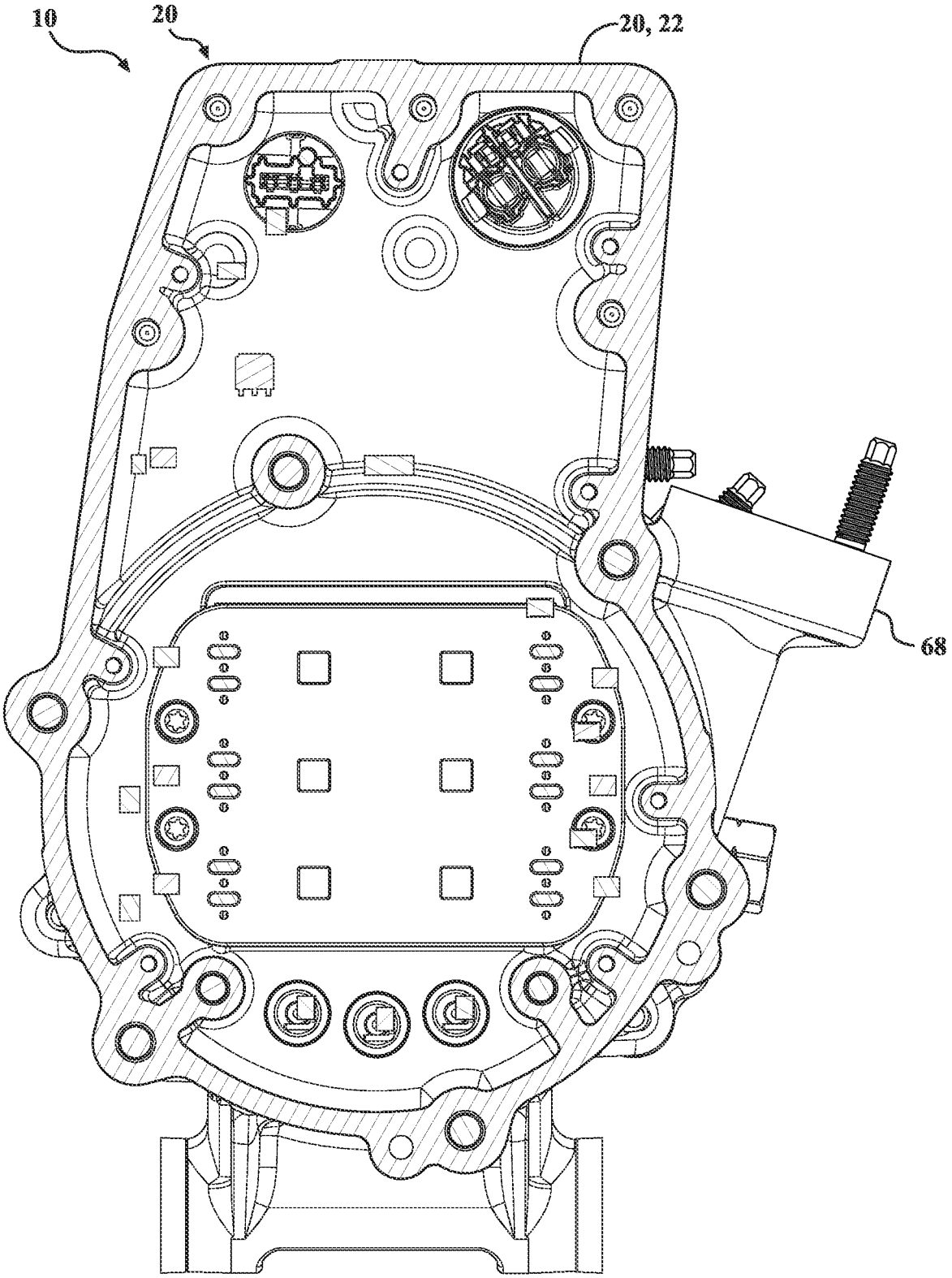
FIG. 10 is a second cross-sectional view of the electric compressor of FIG. 1A.

With specific reference to FIGS. 1, 2 and 9, intermixed refrigerant and oil (at low pressure) enters the electric compressor 10 via a refrigerant inlet port 68 and exits the electric compressor 10 (at high pressure) via refrigerant outlet port 70 after being compressed by the compression device 18. As shown in the cross-sectional view of FIG. 9, the refrigerant follows the refrigerant path 72 through the electric compressor 10. As shown, refrigerant enters the refrigerant inlet port 68 and enters an intake volume 74 formed between the motor side 22A of the inverter housing 22 and the center housing 24 adjacent the refrigerant inlet port 68. Refrigerant is then drawn through the motor section 16 and enters a compression intake volume 76 formed between an internal wall of the fixed scroll 26 and the orbiting scroll 66 (demonstrated by arrow 92 in FIG. 14A).

Figure 13:
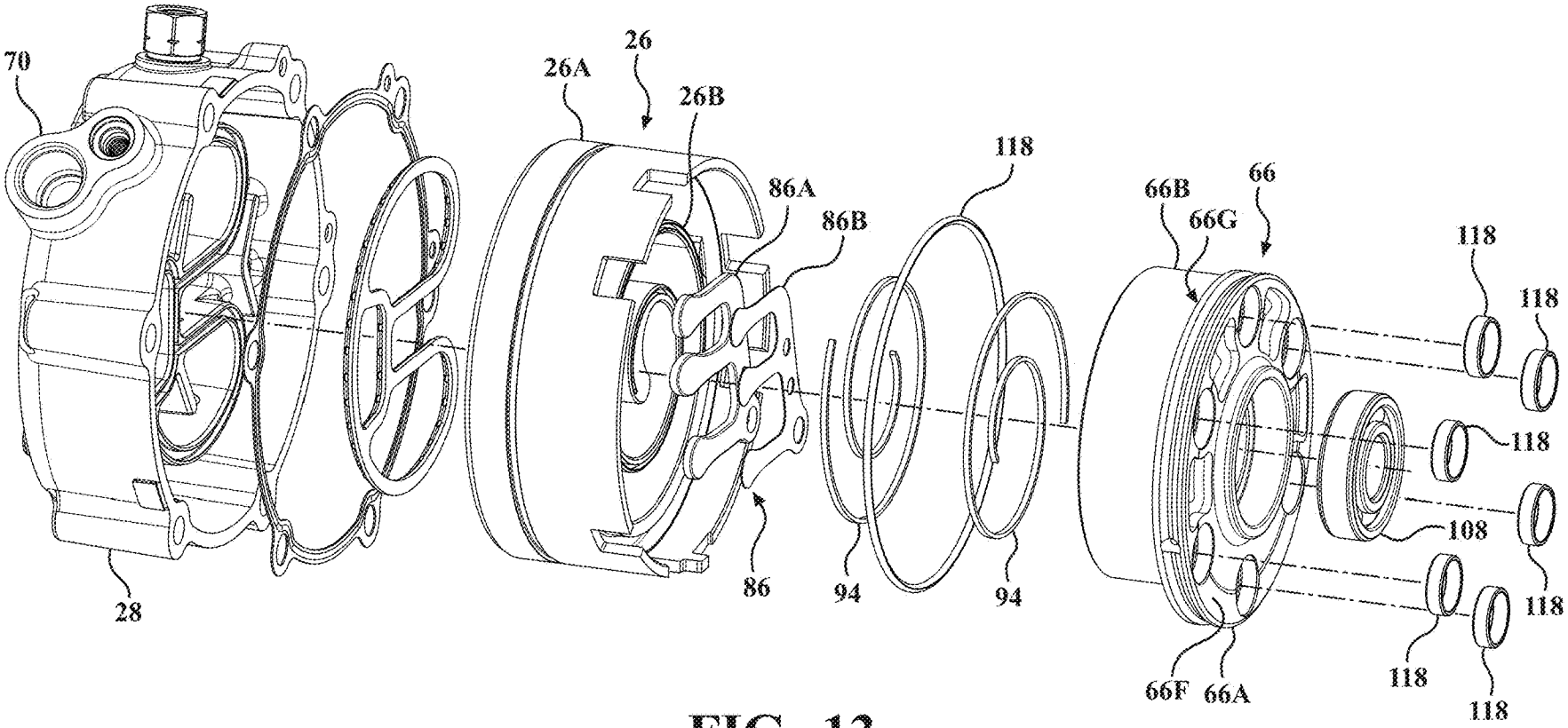
FIG. 13 is an exploded view of a compression device of the electric compressor of FIG. 1A.
Figure 14A:
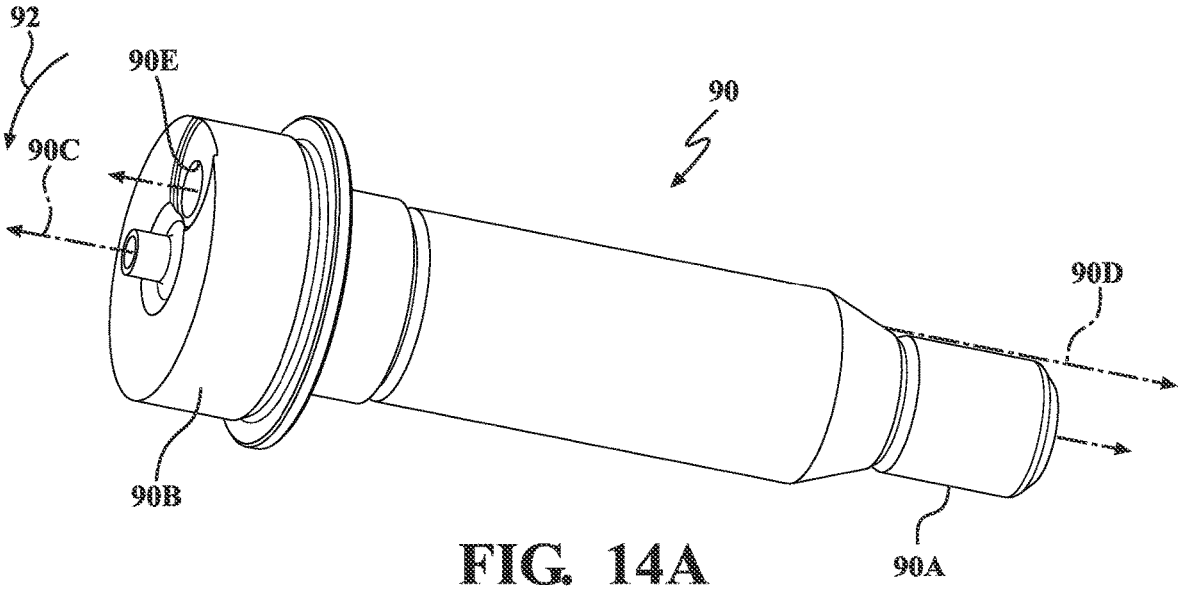
FIG. 14A is a first perspective view of a drive shaft of FIG. 12.
Figure 14B:
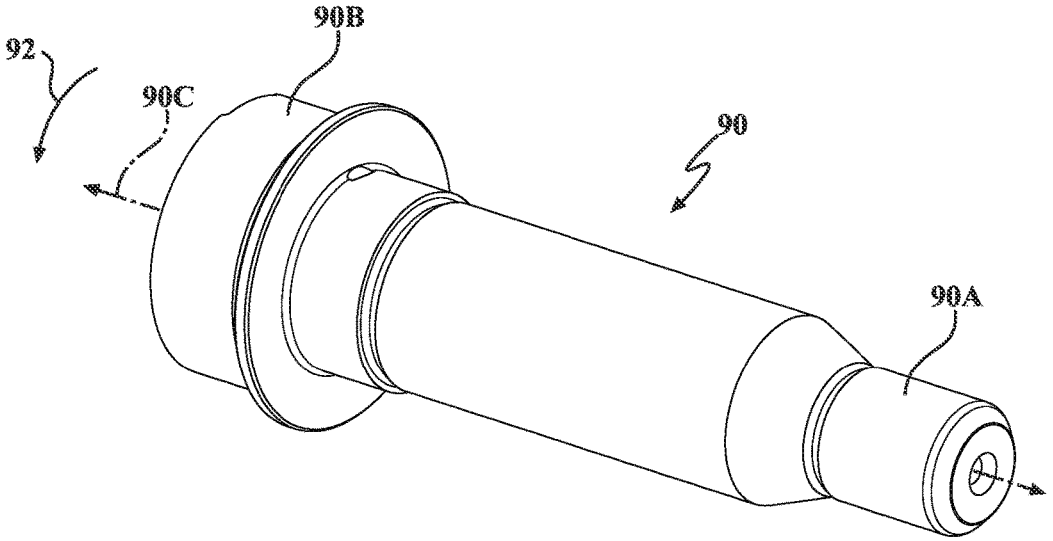
FIG. 14B is a second perspective view of the drive shaft of FIG. 14A.
Figure 15A:
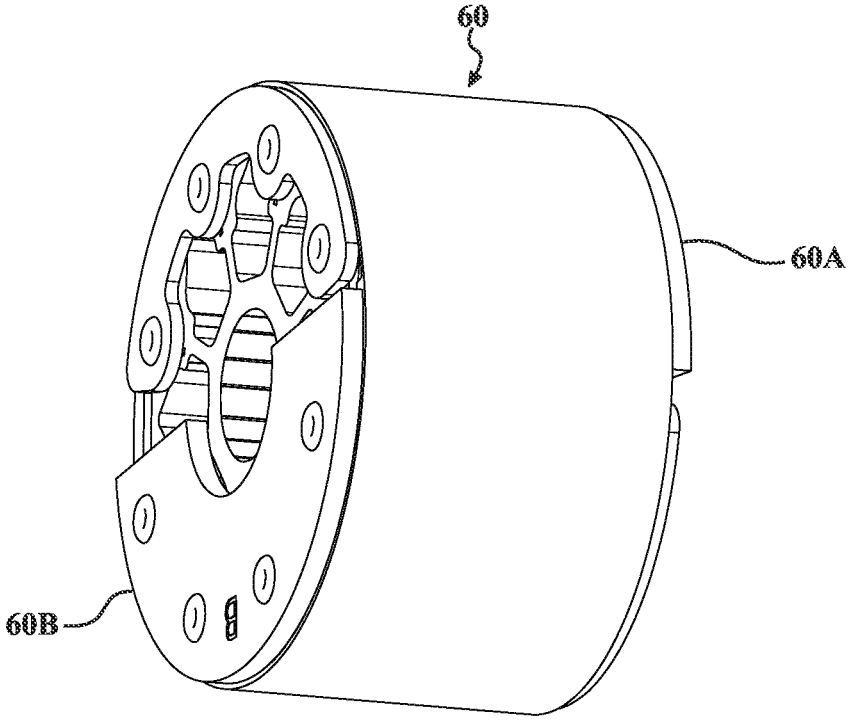
FIG. 15A is a first perspective view of a rotor and counterweights of the motor of FIG. 12.
Figure 15B:
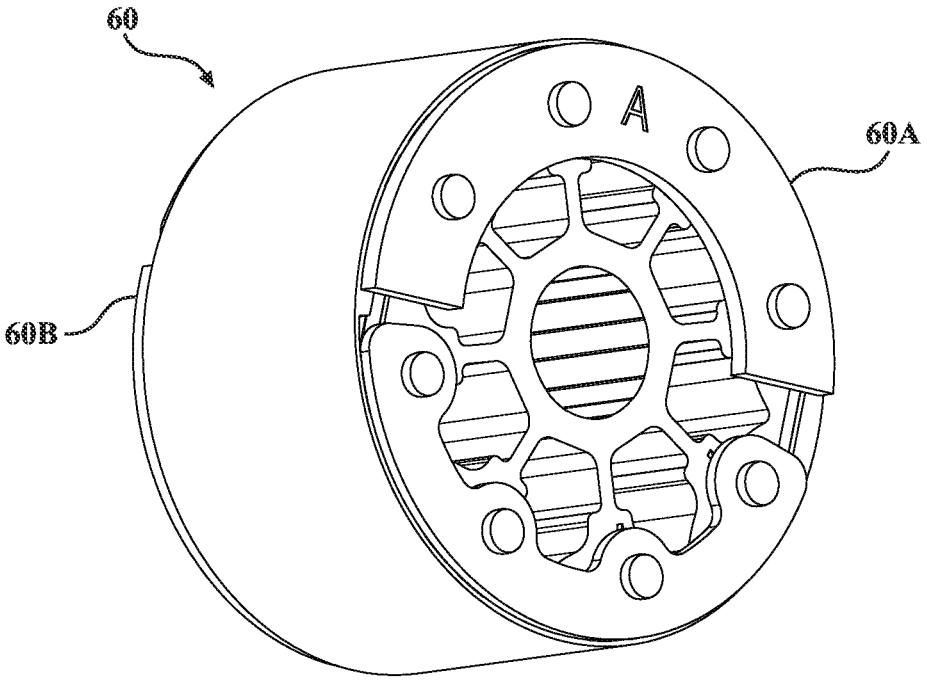
FIG. 15B is a second perspective view of the rotor and counterweights of FIG. 15A.
Figure 16A:
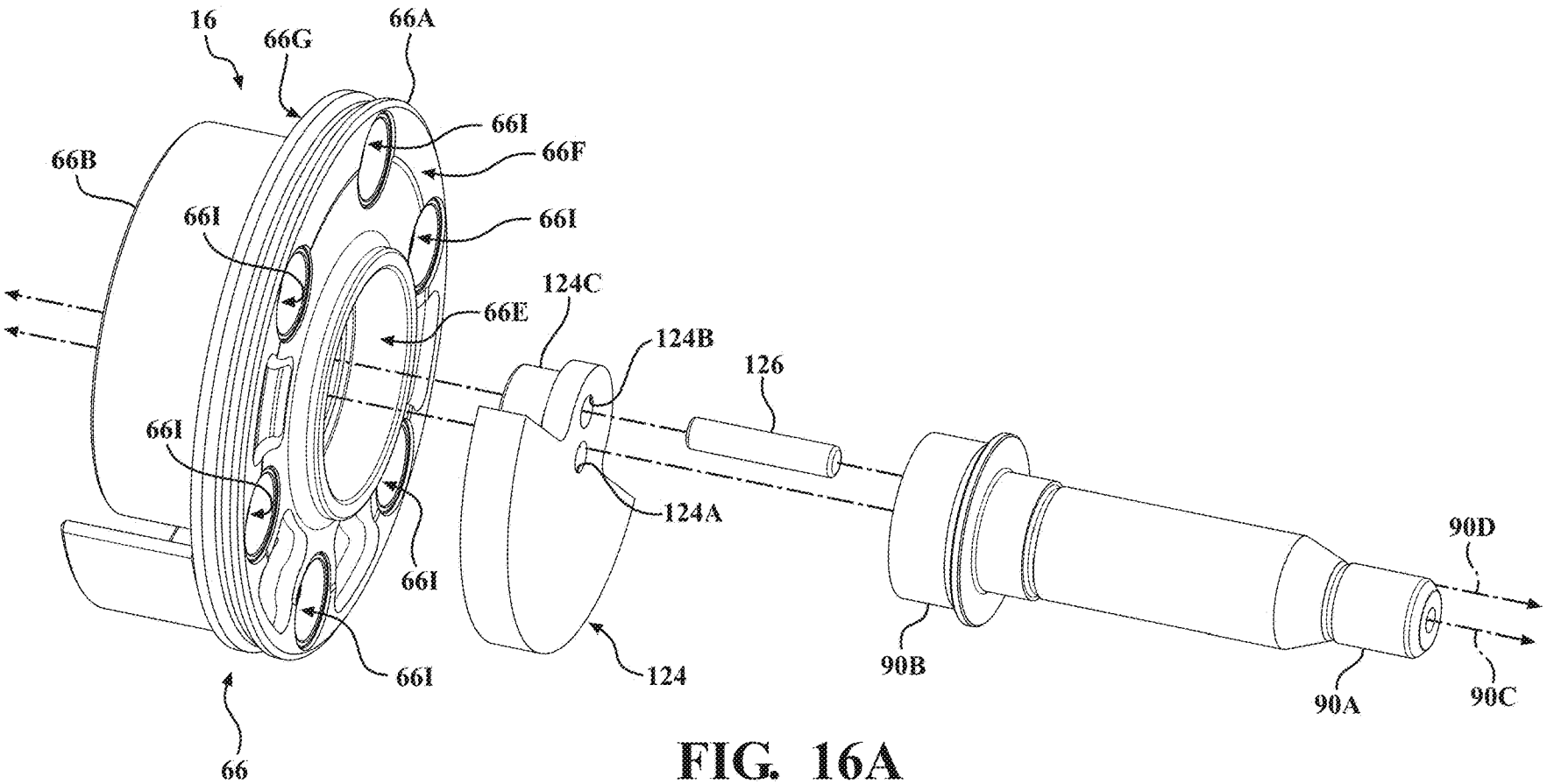
FIG. 16A is a first perspective view of a portion of the electric compressor of FIG. 1, including an orbiting scroll, drive pin and swing-link mechanism.
Figure 16B:
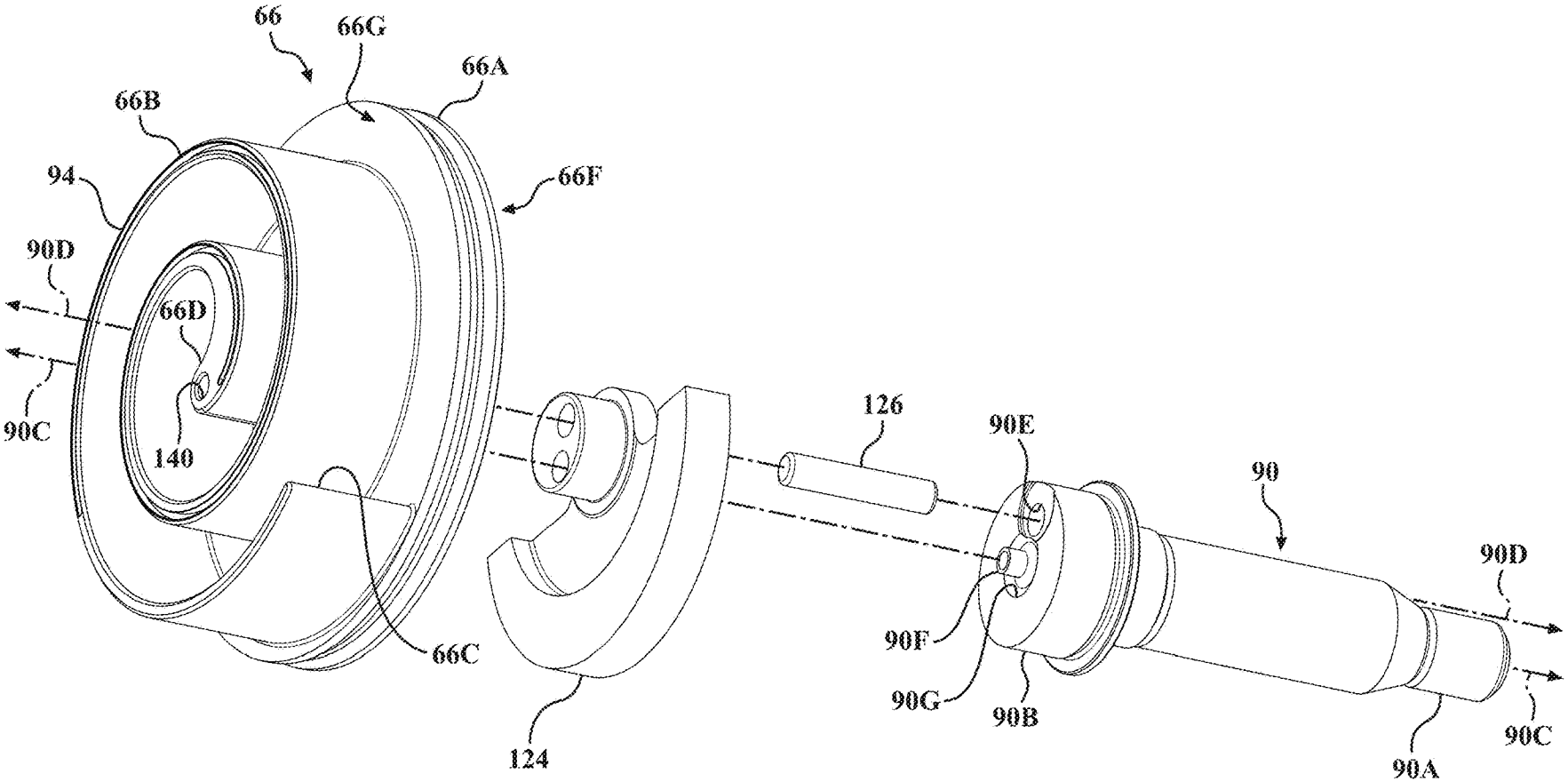
FIG. 16B is a second perspective view of the portion of the electric compressor of FIG. 16A.

The fixed scroll 26 is mounted within the center housing 24. As shown in FIGS. 9 and 13, the fixed scroll 26 has a fixed scroll base 26A and a fixed scroll lap 26B extending away from the fixed scroll base 26A towards the orbiting scroll 66. As shown in FIGS. 16A-16B, the orbiting scroll 66 has an orbiting scroll base 66A and an orbiting scroll lap 66B extending from the orbiting scroll base 66A towards the fixed scroll 26. The laps 26B, 66B have a tail end 26C, 66C adjacent an outer edge of the respective scroll 26, 66 and scroll inward towards a respective center end 26D, 66D.

Respective tip seals 94 are located within a slot (not shown) located at a top surface of the fixed scroll 26 and the orbiting scroll 66, respectively. The tip seals 94 are comprised of a flexible material, such as a Polyphenylene Sulfide (PPS) plastic. When assembled, the tip seals 94 are pressed against the opposite base 26A 66A to provide a seal therebetween. In one embodiment, the slots, are longer than the length of the tip seals 94 to provide room for adjustment/movement along the length of the tip seals 94.

With reference to FIGS. 17A-17I, refrigerant enters the compression device 12 from the compression intake volume 76. In FIGS. 17A-17I, a cross-section view of the fixed scroll 26 and the top of the orbiting scroll 66 are shown.

As discussed in detail below, the fixed scroll lap 26B and the orbiting scroll lap 66B form compression chambers 80 in which low or unpressurized (saturation pressure) refrigerant enters from the compression device 12. As the orbiting scroll 66 moves to enable the compression chambers 80 to be closed off and the volume of the compression chambers 80 is reduced to pressurize the refrigerant. At any one time during the cycle, one or more compression chambers 80 are at different stages in the compression cycle. The below description relates just to one set of compression chambers 80 during a complete cycle of the electric compressor 10.

The refrigerant enters the compression chambers 80 formed between the orbiting scroll lap 66B and the fixed scroll lap 26B. During a cycle of the compressor 10, the refrigerant is transported towards the center of these chambers. The orbiting scroll 66 orbits in a circular motion indicated by arrow 78 formed by the relative position of the orbiting scroll 66 relative to the fixed scroll 26 is shown during one cycle of the electric compressor 10.

Figure 17A:
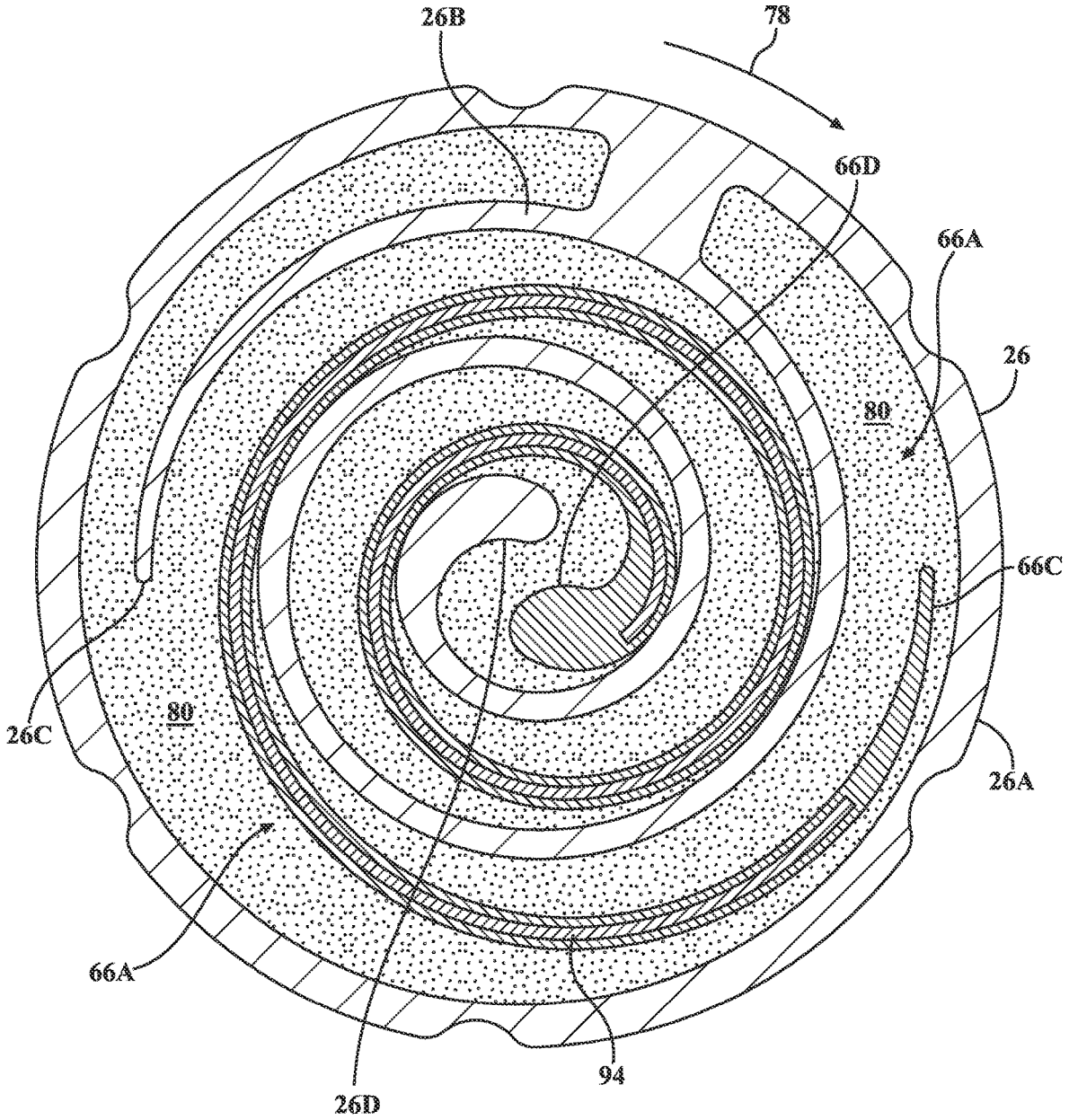
FIGS. 17A-17J are graphic representations of a fixed scroll and an orbiting scroll of a compression device of the electric compressor of FIG. 1, according to an embodiment of the present invention.
Figure 17B:
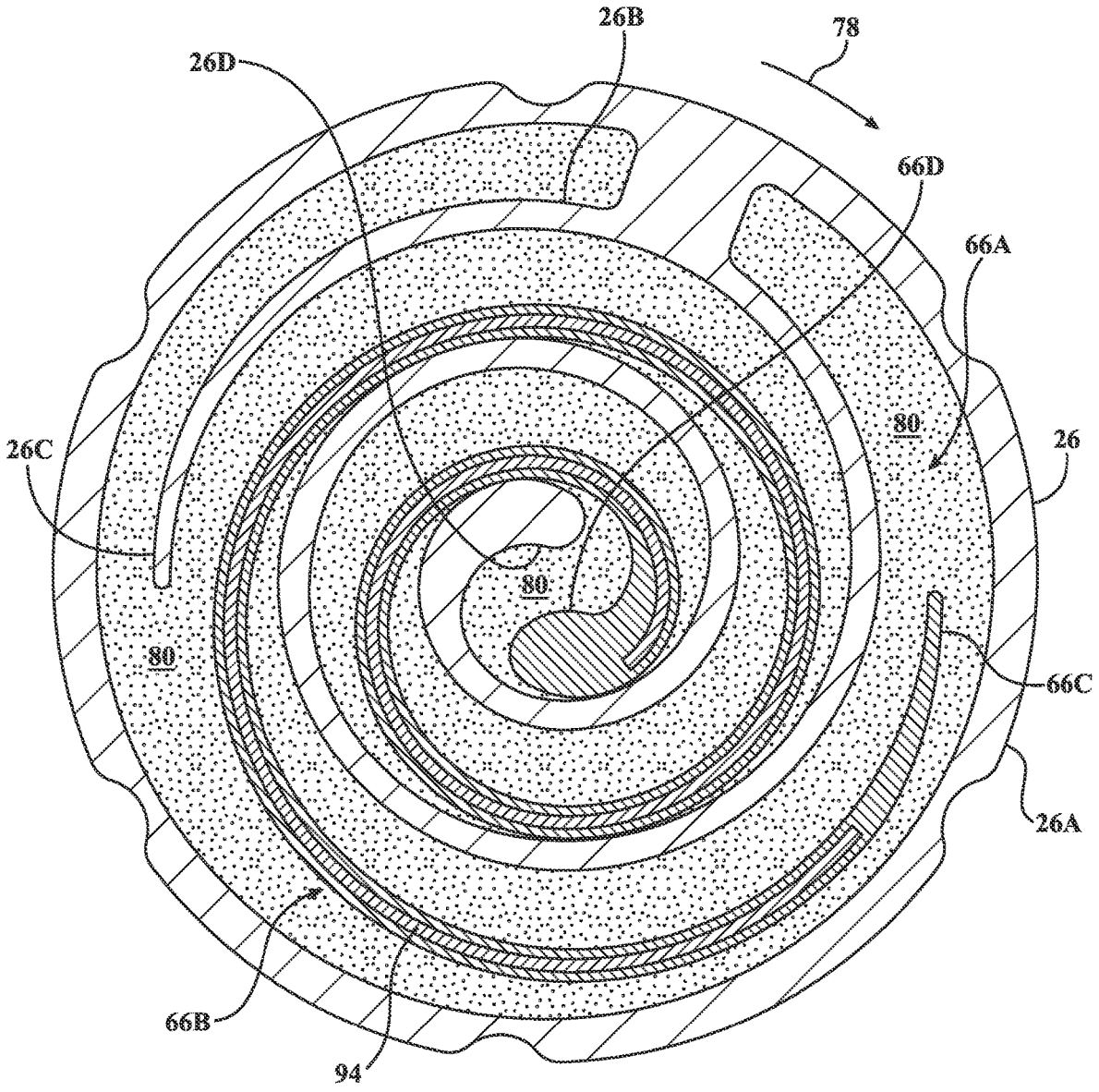
Figure 17C:
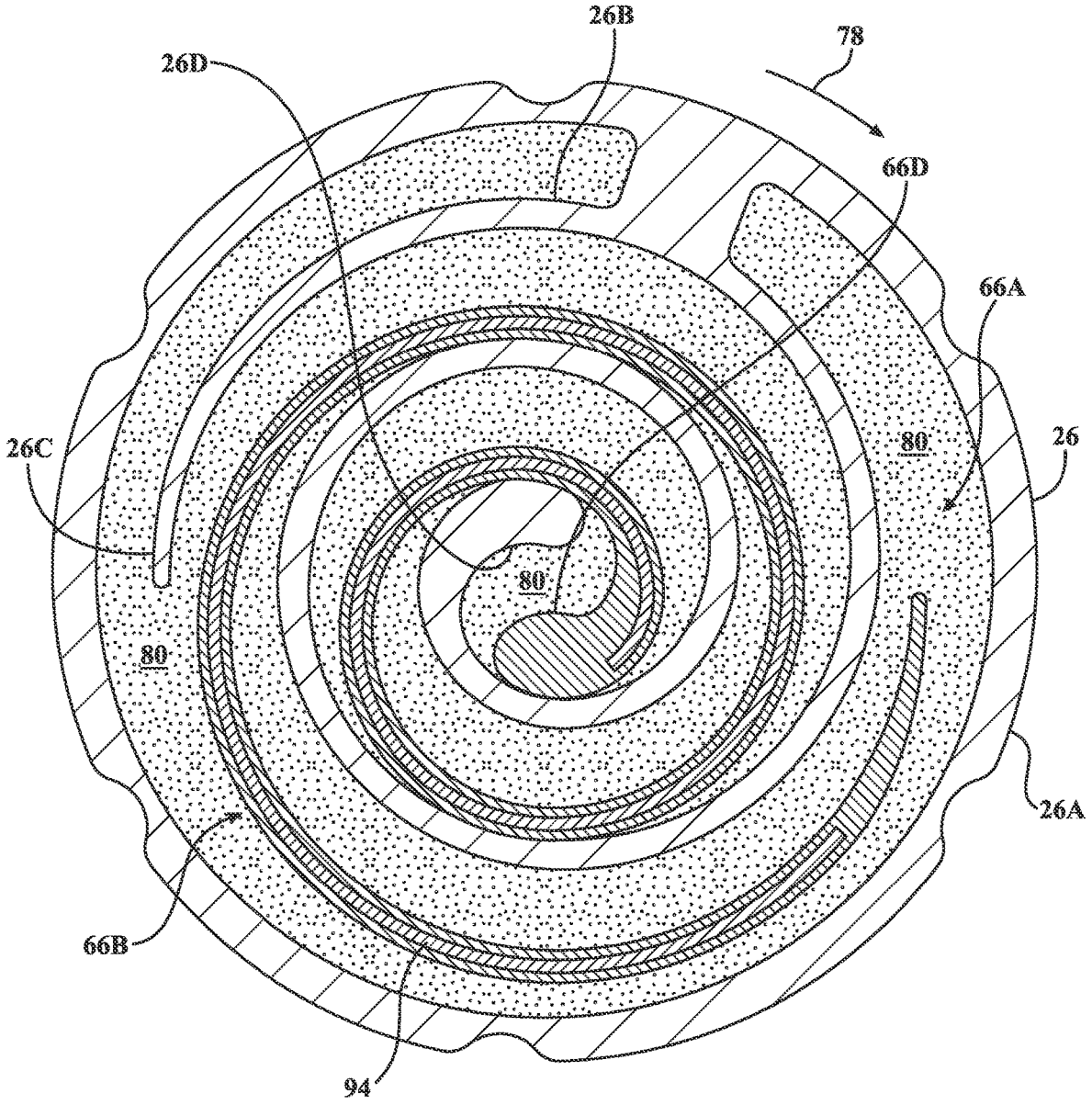
Figure 17D:
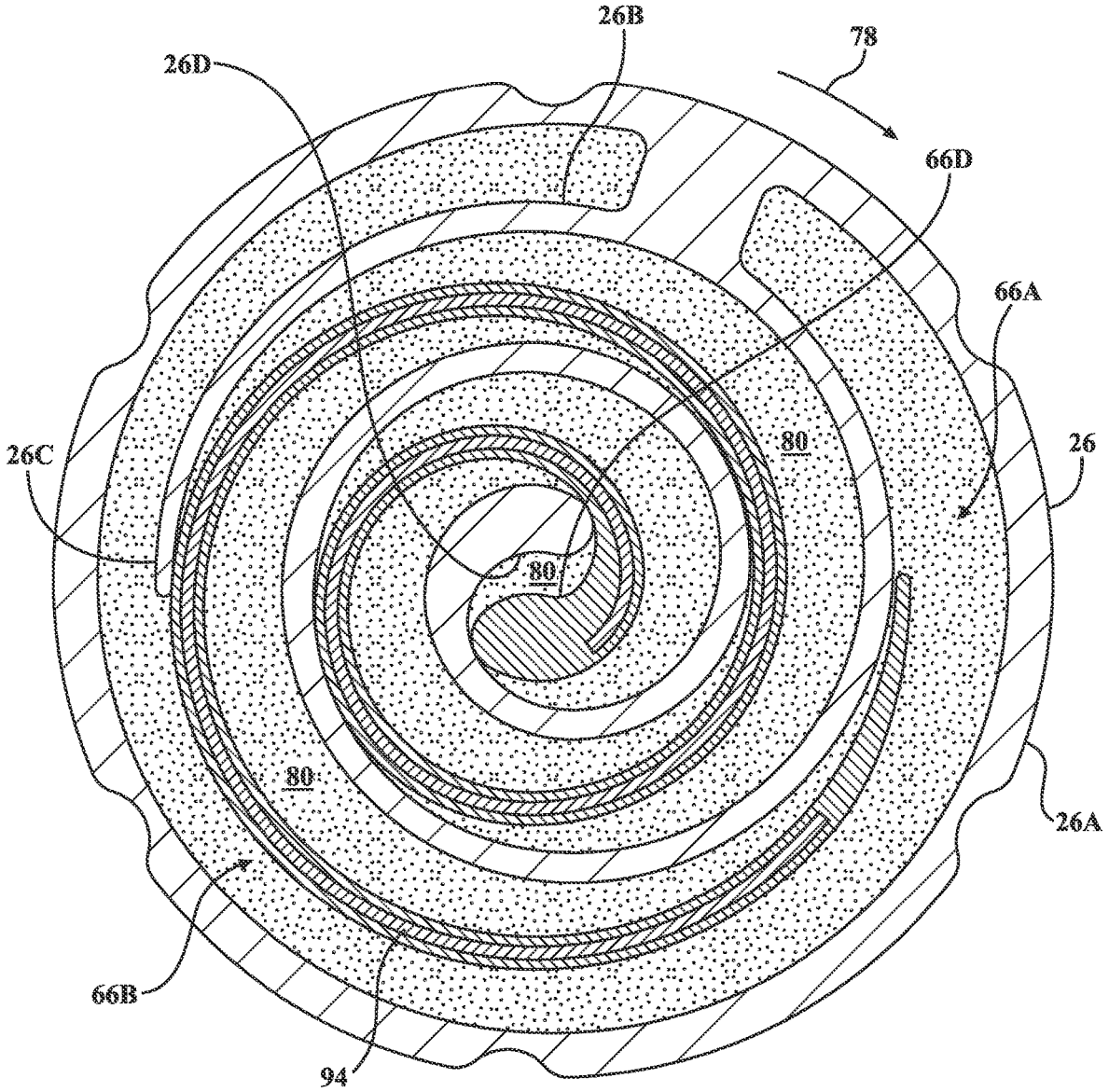
Figure 17E:
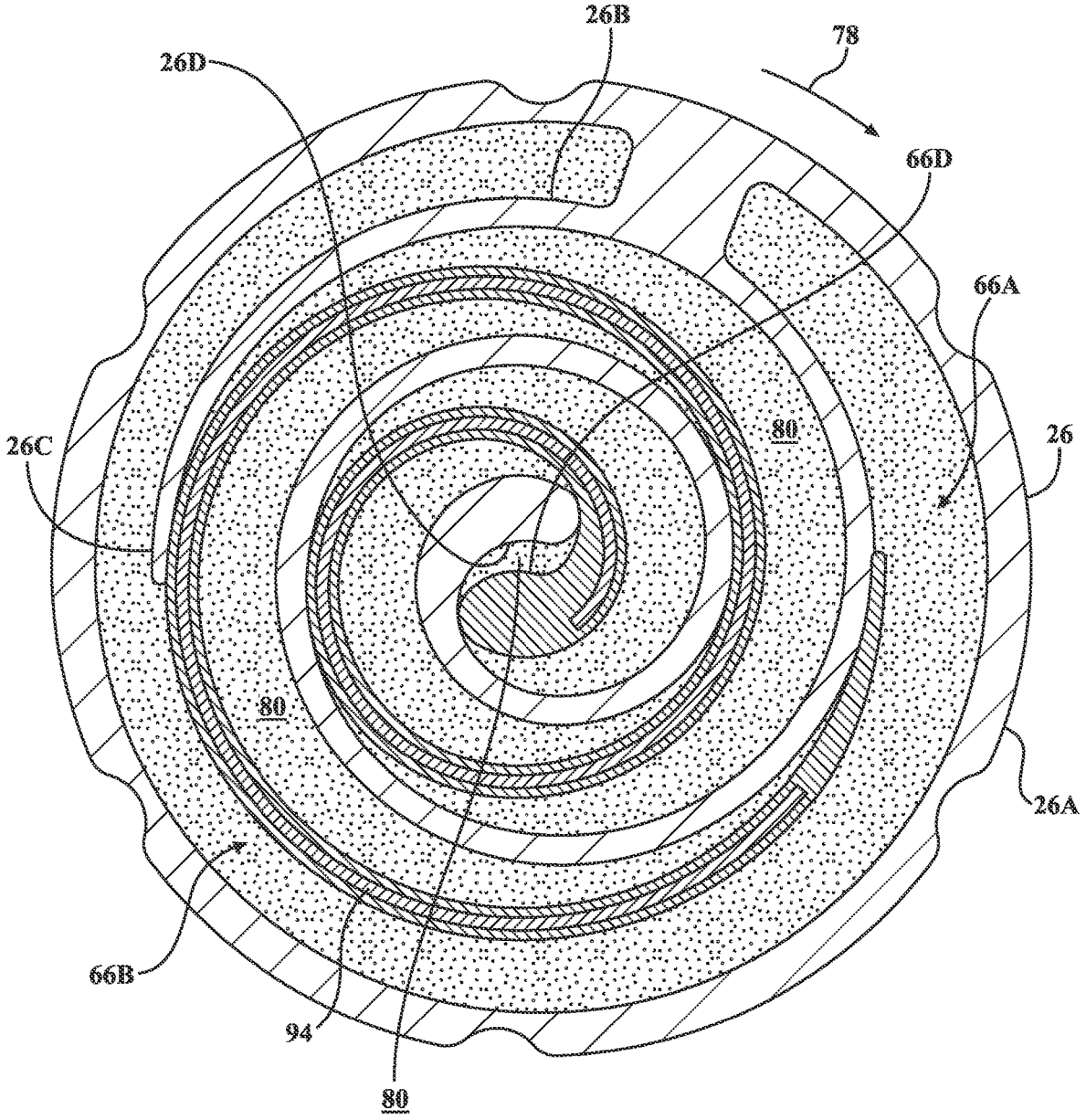
Figure 17F:
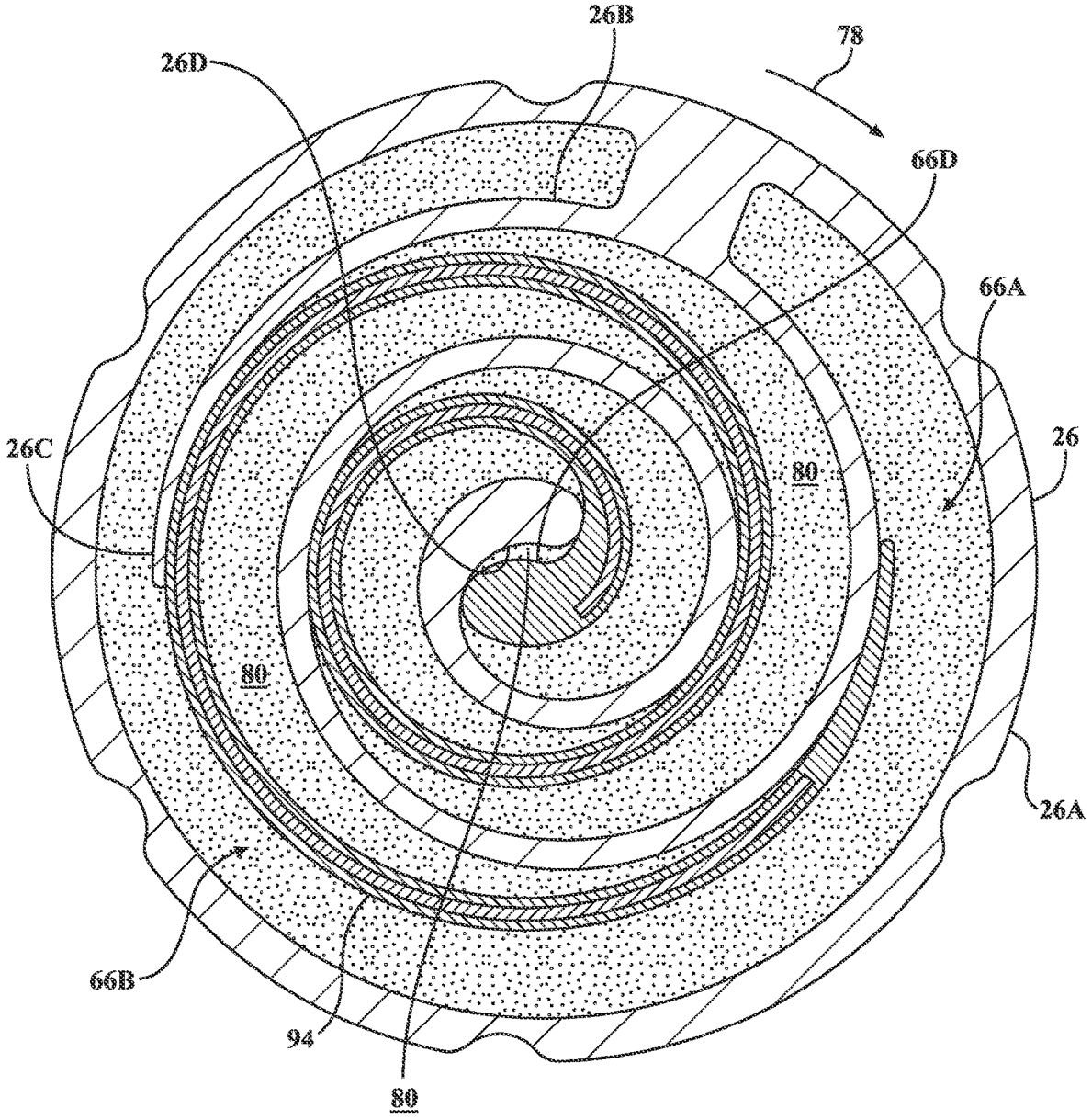
Figure 17G:
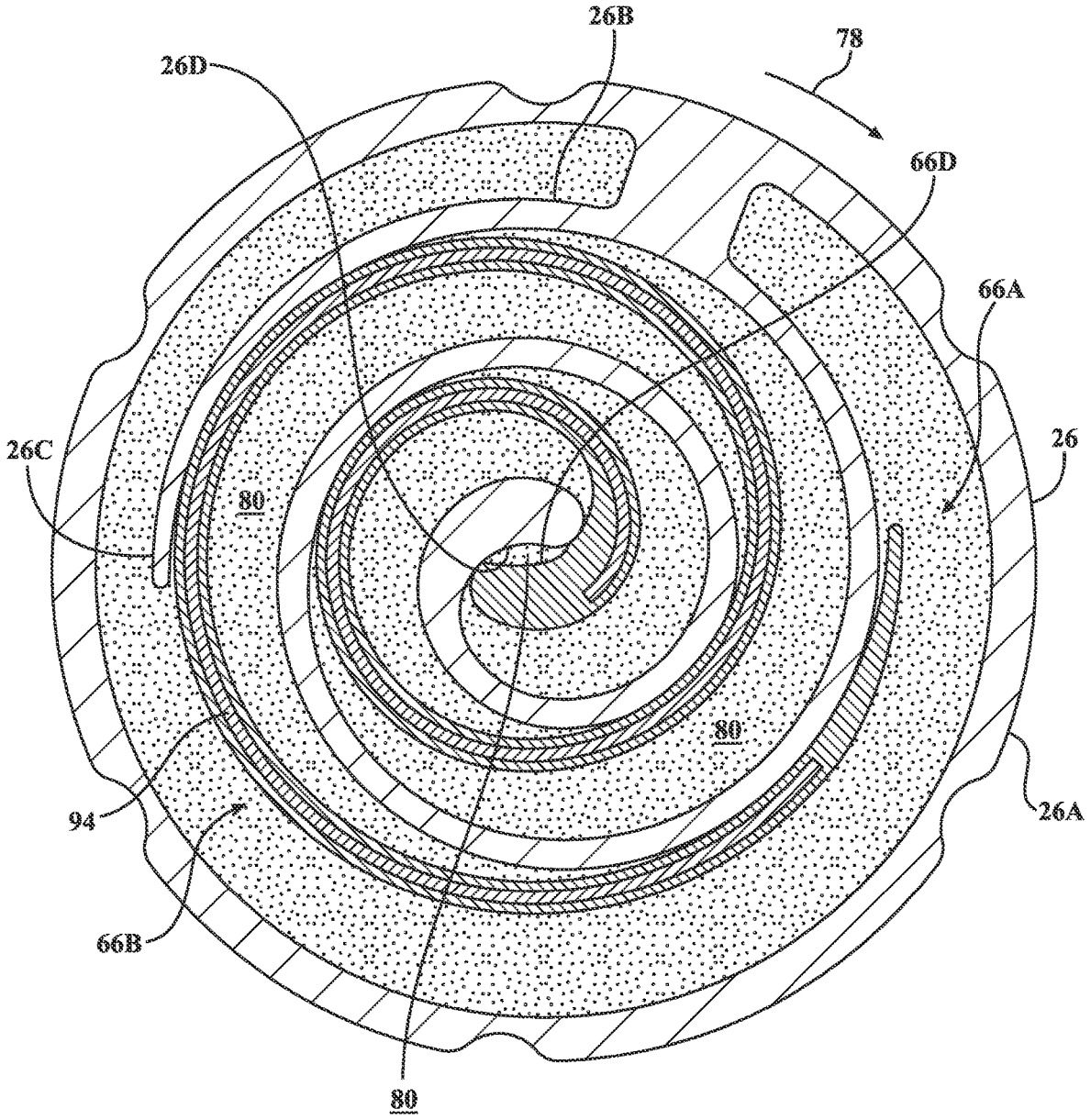
Figure 17H:
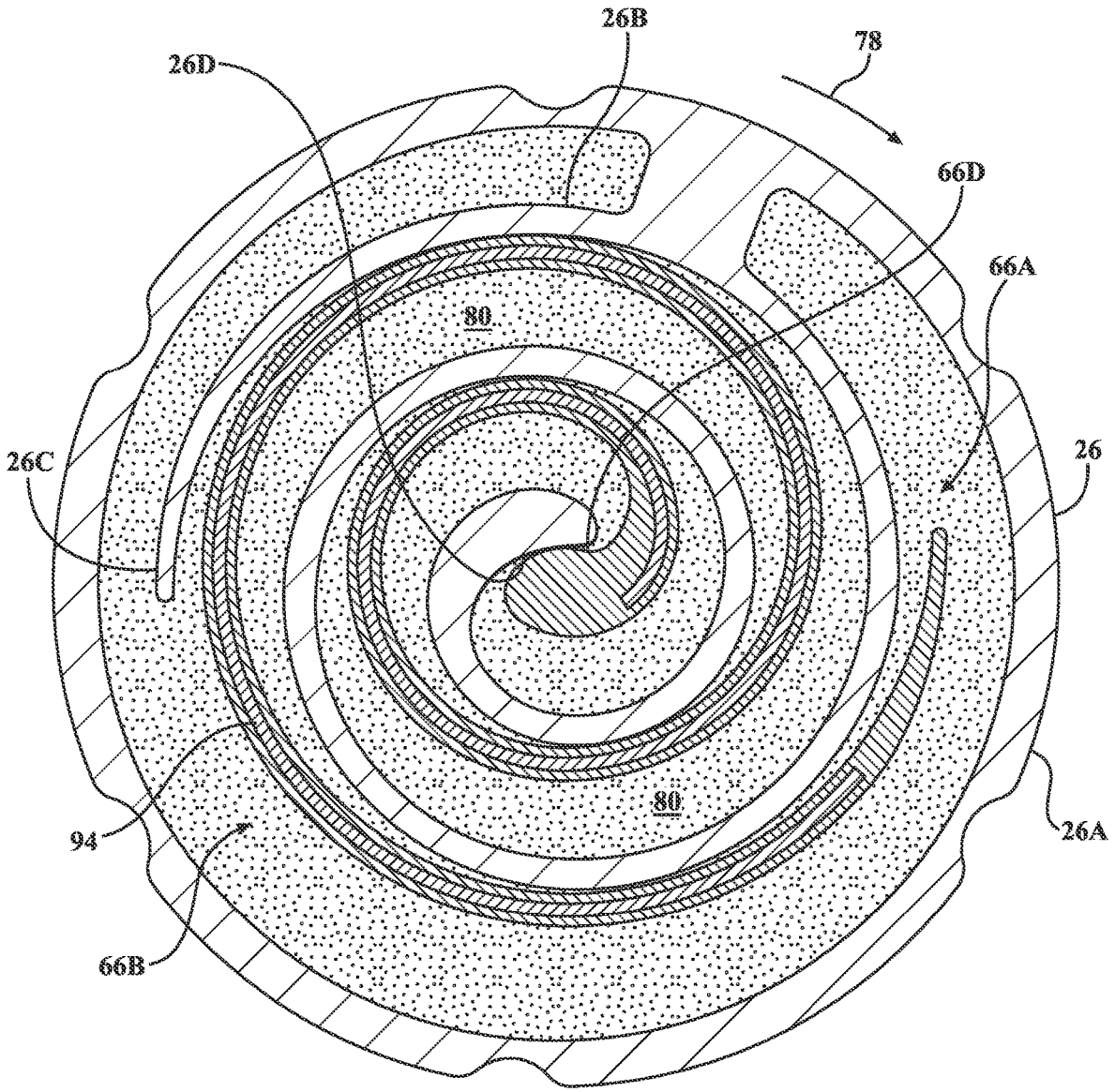
Figure 17I:
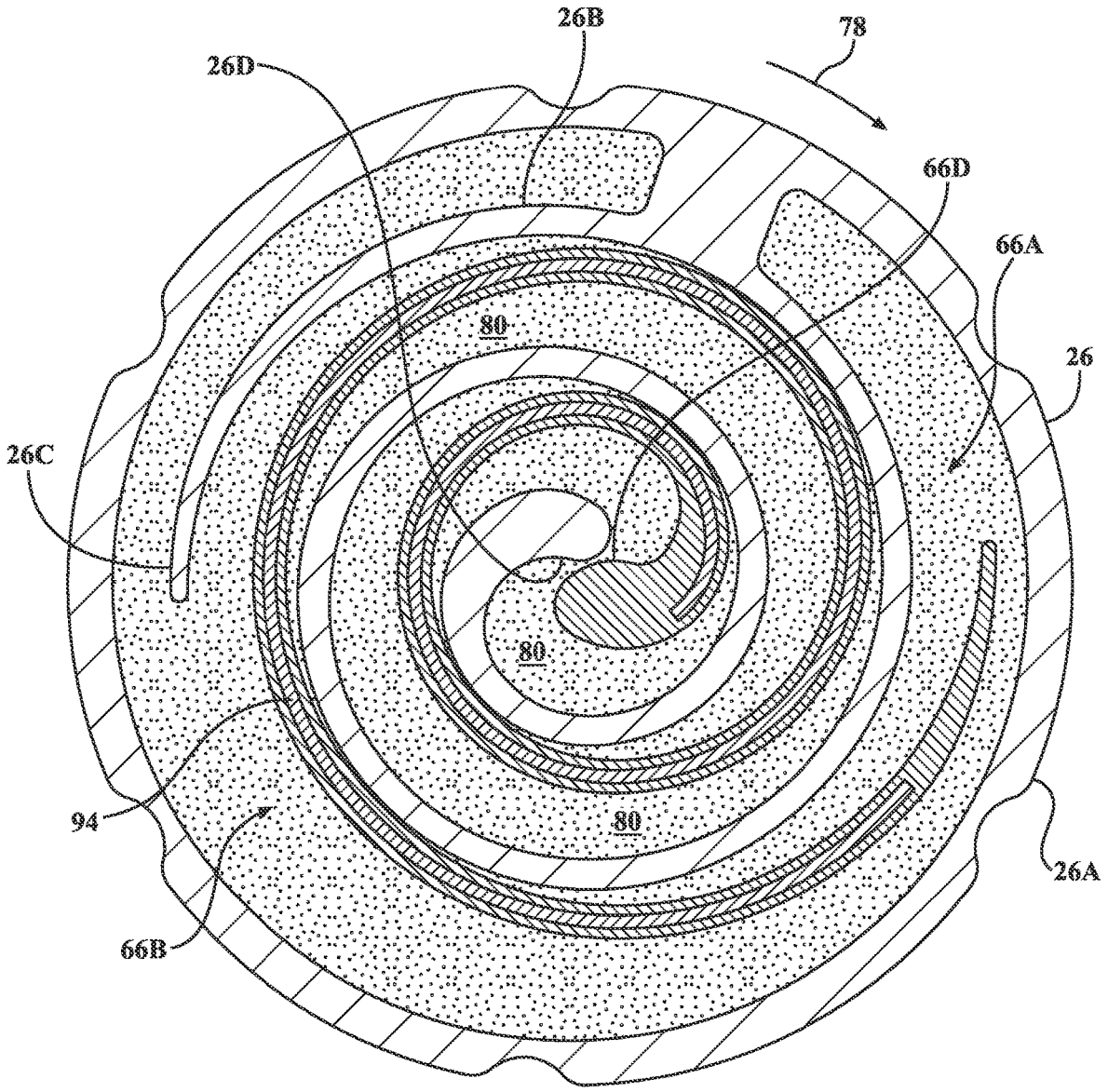
Figure 17J:
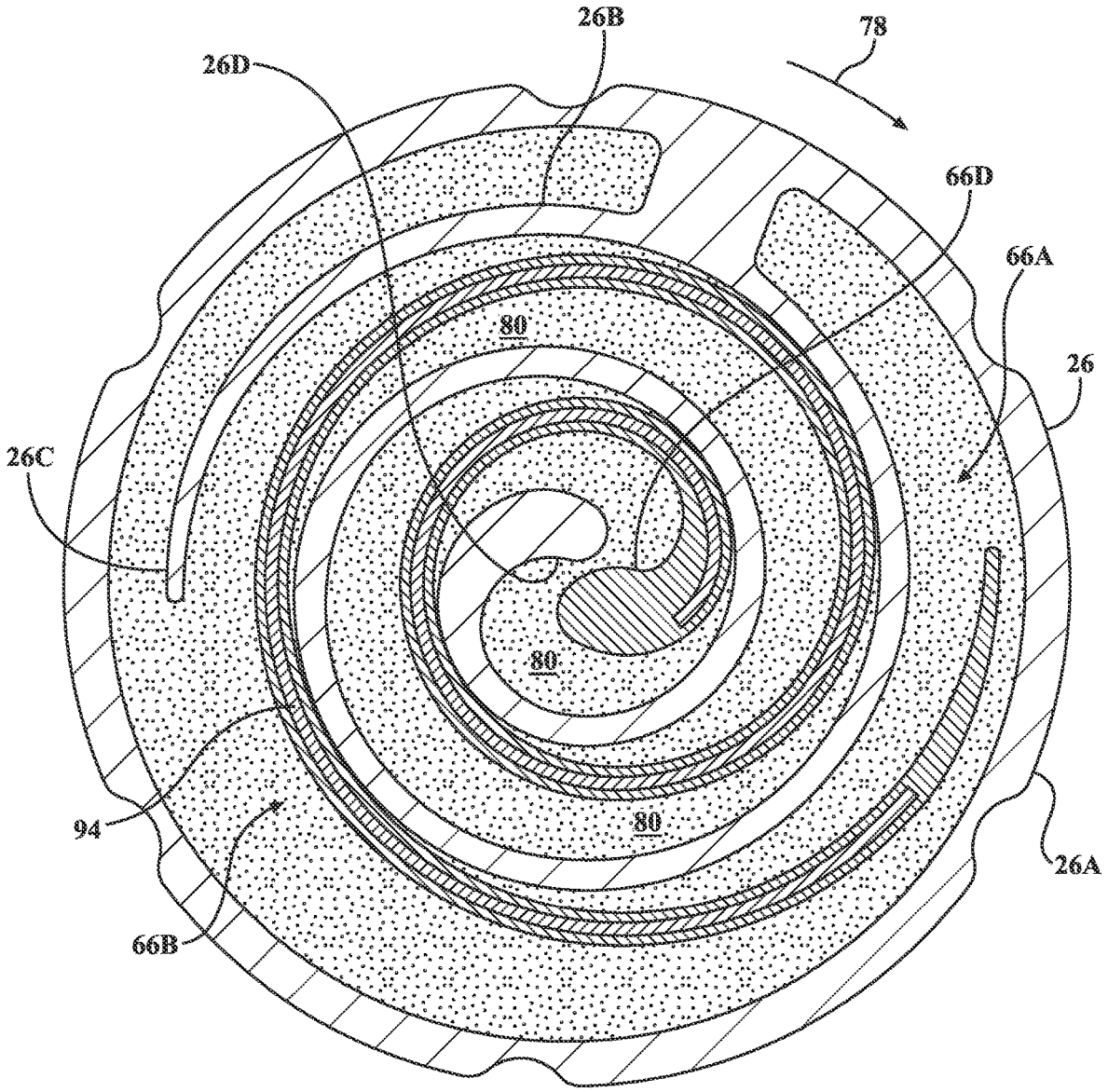

In FIG. 17A, the position of the orbiting scroll 66 at the beginning of a cycle is shown. As shown, in this initial position, the tail ends 26C, 66C are spaced apart from the other scroll lap 66B, 26B. At this point, the compression chambers 80 are open to the compression intake volume 76 allowing refrigerant under low pressure to fill the compression chambers 80 from the compression intake volume 76. As the orbiting scroll 66 moves along path 78, the space between the tail ends 26C, 66C and the other scroll 66, 16 decreases until the compression chambers 80 are closed off from the compression intake volume 76 (FIGS. 17B-17E). As the orbiting scroll 66 continues to move along 78, the volume of the compression chambers 80 is further reduced, thus pressurizing the refrigerant in both compression chambers 80 (FIGS. 17F-H). As shown in FIGS. 17I-18J, as the orbiting scroll 66 continues to orbit, the two compression chambers 80 are combined into a single volume. This volume is further reduced until the pressurized refrigerant is expelled from the compression device 18 (see below)

As discussed below, the refrigerant enters chambers formed between the walls of the orbiting scroll 66 and the fixed scroll 26. During the cycle of the compressor 10, the refrigerant is transported towards the center of these chambers. The orbiting scroll 66 orbits or moves in a circular motion indicated by arrow 78 formed by the relative position of the orbiting scroll 66 relative to the fixed scroll 26 is shown during one cycle of the electric compressor 10.

Returning to FIG. 1, the front cover 28 forms a discharge volume 82. The discharge volume 82 is in communication with the refrigerant output port 70. As discussed in more detail below, pressurized refrigerant leaves the compression device 18 through a central orifice 84A and two side orifices 84B in the fixed scroll 26 (see FIGS. 18C and 18E) The release of pressurized refrigerant is controlled by a reed mechanism 86. In the illustrated embodiment, the reed mechanism 86 includes three reeds: a central reed 87A and two side reeds 87B corresponding to the central orifice 84A and the two side orifices 84B (see below).

Figure 18A:
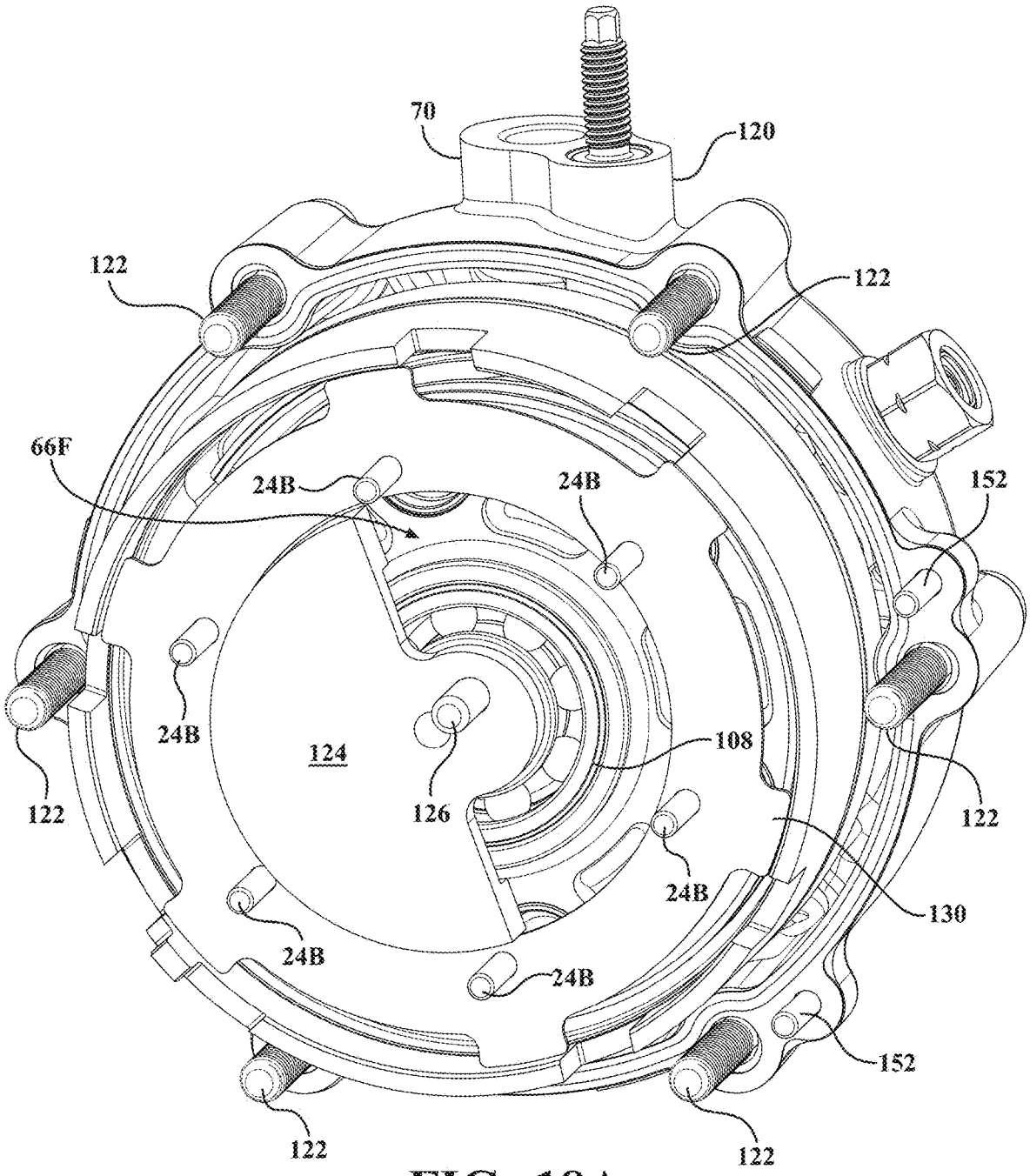
FIG. 18A is a first perspective view of a portion of the compression device of FIG. 13, including a fixed scroll and an orbiting scroll.
Figure 18B:
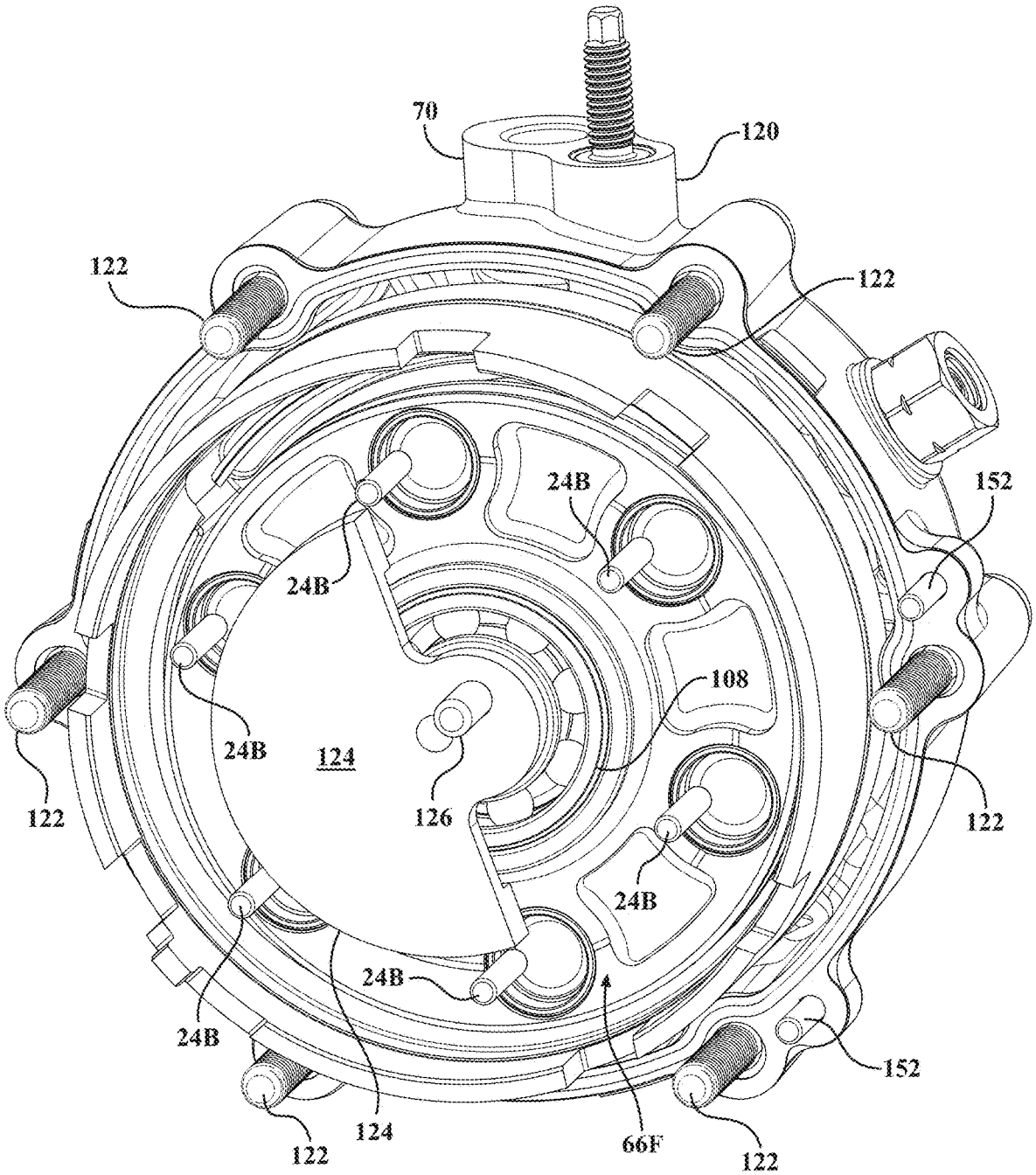
FIG. 18B is a second perspective view of the portion of the compression device of FIG. 18A.
Figure 18C:
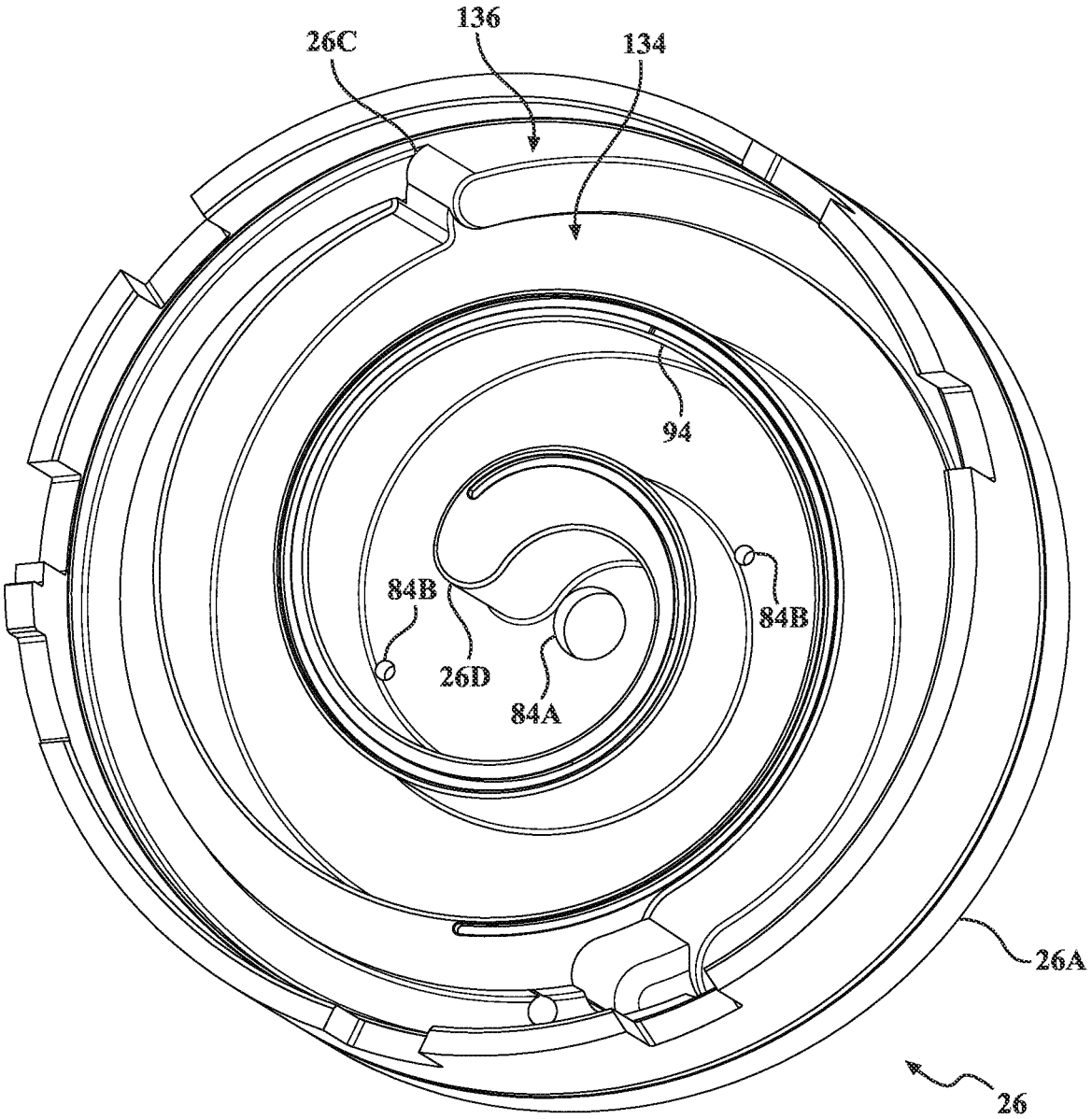
FIG. 18C is a first perspective view of the fixed scroll of the compression device of FIG. 13.
Figure 18D:
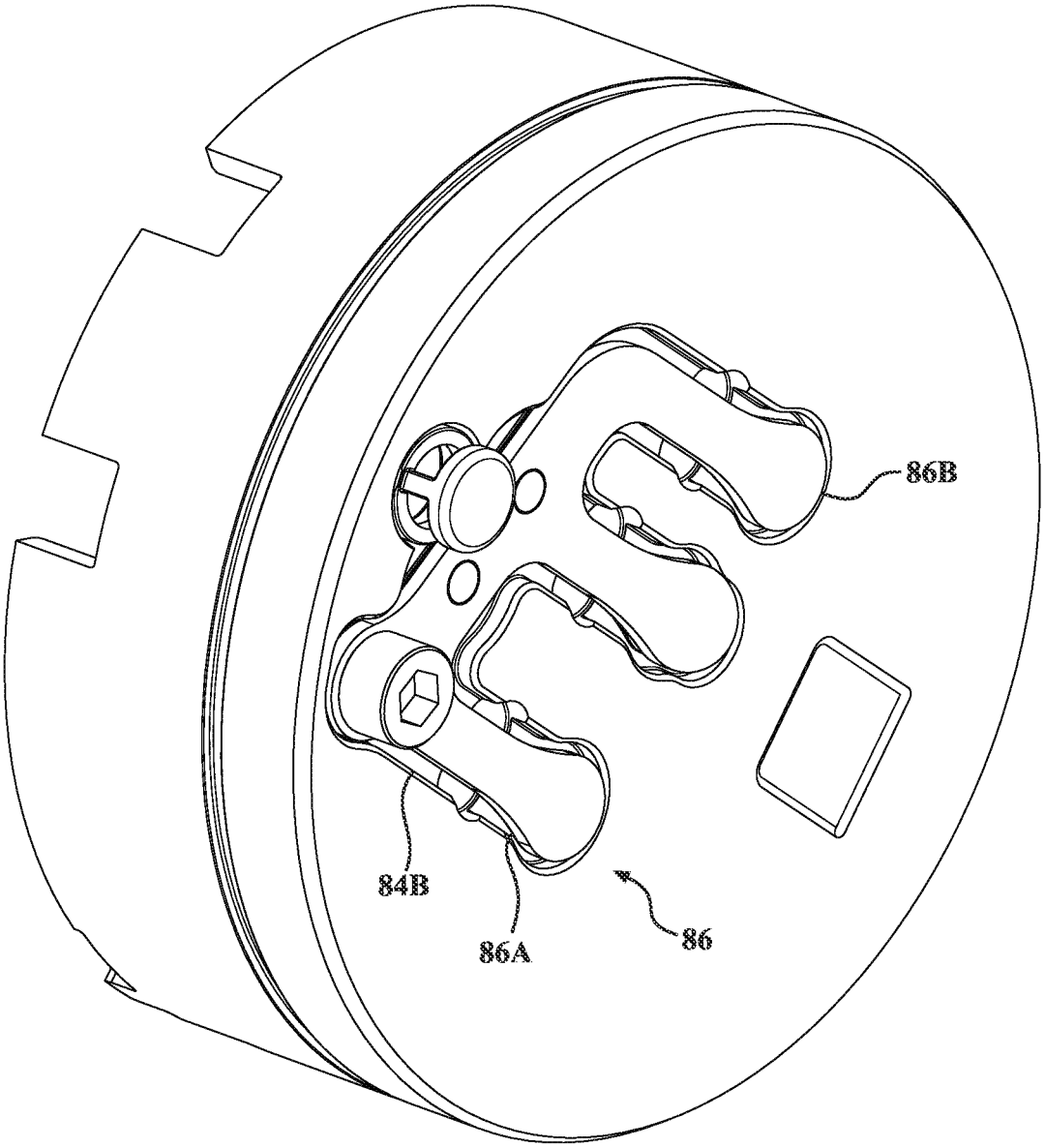
FIG. 18D is a second perspective view of the fixed scroll of the compression device of FIG. 13.
Figure 18E:
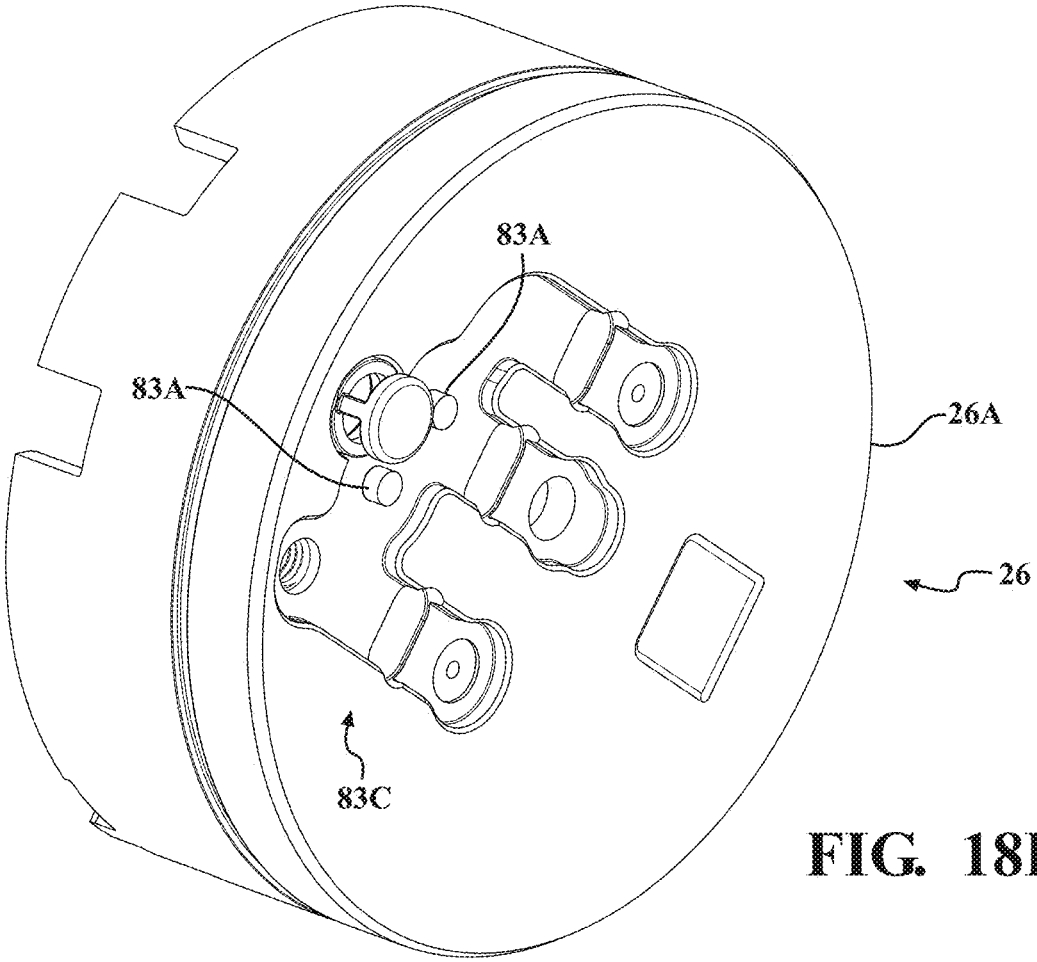
FIG. 18E is a third perspective view of the fixed scroll of the compression device of FIG. 13.

As shown in FIGS. 18D and 18E, in the illustrated embodiment, the reed mechanism 86 includes a discharge reed 86A and a reed retainer 86B. The discharge reed 86A is made from a flexible material, such as steel. The characteristics, such as material and strength, are selected to control the pressure at which the pressurized refrigerant is released from the compression device 18. The reed retainer 86B is made from a rigid, inflexible material such as stamped steel. The reed retainer 86B controls or limits the maximum displacement of the discharge reed 86A relative to the fixed scroll 26. Generally, oil is directed rearward through the motor section 16, providing lubrication and cooling to the rotating components of the electric compressor 10, such as the rotor 60, the drive shaft 90 and all bearings 62, 64, 108. Oil is drawn upward towards the top of the motor 54 by the rotation of the rotor 60. From there, oil enters the interior of the motor 54 to lubricate the second ball bearing 64 and the oil by the rotational forces within the motor section 16 may impact against the motor side 22A of the inverter housing 22. The oil is further directed by the motor side 22A into the ball bearing 62, as further discussed below.

Figure 18F:
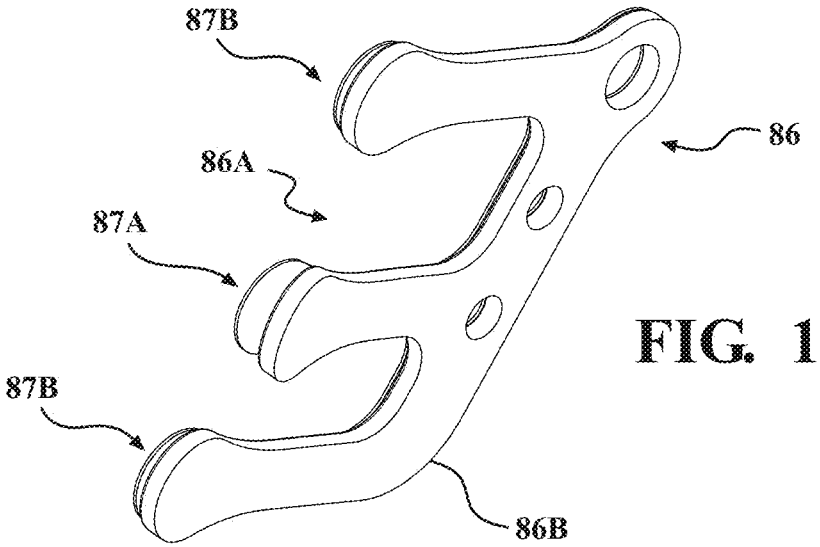
FIG. 18F is a perspective view of a reed mechanism associated with the compression device of FIG. 13.

In the illustrated embodiment, the read mechanism 86 is held or fixed in place via a separate fastener 89. As shown in FIGS. 18E and 18F, the reed mechanism 86 includes a plurality of apertures 86C which are configured to receive associated posts 83A on the fixed scroll 26. As shown in FIG. 18E, the back surface of the fixed scroll 26 includes a bezel 83B surrounding the orifices 84A, 84B which assists in tuning the pressure at which refrigerant exits the compression device 18. Additionally, a debris collection slot 83C collects debris near the orifices 84A, 84B to prevent interference with the reed mechanism 86.

As shown in FIG. 9, the path of refrigerant through the electric compressor is indicated by dashed arrow 72.

The electric compressor 10 utilizes oil (not shown) to provide lubrication to the between the components of the compression device 18 and the motor 54, for example, between the orbiting scroll 66 and the fixed scroll 26 and within the ball bearings 62, 64. The oil intermixes with the refrigerant within the compression device 18 and the motor 54 and exits the compression device 18 via the orifice 84. As discussed in more detail below, the oil is separated from the compressed refrigerant within the front cover 28 and is returned to the compression device 18.

Figure 3:
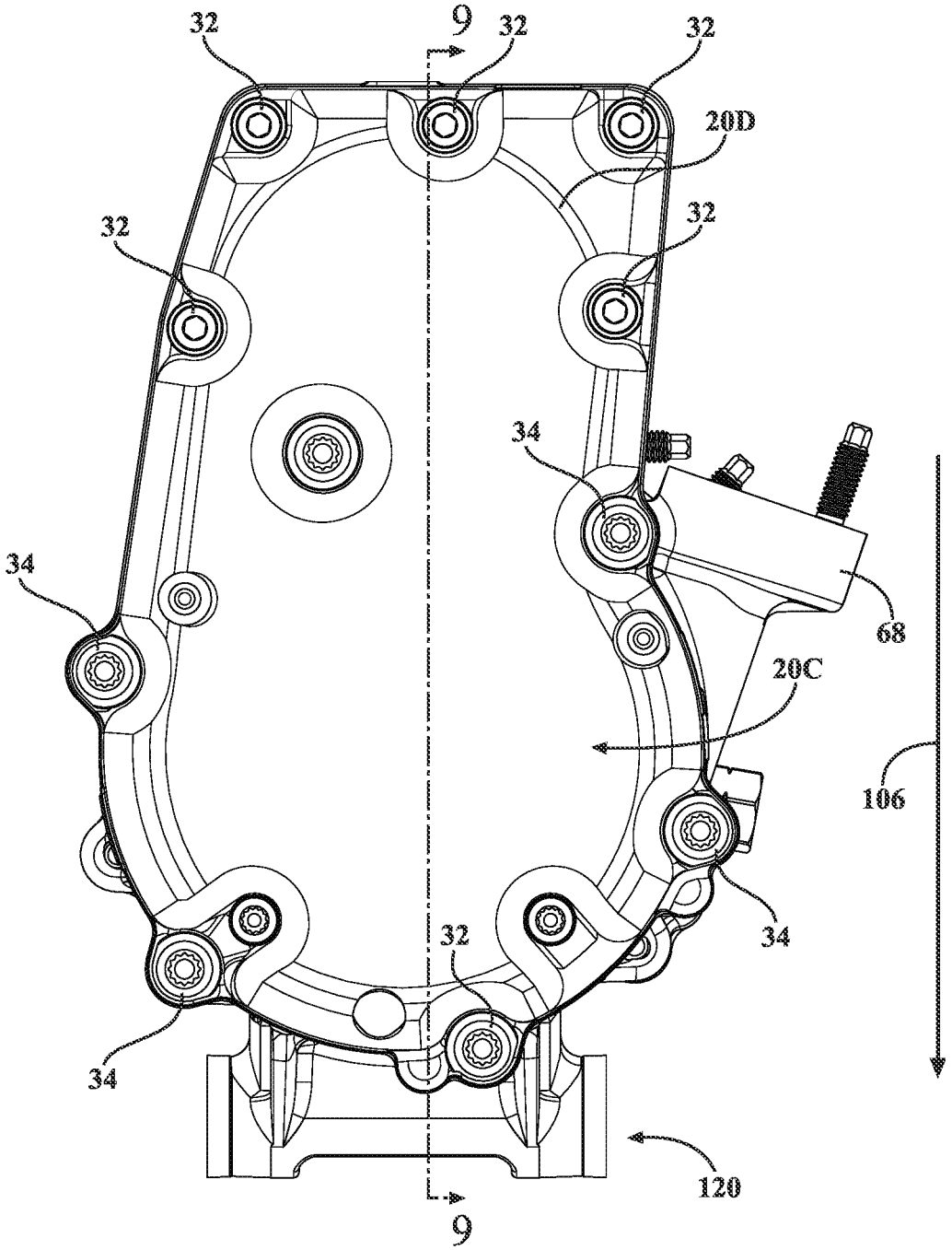
FIG. 3 is a first side view of the electric compressor of FIG. 1A.
Figure 4:
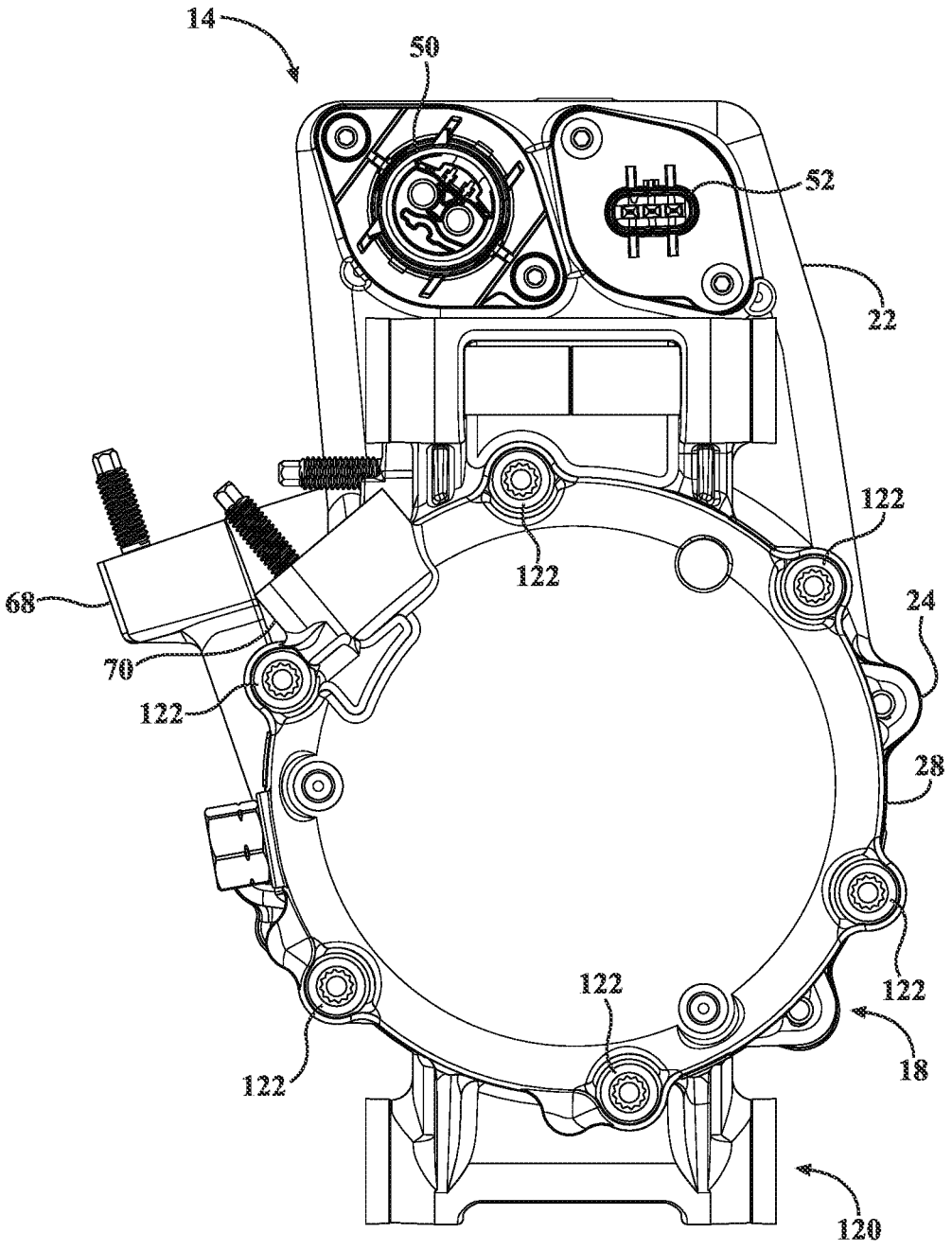
FIG. 4 is a second side view of the electric compressor of FIG. 1A.
Figure 5:
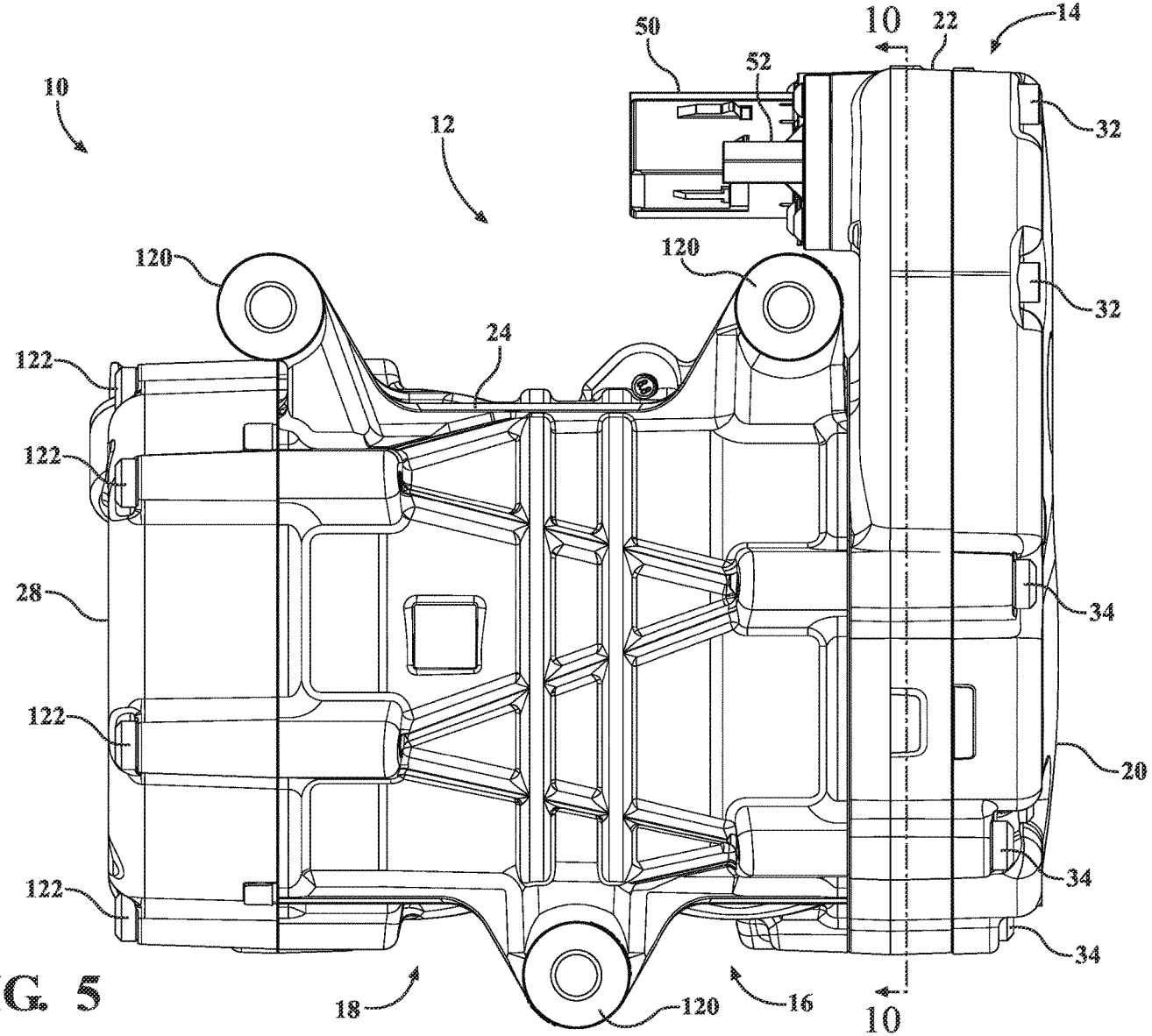
FIG. 5 is a front view of the electric compressor of FIG. 1A.

An oil separator 96 facilitates the separation of the intermixed oil and refrigerant. In the illustrated embodiment, the oil separator 96 is integrated within the front cover 28. The front cover 28 further defines an oil reservoir 98 which collects oil from the oil separator 96 before the oil is recirculated through the motor 54 and motor cavity 56 and the compression device 18. In use, the electric compressor 10 is generally orientated as shown in FIGS. 3-5, such that gravity acts as indicated by arrow 106 and oil collects within the oil reservoir 98.

With reference to FIG. 9, the general path oil travels from the bottom of the electric compressor 10 through the compression device 18, out the orifice 84 to the discharge volume 82 of the front cover 28 and back to the compression device 18 is shown by arrow 88.

In the illustrated embodiment, the front cover 28 is mounted to the center housing 24 by a plurality of bolts 122 inserted through respective apertures therein and threaded into apertures in the center housing 24. A fixed head gasket 110 and a rear heard gasket 112, are located between the center housing 24 and the fixed scroll 26 to provide sealing.

An oil separator 96 facilitates the separation of the intermixed oil and refrigerant. Generally, the oil separator 96 only removes some of the oil within the intermixed oil and refrigerant. The separator oil is stored in an oil reservoir and cycled back through the compression device 18, where the oil is mixed back in with the refrigerant.

In the illustrated embodiment, the oil separator 96 is integrated within the front cover 28. The front cover 28 further defines an oil reservoir 98 which collects oil from the oil separator 96 before the oil is recirculated through the motor 54 and motor cavity 56 and the compression device 18. In use, the electric compressor 10 is generally orientated as shown in FIGS. 3-5, such that gravity acts as indicated by arrow 106 and oil collects within the oil reservoir 98. With reference to FIG. 9, the general path oil travels from the bottom of the electric compressor 10 through the compression device 18, out the orifice 84 to the discharge volume 82 of the front cover 28 and back to the compression device 18 is shown by arrow 88. As shown, the oil is drawn back up into the compression device 18 where the oil is mixed back into or with the refrigerant.

As stated above, refrigerant, which is actually a mixture of refrigerant and oil enters the electric compressor 10 via the refrigerant inlet port 68. The intermix of oil and refrigerant is drawn into the motor section 16, thereby providing lubrication and cooling to the rotating components of the electric compressor 10, such as the rotor 60, the drive shaft 90. Oil and refrigerant enters the interior of the motor 54 to lubricate the second ball bearing 64 and the oil by the rotational forces within the motor section 16. may impact against the motor side 22A of the inverter housing 22. The refrigerant and oil is further directed by the motor side 22A into the ball bearing 62, further discussed below.

Swing-Link Mechanism and Concentric Protrusion of the Drive Shaft

With specific reference to FIGS. 13-18B, in a first aspect of the electric compressor 10 of the disclosure, an electric compressor 10 includes a swing-link mechanism 124 and the drive shaft 90 has a concentric protrusion 90F. In one embodiment, the concentric protrusion 90F is integrally formed with the drive shaft 90. As discussed below, the swing-link mechanism 124 is used to rotate the orbiting scroll 66 in an eccentric orbit about the drive shaft 90.

In the prior art, the drive shaft is coupled to a swing-link mechanism by a drive pin and a separate eccentric pin, both of which are pressing into the drive shaft. The drive pin is used to rotate the swing-link mechanism 124 which moves the orbiting scroll 66 along its eccentric orbit. The drive pin and the eccentric pin are inserted into respective apertures at the end of the drive shaft. The eccentric pin is used to limit articulation of the orbiting scroll 66 is the orbiting scroll 66 travels along the eccentric orbit. Neither the drive pin, nor the eccentric pin, are located along the central axis of the drive shaft. As the drive shaft is rotated, the drive pin and the eccentric pin are placed under considerable stress. Thus, both pins are composed from a hardened material, such as SAE 52100 bearing steel. In addition, the eccentric pin may require an aluminum bushing or other slide bearing to prevent damage to the eccentric pin, as the eccentric pin is used to limit the radial movement of the eccentric orbit of the orbiting scroll 66. Also, the prior art eccentric pin requires additional machining on the face of the drive shaft 90, including precise apertures for the drive pin, and eccentric pin.

As discussed in more detail below, the eccentric pin of the prior art is replaced with a concentric protrusion 90F.

In the illustrated embodiment, the scroll-type electric compressor 10 includes the housing 12, the refrigerant inlet port 68, the refrigerant outlet port 70, the drive shaft 90, the concentric protrusion 90F, the motor 54, the compression device 18, the swing-link mechanism 124, a drive pin 126 and a ball bearing 108. The housing 12 defines the intake volume 74 and the discharge volume 82. The refrigerant inlet port 68 is coupled to the housing 12 and is configured to introduce the refrigerant to the intake volume 74. The refrigerant outlet port 70 is coupled to the housing 12 and is configured to allow compressed refrigerant to exit the scroll-type electric compressor 10 from the discharge volume 82. The drive shaft 90 is located within the housing 12 and has first and second ends 90A, 90B. The drive shaft 90 defines, and is centered upon, a center axis 90C.

The concentric protrusion 90F is located at the second end 90B of the drive shaft 90 and is centered on the center axis 90C. The concentric protrusion 90F and extends away from the drive shaft 90 along the central axis 90C. The concentric protrusion 90F includes a drive pin aperture 90E. The motor 54 is located within the housing 12 and is coupled to the drive shaft 90 to controllably rotate the drive shaft 90 about the center axis 90C. The drive pin 126 is located within the drive pin aperture 90E and extends away from the drive shaft 90. The drive pin 126 is parallel to the concentric protrusion 90F.

The concentric pin 90F may further include an undercut 90G, and the outer surface may be surface hardened or after treated with a coating or bearing surface. The concentric pin 90F may be further machined simultaneously with the drive shaft 90.

As explained above, the compression device 18 includes the fixed scroll 26 and the orbiting scroll 66. The fixed scroll 26 is located within, and being fixed relative to, the housing 12. The orbiting scroll 66 is coupled to the drive shaft 90. The orbiting scroll 66 and the fixed scroll 26 form compression chambers 80 (see above) for receiving the refrigerant from the intake volume 74 and for compressing the refrigerant as the drive shaft 90 is rotated about the center axis 90C. The orbiting scroll 66 has an inner circumferential surface 66E.

The swing-link mechanism 124 is coupled to the drive shaft 90 and has first and second apertures 124A, 124B for receiving the concentric protrusion 90F and the drive pin 126. The swing-link mechanism 124 further includes an outer circumferential surface 124C.

The ball bearing 108 is positioned between, and adjacent to each of, the inner circumferential surface 66E of the orbiting scroll 66 and the outer circumferential surface 124C of the swing-link mechanism 124. The drive shaft 90, drive pin 126, orbiting scroll 66 and swing-link mechanism 124 are arranged to cause the orbiting scroll 66 to rotate about the central axis 90C in an eccentric orbit.

In one embodiment, the concentric protrusion 90F is integrally formed with the drive shaft 90. The drive shaft 90, concentric protrusion 90F, and swing-link mechanism 124 may be machined from steel. The concentric protrusion 90F being formed simultaneously and within the same machining operation with the drive shaft 90 further increases manufacturing efficiencies.

Figure 16C:
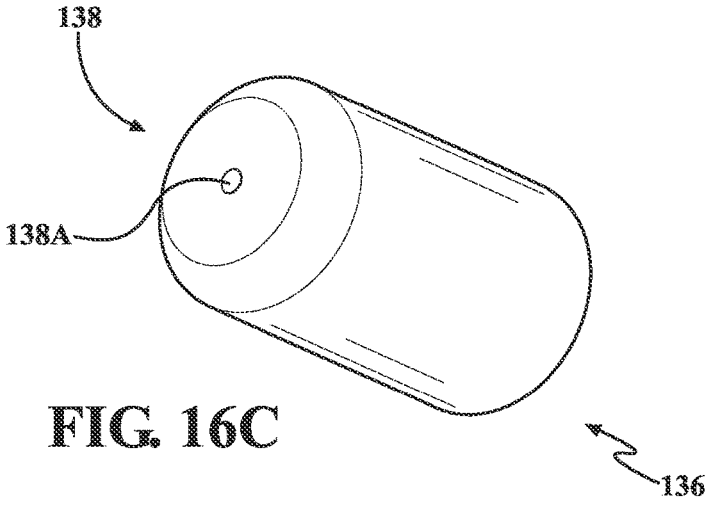
FIG. 16C is a perspective view of a plug of the compression device of FIG. 13.
Figure 16D:
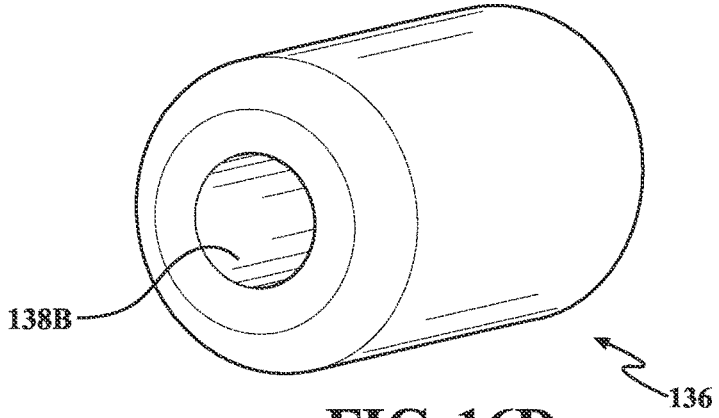
FIG. 16D is a second perspective view of the plug of FIG. 16C.
Figure 16E:
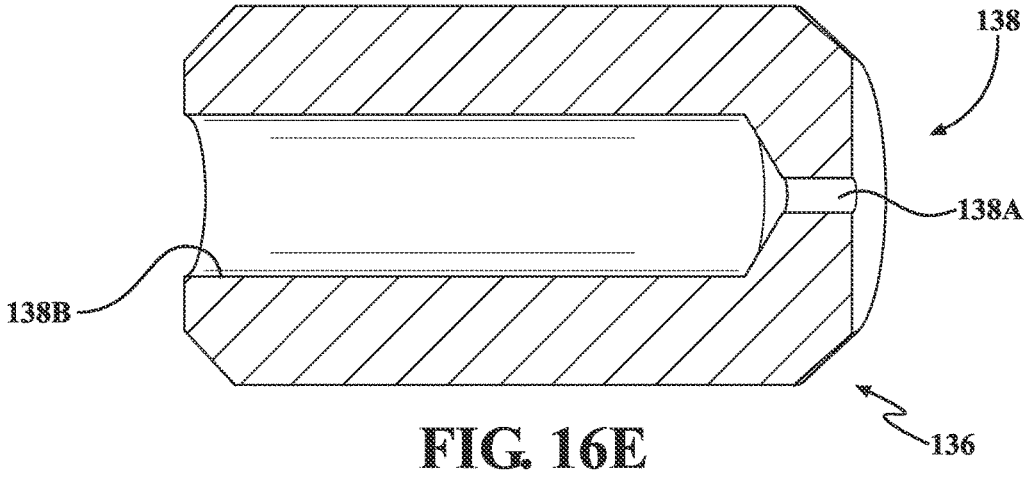
FIG. 16E is a cross-sectional view of the plug of FIG. 16C.
Figure 16F:
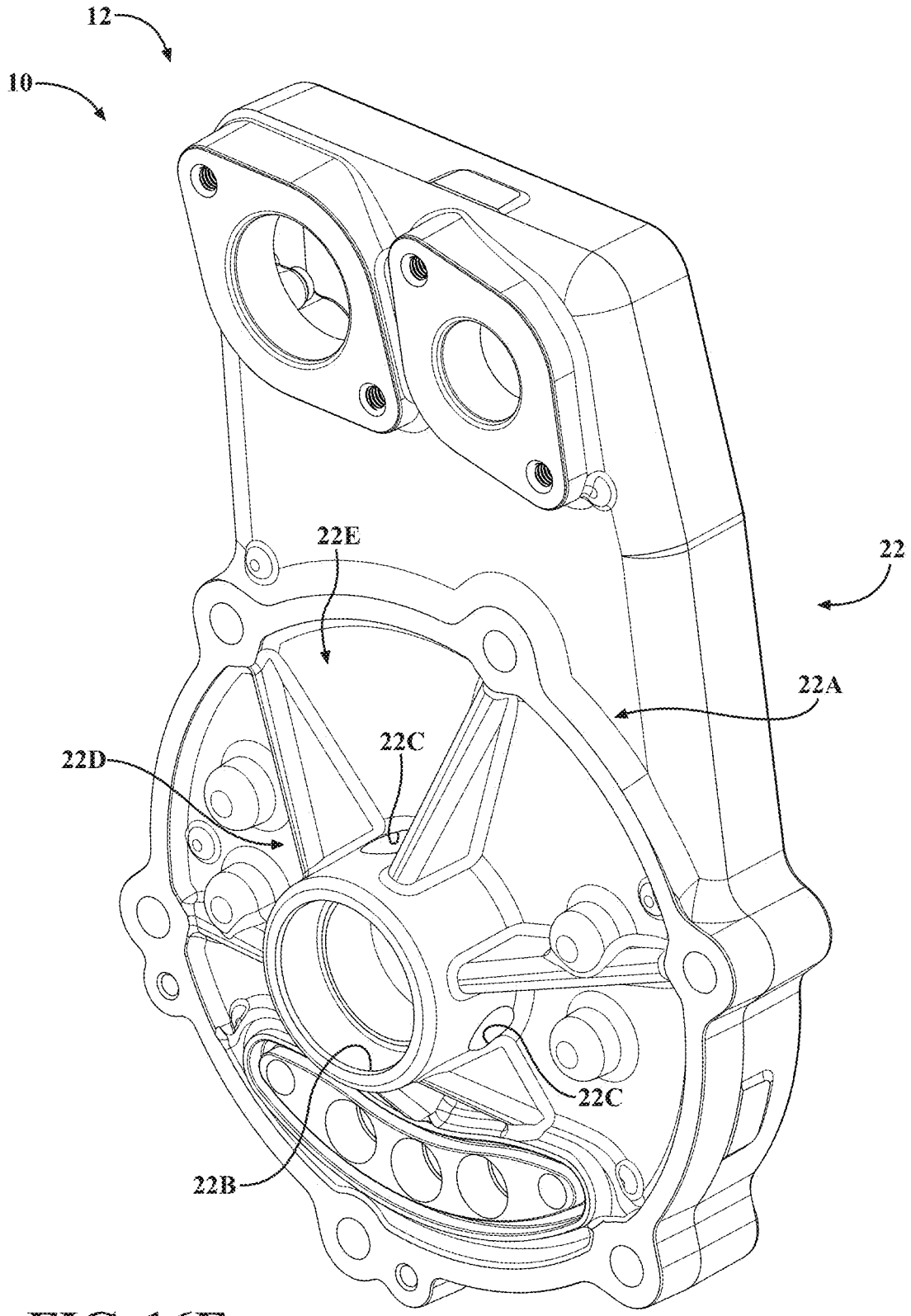
FIG. 16F is a perspective view of an inverter housing of the inverter of FIG. 11.
Figure 16G:
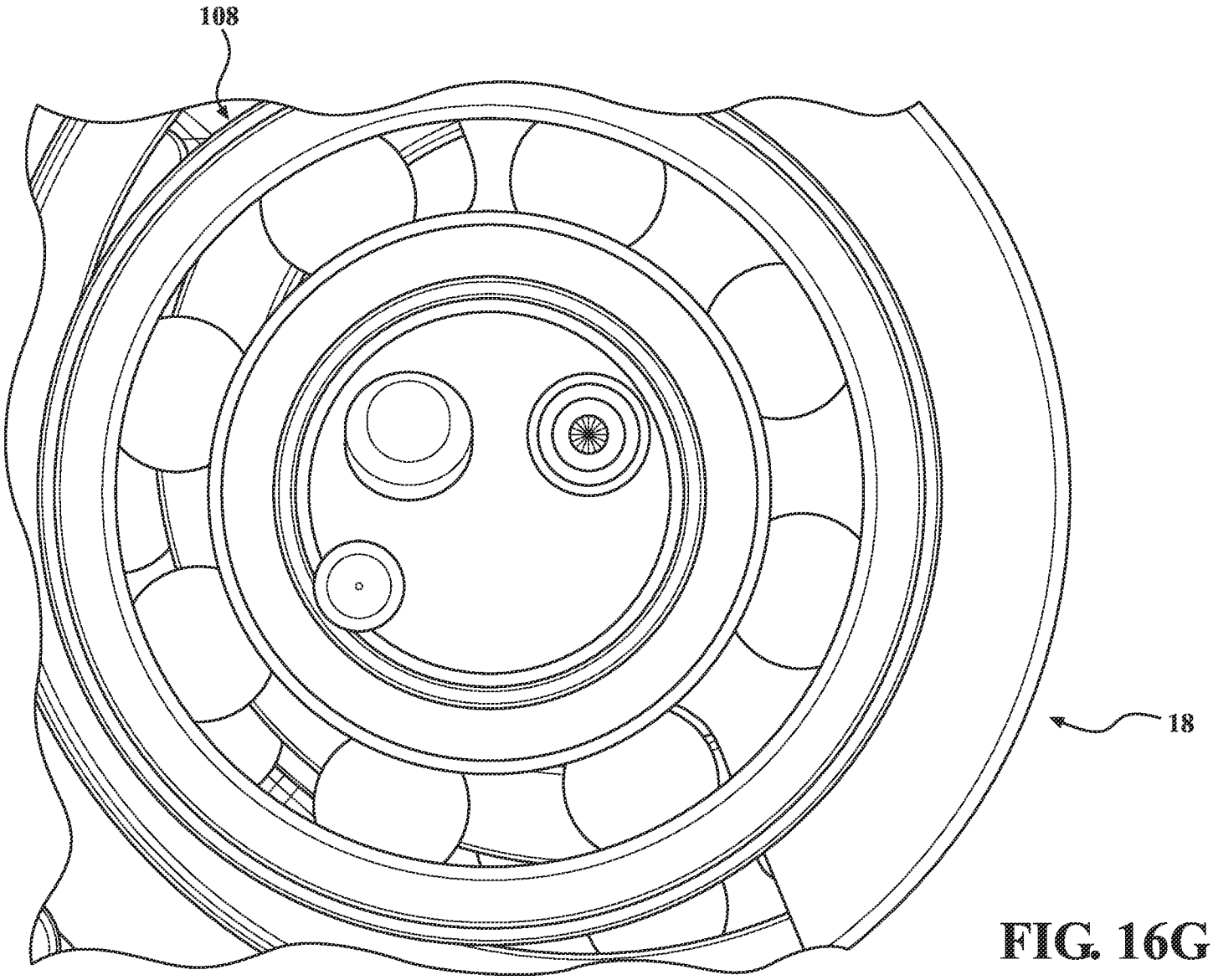
FIG. 16G is a partial expanded view of the compression device of FIG. 13.

The expanded view of a portion of the compression device 18 illustrated in FIG. 16G, further illustrates the concentric protrusion 90F. The concentric protrusion 90F interacts and guides the swing-link mechanism 124. The concentric protrusion 90F is sized and machined with a controlled tolerance with the first aperture 124A to create a controlled gap that limits the radial movement of the eccentric orbit of the orbiting scroll 66. Unlike the prior art, the concentric protrusion 90F does not require a second pin, or any additional machining operations. The concentric protrusion 90F further co-operates with the guidance pins 24B and the slots 661 on a lower surface 66F of the orbiting scroll 66, further discussed below.

The scroll-type electric compressor 10 includes an inverter section 14, a motor section 16, and the compression device 18. The motor section 16 includes a motor housing 24 that defines a motor cavity 56. The compression section 18 includes the fixed scroll 26. The housing 12 is formed, at least in part, the fixed scroll 26 and the center housing 24.

With specific reference to FIGS. 13, 16B, and 18A-18F in the illustrated embodiment, the orbiting scroll 66 has a lower surface 66F. The lower surface 66F has a plurality of ring-shaped slots 661. The center housing 24 includes a plurality of articulating guidance pin apertures 155. The guidance pins 24B are located within the guidance pin apertures 155 and extend towards the compression device 18 and into the ring-shaped slots 661. The guidance pins 24B are configured to limit articulation of the orbiting scroll 66 as the orbiting scroll 66 orbits about the central axis 90C. In one embodiment, each of the ring-shaped slots 661 includes a ring sleeve 118. A thrust plate 142 is located between the fixed scroll 26 and a thrust body 144 (see below) and provides a wear surface therebetween.

Discharge Head Design Having a Three-Reed Reed Mechanism and an Oil Separator

In the illustrated embodiment, the electric compressor 10 includes a multicavity pulsation muffler system 159 and an oil separator 96 which may be located in the discharge volume 82 and integrally formed with the discharge head or front cover 28. As discussed above, oil is used to provide lubrication between the moving components of the electric compressor 10. During operation, the oil and the refrigerant become mixed. The oil separator 96 is necessary to separate the intermixed oil and refrigerant before the refrigerant leaves the electric compressor 10.

Generally, refrigerant is released from the compression device 18 during each cycle, i.e., revolution (or orbit) of the orbiting scroll 66. In the illustrated embodiment, refrigerant leaves the compression device 18 through the central orifice 84A and two side orifices 84B in the fixed scroll 26. Release of the refrigerant through the orifices, 84A, 84B is controlled by the central reed 87A and two side reeds 87B, respectively. The multicavity pulsation muffler system 159 and the oil separator 96 are described in more detail below.

Scroll Bearing Oil Orifice

The electric compressor 10 may include a scroll bearing oil injection orifice 138 (see FIGS. 16C and 16E). As discussed above, the compression device 18 of the present disclosure includes a ball bearing 108. In the illustrated embodiments, the ball bearing 108 is located between the swing-link mechanism 124 and the orbiting scroll 66. However, as a result of the location of the ball bearing 108 within the compression device 18, there may be limited oil delivery to the ball bearing 108 resulting in reduced durability. As shown in FIG. 9, the oil orifice 138 allows oil (and refrigerant) to travel from the discharge chamber 82 to the ball bearing 108 along the path 73 (which may be referred to as the "nose bleed" path).

The scroll-type electric compressor 10 may include a housing 12, a refrigerant inlet port 68, a refrigerant outlet port 70, an inverter module 44, a motor 54, a drive shaft 90 and a compression device 18. The housing 12 defines an intake volume 74 and a discharge volume 82. The refrigerant inlet port 68 is coupled to the housing 12 and is configured to introduce the refrigerant to the intake volume 74. The refrigerant outlet port 70 is coupled to the housing 12 and is configured to allow compressed refrigerant to exit the scroll-type electric compressor 10 from the discharge volume 82. The inverter module 44 is mounted inside the housing 12 and adapted to convert direct current electrical power to alternating current electrical power. The motor 54 is mounted inside the housing 12. The drive shaft 90 is coupled to the motor 54. The compression device 18 receives the refrigerant from the intake volume 74 and compresses the refrigerant as the drive shaft 90 is rotated by the motor 54. The compression device 18 includes a fixed scroll 26, an orbiting scroll 66, a swing-link mechanism 124, a ball bearing 108 and a plug 136.

The fixed scroll 26 is located within, and is fixed relative to, the housing 12. The orbiting scroll 66 is coupled to the drive shaft 90. The orbiting scroll 66 and the fixed scroll 26 form compression chambers 80 for receiving the refrigerant from the intake volume 74 and compressing the refrigerant as the drive shaft 90 is rotated about the center axis 90C. The orbiting scroll 66 has a first side (or the lower surface) 66F and a second side (or upper surface) 66G. The orbiting scroll 66 has an oil aperture 140 through the orbiting scroll 66 from the first side 66F to the second side 66G.

The swing-link mechanism 124 is coupled to the drive shaft 90. The ball bearing 108 is positioned between and adjacent to each of the orbiting scroll 66 and the swing-link mechanism 124. The drive shaft 90, orbiting scroll 66 and swing-link mechanism 124 are arranged to cause the orbiting scroll 66 to orbit the central axis 90C in an eccentric orbit.

As shown in FIGS. 16B-16E, the tip of the orbiting scroll 66 includes a plug 136 and has an oil orifice 138. The plug 136 may be press fit within the oil aperture 140 of the orbiting scroll 66. The oil orifice 138 is configured to allow oil with a controlled flow rate or compressed refrigerant to pass through the orbiting scroll 66 to the ball bearing 108.

The size of the oil orifice 138 may be tuned to the specifications of the electric compressor 10. For example, given the specifications of the electric compressor 10, the diameter of the oil orifice 138 may be chosen such that only oil is allowed to pass through and to limit the equalization of pressure between the first and second sides of the orbiting scroll 66. By using a separate plug 136, rather than machining the oil orifice 138 directly in the orbiting scroll 66, manufacturing efficiencies may be achieved. And the plug 136 may have an oil orifice 138 that is specifically designed and tuned to allow for oil flow and refrigerant flow to increase or decrease depending on the diameter and geometry of the oil orifice 138.

As shown in FIGS. 16D-16E, in one embodiment, the oil orifice 138 may have a first bore 138A and a second bore 138B, wherein a diameter of the first bore 138A is less than a diameter of the second bore 138B. For example, in one application of this embodiment the first bore 138A has an approximate diameter of 0.3 mm. The second bore 138B has a diameter greater than the diameter of the first bore 138A and is only used to shorten the length of the first bore 138A. The flow of the oil and coolant is designed to provide thermal and lubricant to the ball bearing 108 supporting the radial forces created by the eccentric orbit of the orbiting scroll 66.

Further, as discussed above, the orbiting scroll 66 has an orbiting scroll base 66A and an orbiting scroll lap 66B. The orbiting scroll lap 66B may have an orbiting scroll tail end 66C and an orbiting scroll center end 66D. As shown, the oil aperture 140 is located within the orbiting scroll center end 66D. The plug 136 may be secured into the oil aperture 140, by press fit or any other method that will secure the plug 136.

As shown in FIG. 9, the oil orifice 138 allows oil (and refrigerant) to travel from the discharge chamber 82 to the ball bearing 108 along the path 73 (which may be referred to as the "nose bleed" path).

Bearing Oil Communication Hole

The electric compressor 10 may include one or more bearing oil communication holes. As discussed above, in the illustrated embodiment, a drive shaft 90 is rotated by the motor 54 to controllably actuate the compression device 18. The drive shaft 90 has a first end 90A and a second and 90B. The housing 10 of the electric compressor 10 forms a first drive shaft supporting member 22B and a second drive shaft support member 24A. In the illustrated embodiment, the first drive shaft supporting member 22B is formed in a motor side 22 of the inverter housing 22A and the second drive shaft supporting member 24A is formed within the center housing 24. First and second ball bearings 62, 64 are located within the first and second drive shaft support members 22B, 24A.

The location of the first drive shaft supporting members 22B is not a flow-through area for refrigerant (and oil). This may result in a low lubricating condition and affect the durability of the electric compressor 10.

As shown in FIG. 16F, the first drive supporting member 22B may include one or more holes 22C to allow oil to enter the first drive support member 22B and lubricate the first ball bearing 62.

In the illustrated embodiment, the scroll-type electric compressor 10 includes a housing 12, a first ball bearing 62, a second ball bearing 64, a refrigerant inlet port 68, a refrigerant outlet port 70, an inverter module 44, a motor 54, a drive shaft 90, and a compression device 18.

The housing 12 defines an intake volume 74 and a discharge volume 82 and includes first and second drive shaft supporting members 22B, 24A. The first ball bearing 62 is located within the first drive shaft supporting member 22B. The first drive shaft support member 22B of the housing 12 includes one or more oil communication holes 22C for allowing oil to enter the first ball bearing 62.

The second ball bearing 64 is located within the second drive shaft supporting member 24A. The refrigerant inlet port 68 is coupled to the housing 12 and is configured to introduce the refrigerant to the intake volume 74. The refrigerant outlet port 70 is coupled to the housing 12 and is configured to allow compressed refrigerant to exit the scroll-type electric compressor 10 from the discharge volume 82. The inverter module 44 is mounted inside the housing 12 and is adapted to convert direct current electrical power to alternating current electrical power. The motor 54 is mounted inside the housing 12. The drive shaft 90 is coupled to the motor 54. The drive shaft 90 has a first end 90A and a second end 90B. The first end 90A of the drive shaft 90 is positioned within the first bearing 62 and the second end 90B of the drive shaft 90 is positioned within the second bearing 64. The compression device 18 receives the refrigerant from the intake volume 74 and compresses the refrigerant as the drive shaft 90 is rotated by the motor 54. As discussed above, in the illustrated embodiment, the first drive shaft support member 22 may be formed on the motor side 22A of the inverter housing 22.

The rotational movement within the motor section 16 of the compression device 18 creates a flow path and movement to the oil from the oil reservoir 98, as shown by arrows 88 in FIG. 9. As shown the oil flows from the oil reservoir 98 toward the motor section 16 and continues toward the stator 58 and rotor 60. The rotational motion of the orbiting scroll, rotor and drive shaft pulls the oil upward to mix with the inlet flow of the refrigerant path 72. The rotational movement of the rotor 60 and drive shaft 90 will further propel the oil against the motor side 22A of the inverter housing 22. The motor side 22A surface further includes a series of ribs 22D, shown in FIG. 16F. The ribs 22D provide the needed rigidity for supporting the first drive shaft support member 22 and allow for a ridged backing and pocket to secure the first bearing 62. The inverter housing 22 nay further defines an oil cavity 22E where the oil collected between the ribs 22D is directed by gravity downward and into the oil cavity 22E. The ribs 22D and the sloped surface of the motor side 22A cooperate to capture and direct the oil splashed or propelled against the motor side 22A by the rotor 60 or drive shaft 90, to assist in increasing the oil flow into the oil cavity 22E and first bearing 62. FIG. 16F illustrates two communication holes 22C, but it is appreciated additional or less than 2 oil communication hole 22C may be included above and between the ribs 22D on the motor side 22A of the inverter housing 22. For example, in the illustrated embodiment the hole is 3.5 mm in diameter and the motor side 22A includes a sloping wall between the ribs 22D. In addition, the motor side 22A may include an outer oil collection area.

Domed Inverter Cover

The scroll-type electric compressor 10 of the present invention may include a domed inverter cover 20. The scroll-type electric compressor 10 includes the housing 12, the refrigerant inlet port 68, the refrigerant outlet port 70, the inverter module 44, the motor 54, the drive shaft 90, the compression device 18 and the inverter cover 20. The housing 12 defines the intake volume 74 and the discharge volume 82. The housing 12 has a generally cylindrical shape and the central axis 90C. The refrigerant inlet port 68 is coupled to the housing 12 and is configured to introduce the refrigerant to the intake volume 70. The refrigerant outlet port 70 is coupled to the housing 12 and is configured to allow compressed refrigerant to exit the scroll-type electric compressor 10 from the discharge volume 82.

The inverter module 44 is mounted inside the housing 12 and adapted to convert direct current electrical power to alternating current electrical power. The motor 54 is mounted inside the housing 12. The drive shaft 90 is coupled to the motor 54. The compression device 18 is coupled to the drive shaft 90 and is configured to receive the refrigerant from the intake volume and to compress the refrigerant as the drive shaft 90 is rotated by the motor 54.

As discussed above, the compression device 18 may rotate at a high speed (>2,000 RPM) which may create undesirable noise, vibration, and harshness (NVH) and low durability conditions. In the prior art, the inverter cover 20 is generally flat and tends to amplify and/or focus, the vibrations from the compression device 18.

To disperse vibrations rather than focus, the vibrations from the compression device 18, the inverter back cover 20 of the electric scroll-like compressor 10 of the fifth aspect of the disclosure is provided with a generally curved or domed profile.

Figure 6:
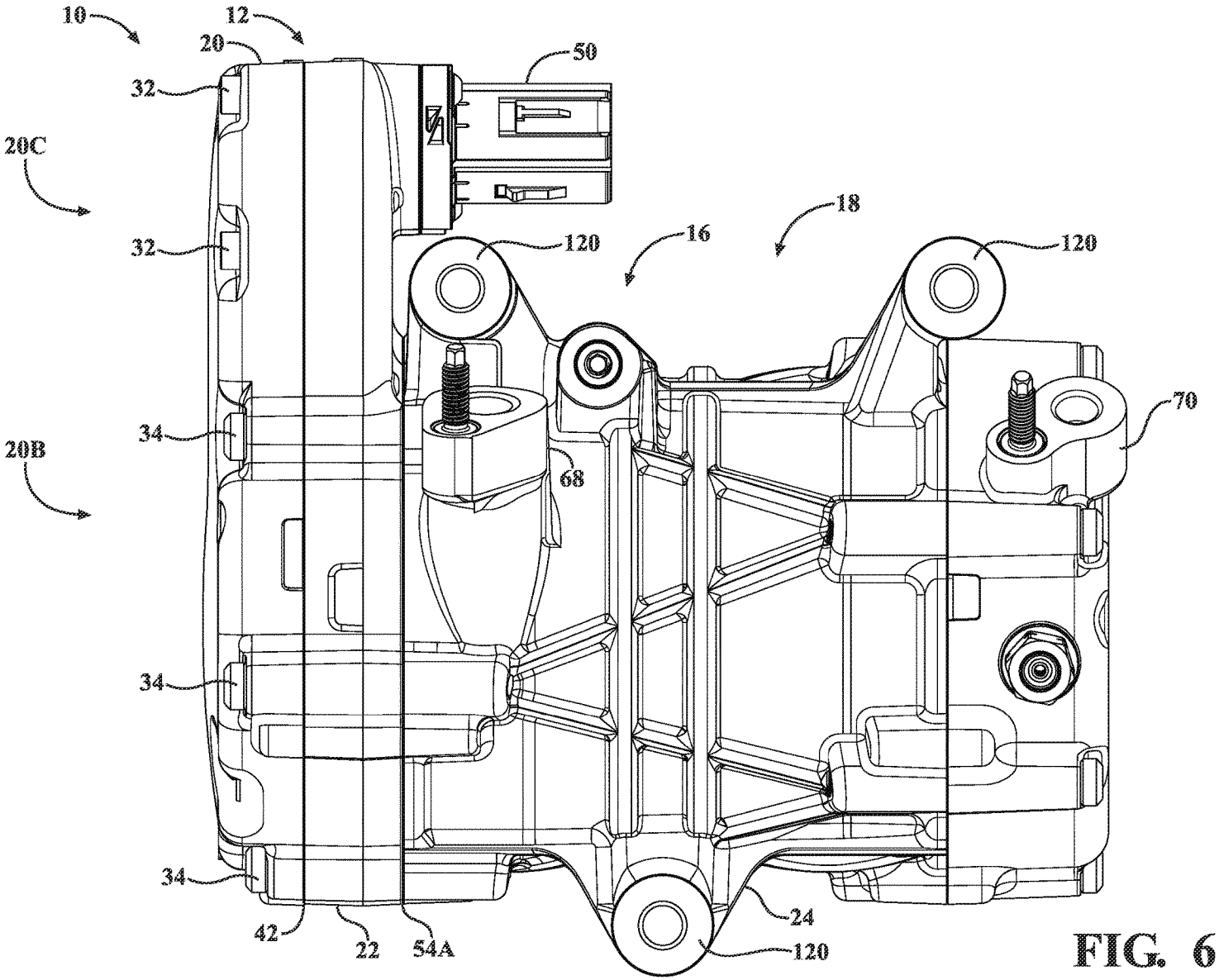
FIG. 6 is a rear view of the electric compressor of FIG. 1A.
Figure 7:
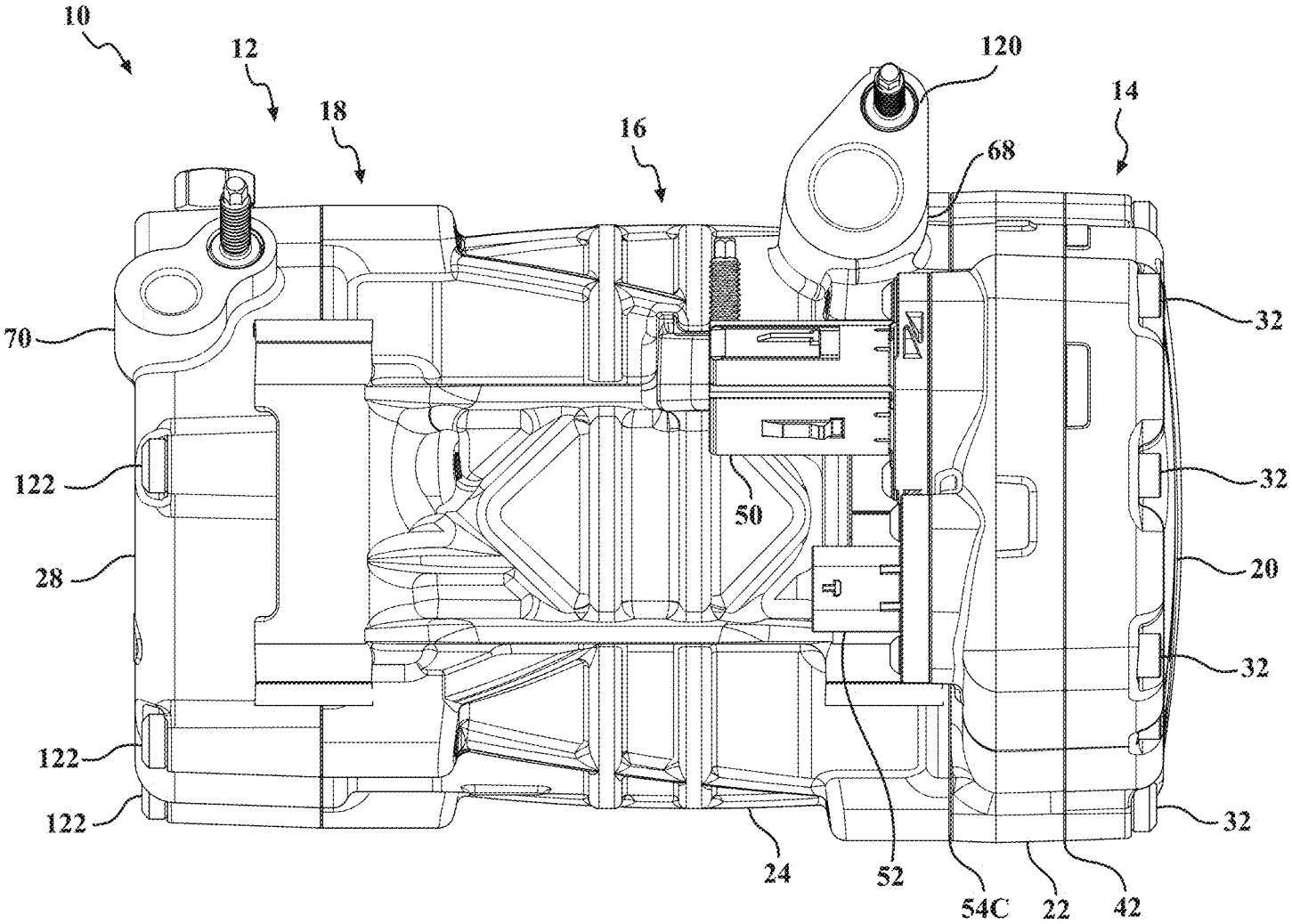
FIG. 7 is a top view of the electric compressor of FIG. 1A.
Figure 8:
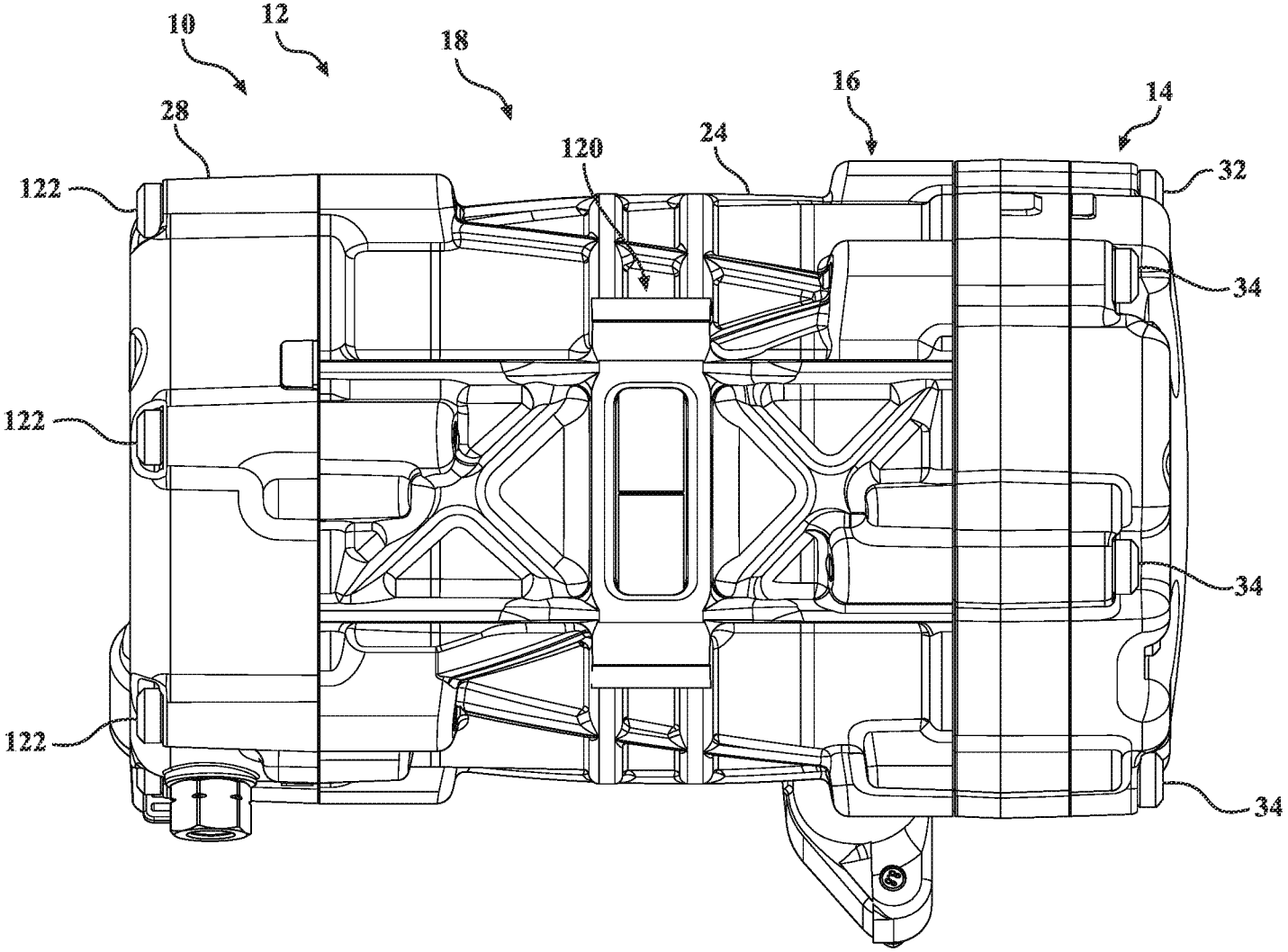
FIG. 8 is a bottom view of the electric compressor of FIG. 1A.

As shown in the FIGS., specifically FIGS. 1, 3 and 6, the inverter cover 20 is located at one end of the scroll-type electric compressor 10 and includes a first portion 20A and a second portion 20B. The first portion 20A includes an apex or apex portion 20C and is generally perpendicular to the central axis 90C and has an apex 20C and an outer perimeter 20D. The first portion 20A has a relatively domed-shaped such that the inverter cover 20 has a curved profile from the apex 20C towards the outer perimeter 20D. The amount and location of the curvature may be dictated or limited by other considerations, such as packaging constraints, i.e., the space in which the electric scroll-type compressor 10 must fit, and constraints placed by internal components, i.e., location and size). The first portion 20A may also have to incorporate other features, e.g., apertures to receive fastening bolts. The second portion 20B may include a portion of the inverter cover 20 that is not domed, i.e., is relatively flat that is located about the perimeter of the inverter cover.

Fixed Scroll Having Modified Scroll Flooring

In a first aspect of the present invention, the scroll-type electric compressor 10 with a modified fixed scroll flooring is configured to compress a refrigerant. The scroll-type electric compressor 10 includes the housing 12, the refrigerant inlet port 68, the refrigerant outlet port 70, the inverter module 44, the motor 54, the drive shaft 90, and the compression device 18. The housing 12 defines an intake volume 74 and a discharge volume 82.

The refrigerant inlet port 68 is coupled to the housing 12 and is configured to introduce the refrigerant to the intake volume 74. The refrigerant outlet port 70 is coupled to the housing 12 and is configured to allow compressed refrigerant to exit the scroll-type electric compressor 12 from the discharge volume 82. The inverter module 44 is mounted inside the housing 12 and adapted to convert direct current electrical power to alternating current electrical power. The motor 54 is mounted inside the housing 12 and the drive shaft 90 is coupled to the motor 54.

In general, and as described above, the compression device 18 receives the refrigerant from the intake volume 74 and compresses the refrigerant as the drive shaft 90 is rotated by the motor 54.

The compression device 18 includes a fixed scroll 26 and an orbiting scroll 66. The compression device 18 defines antechamber volume 134. The antechamber volume 134 (see FIGS. 18C and 18G) feeds refrigerant to the chambers 80 at the start of a compression cycle. During the compression cycle, when the chambers 80 close (as the laps 26B, 66B come into contact, the pressure within the antechamber volume 134 drops due to suction which can affect the efficiency of the electric compressor 10. In one aspect of the present invention, it is desirable to increase the volume of the antechamber (to make additional refrigerant available to the compression device 18). This increases the "capacitance" of the compression device 18 and smooths out the compression cycle.

In the illustrated embodiment, the base 26A, 66A of one of the fixed scroll 26 and the orbiting scroll 66 has a cutout 136 to increase the antechamber volume 134.

In the illustrated embodiment, the cutout 136 is located in the floor or base 26A of the fixed scroll 26.

Figure 18G:
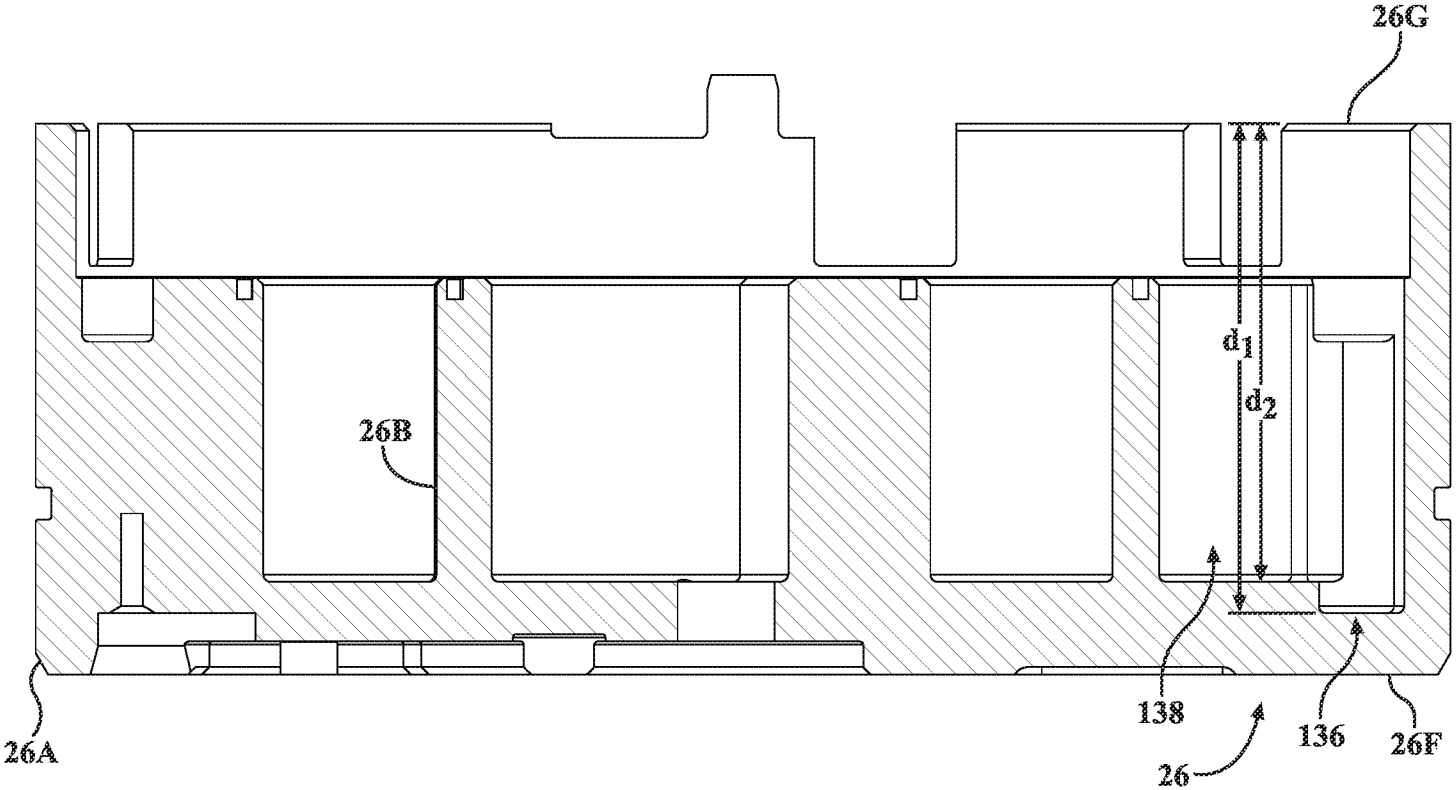
FIG. 18G is a cross-sectional view of the fixed scroll of the compression device of FIG. 13.
Figure 19A:
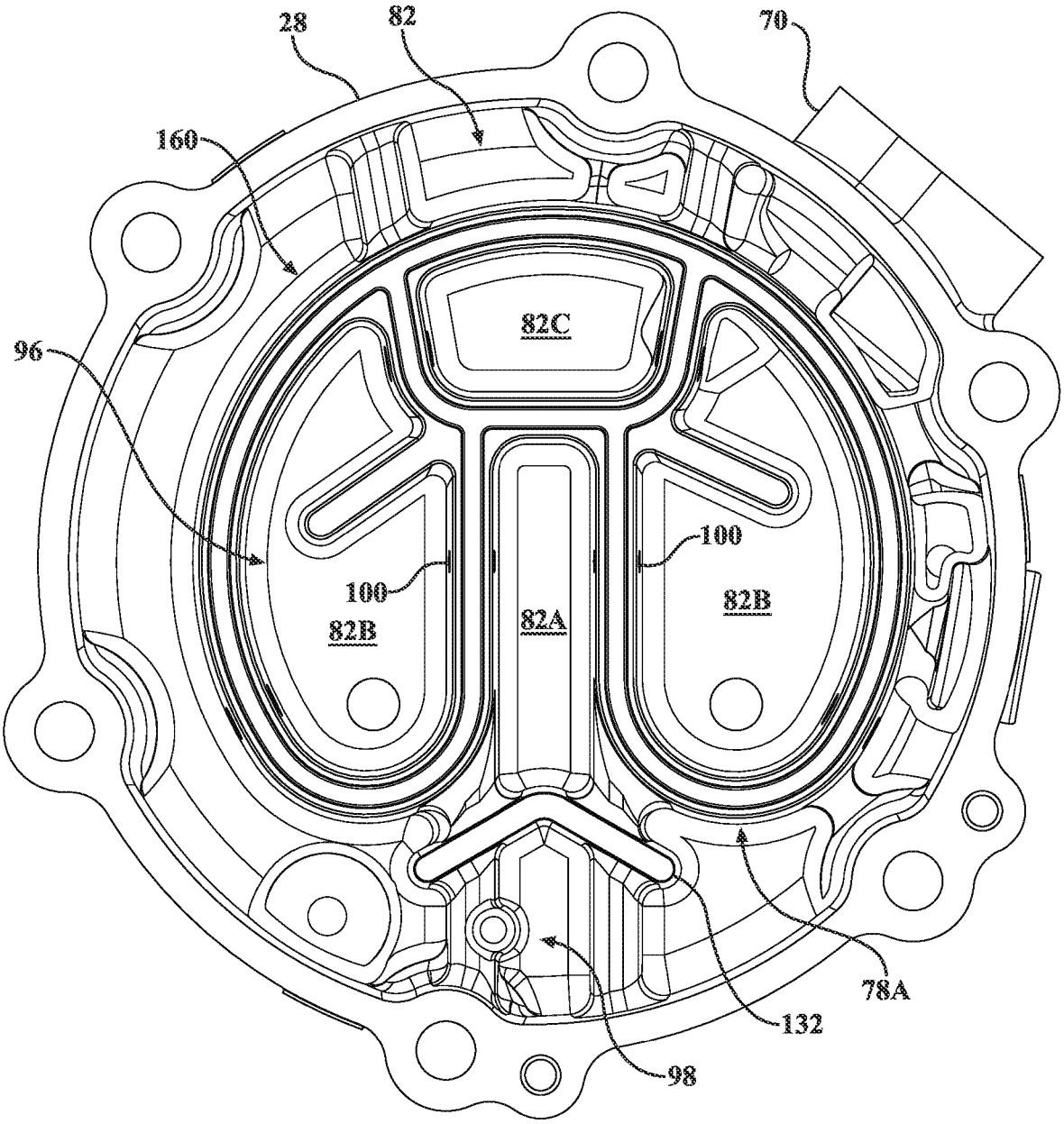
FIG. 19A is a first perspective view of a front cover of an electric compressor forming an oil separator, according to an embodiment of the present invention.
Figure 19B:
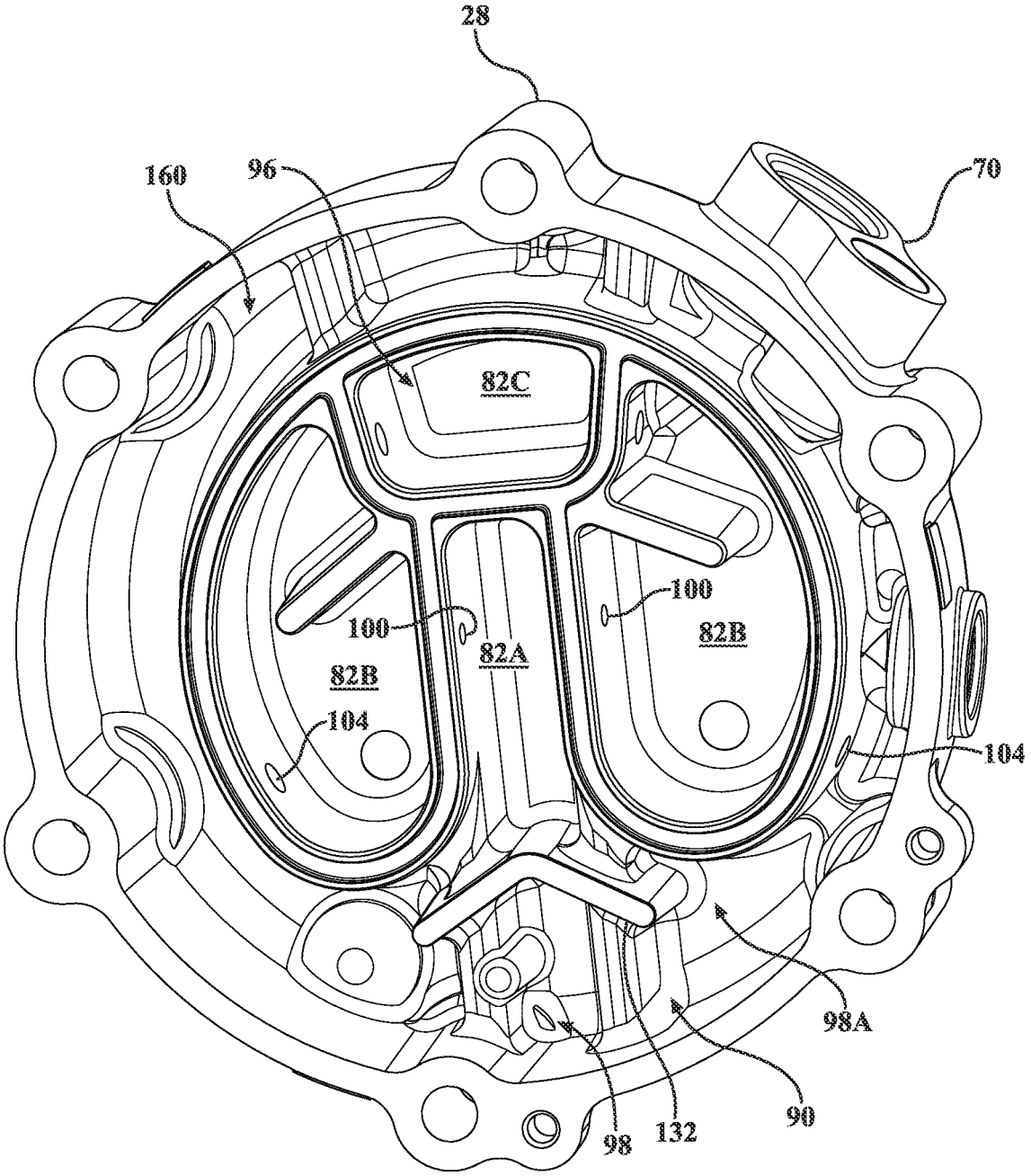
FIG. 19B is a second perspective view of the front cover of FIG. 19A.
Figure 19C:
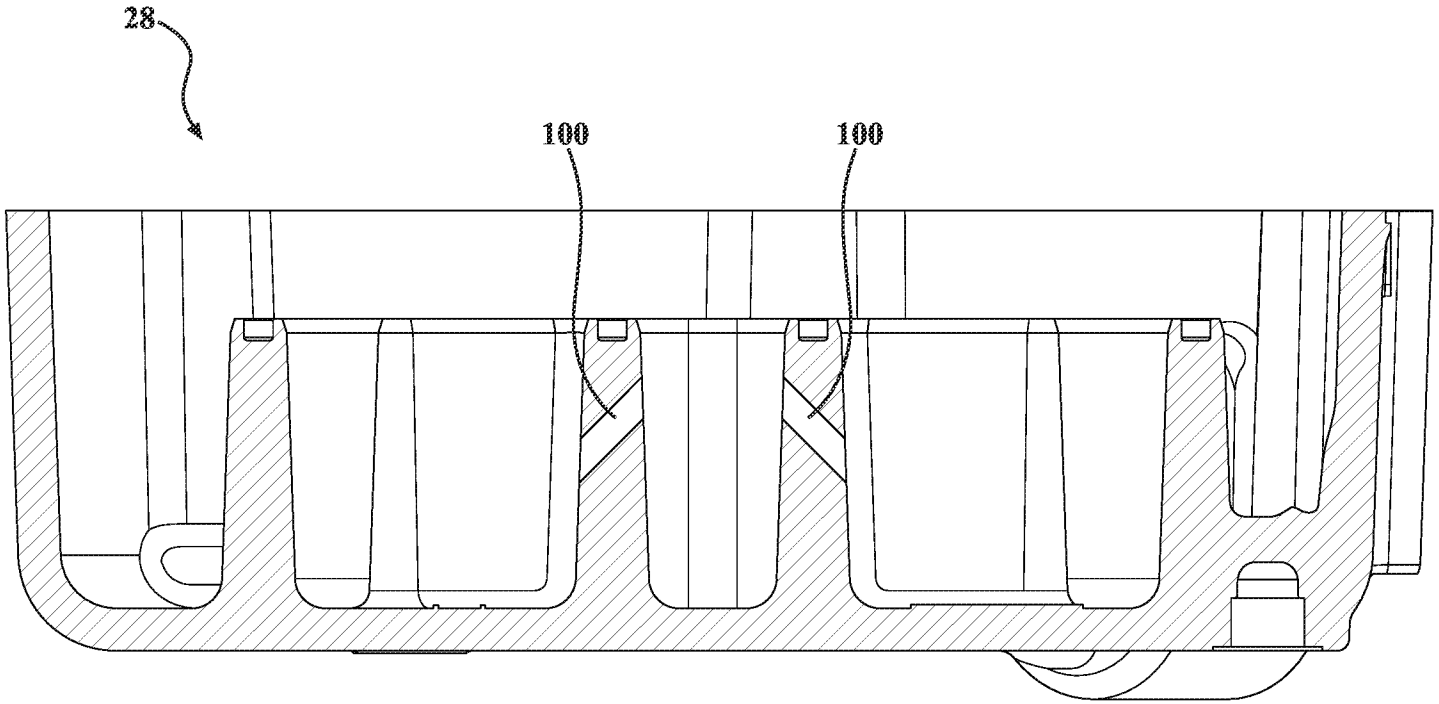
FIG. 19C is a cross-sectional view of the front cover of FIG. 19A.

As shown, the fixed scroll 26 has a first side 26F defined by fixed scroll base 26A and a second side 26G defined by a top surface of the fixed scroll lap 26B. The fixed scroll lap 26B extends from the fixed scroll base 26A towards the second side 26G of the fixed scroll 26. As shown in FIGS. 18C and 18G, the cutout 136 in the floor of the fixed scroll base 26A defines a first portion which has a depth, $d_1$, which is greater than a depth, $d_2$, of a second portion 138.

The size of the first portion or cutout 136 may be limited by a couple constraints. First, the depth, $d_1$, must leave sufficient material to maintain the structural integrity of the fixed scroll 26. In addition, to ensure that the chamber 80 is sealed, the geometry of the cutout must remain outside the orbiting lap 66B, to allow the chamber 80 to close and seal as shown in 17D. The cutout 136 may provide additional volume within the antechamber 134 to allow the volumes within chambers 80 in 17D to be fully filled. The cutout 136 is limited by the path of the orbiting scroll 66, and limitations to the floor and wall thickness needed to the fixed scroll 26. In addition, machine tooling and access to the floor of the fixed scroll may provide additional limitations to the size and areas outside the seal area of the orbiting scroll 66.

Isolation/Constraint System

In a second aspect of the present invention, an isolation and constraint system 145 may be used to isolate the housing 12 from the oscillations and pulsations caused by the orbiting scroll 66.

In a typical, scroll-type electric compressor, the motor and the fixed scroll are directly coupled to the housing. is directly coupled to the housing. As discussed above, guidance pins directly coupled to the housing may cooperate with ring shaped slots on the orbiting scroll to limit articulation of the orbiting scroll as it orbits the drive shaft. With this type of arrangement, oscillations and pumping pulsations from the orbiting scroll may be transmitted to the housing and through the mounts to the, e.g., vehicle structure.

The scroll-type electric compressor 10 is configured to compress a refrigerant. The scroll-type electric compressor includes the housing 12, the refrigerant inlet port 68, the refrigerant outlet port 70, the inverter module 44, the motor 54, the drive shaft 90 and a compression device 18. The housing 12 defines an intake volume 74 and a discharge volume 82 and has a generally cylindrical shape. The refrigerant inlet port 68 is coupled to the housing 12 and is configured to introduce the refrigerant to the intake volume 74. The refrigerant outlet port 70 is coupled to the housing 12 and is configured to allow compressed refrigerant to exit the scroll-type electric compressor 12 from the discharge volume 82. The inverter module 44 is mounted inside the housing 12 and adapted to convert direct current electrical power to alternating current electrical power. The motor 54 is mounted inside the housing 12. The drive shaft 90 is coupled to the motor 54. The compression device 18 is coupled to the drive shaft 90 for receiving the refrigerant from the intake volume 74 and compressing the refrigerant as the drive shaft 90 is rotated by the motor 54.

As discussed above, the compression device 16 includes a fixed scroll 26 and an orbiting scroll 66. The fixed scroll 26 is located within, and is fixed relative to, the housing 12. The orbiting scroll 66 is coupled to the drive shaft 90. The orbiting scroll 66 and the fixed scroll 26 form compression chambers 80 for receiving the refrigerant from the intake volume 74 and for compressing the refrigerant as the drive shaft 90 is rotated about the center axis 90C.

The orbiting scroll 66 has a lower surface having a plurality of ring-shaped slots 661 (see above).

Figure 20A:
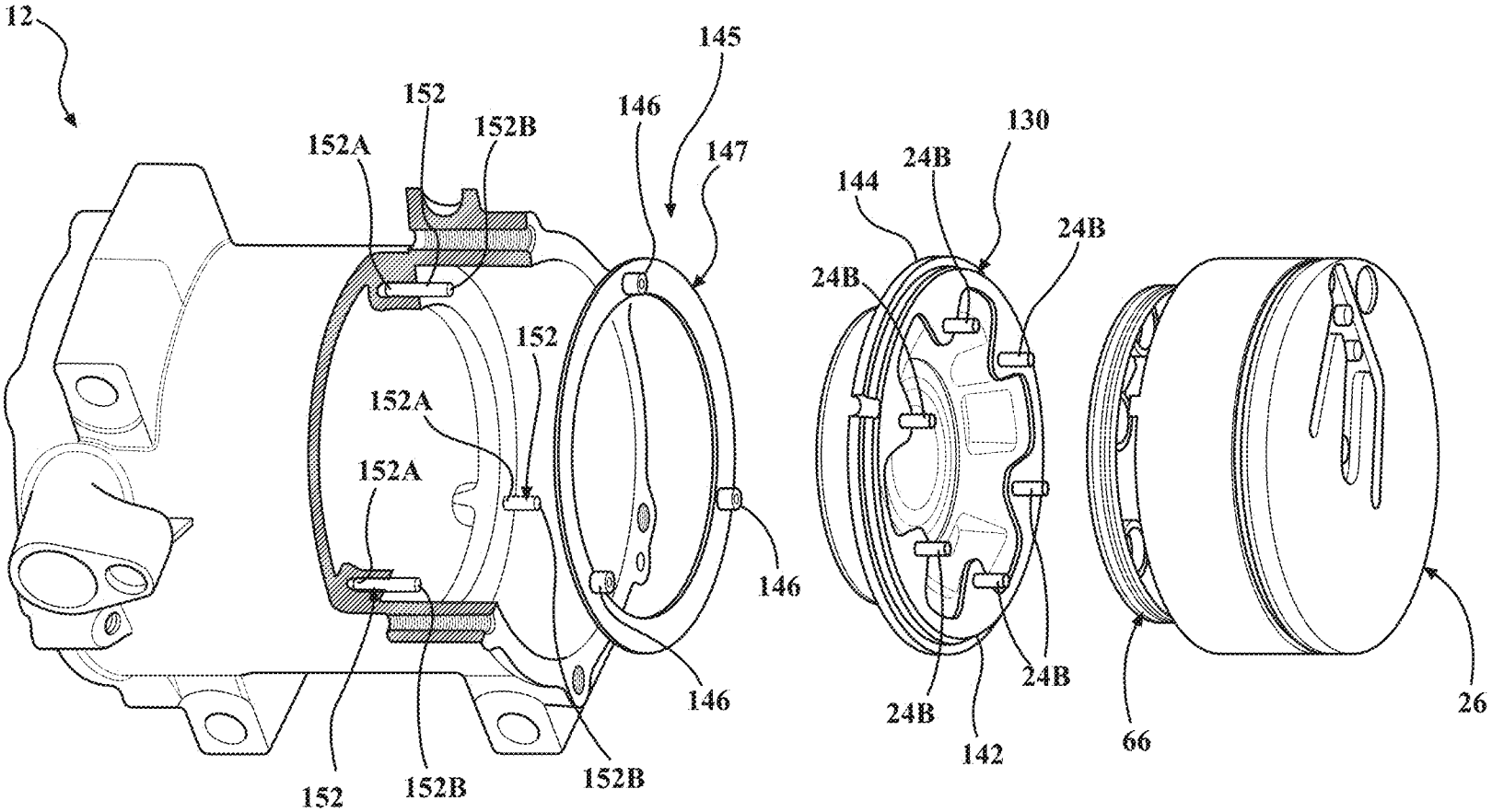
FIG. 20A is a partial view of an electric compressor with a cutaway view of the housing and an isolation and constraint system, according to an embodiment of the present invention.

With specific reference to FIG. 20A, the scroll-type electric compressor 10 further includes a thrust body 144, the plurality of articulating guidance pins 24B, a plurality of mounting pins 148 and a plurality of isolating sleeves 146. The thrust body 144 has a plurality of guidance pin apertures 155. The plurality of mounting pins 148 extend from the guidance pin apertures 155. The guidance pins 24B are configured to limit articulation of the orbiting scroll 66 as the orbiting scroll 66 orbits about the central axis 90.

Each mounting pin 148 has a housing end 148A and a thrust body end 148B. The housing end 148A is press fit within respective receiving apertures in the housing 12. The thrust body end 148B is cylindrical with an outer surface. The plurality of isolating sleeves 146 are composed from a flexible material, such as a chemically resistant synthetic rubber. One such material is ethylene propylene diene monomer (EPDM). The thrust body end 148B of each mounting pin 148 is encapsulated within a respective sleeve 146 and is received in a respective slot 153 within the thrust body 144. In this way, the only connection between the thrust body 144 and the housing 12 is through the mounting pins 148 which is isolated or insulated by the sleeves 146 to prevent or minimize vibrations from the orbiting scroll 66 from being transmitted to the housing 12.

As shown in FIG. 20A, in one embodiment, the isolating sleeves 146 are integrally formed with a circular gasket or ring 147.

Figure 20B:
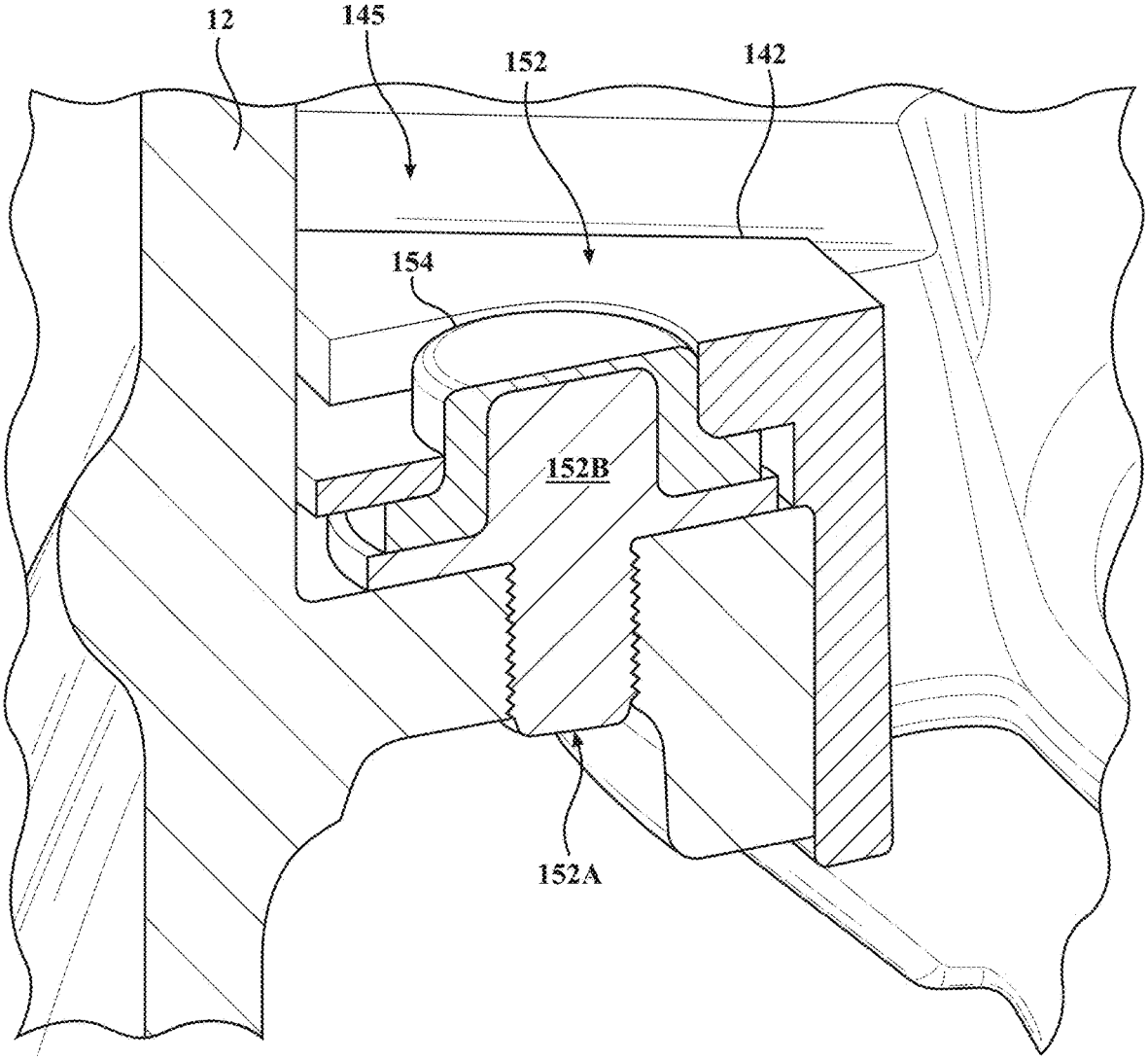
FIG. 20B is a partial view of an isolation and constraint system for use with an electric compressor, according to another embodiment of the present invention.
Figure 20C:
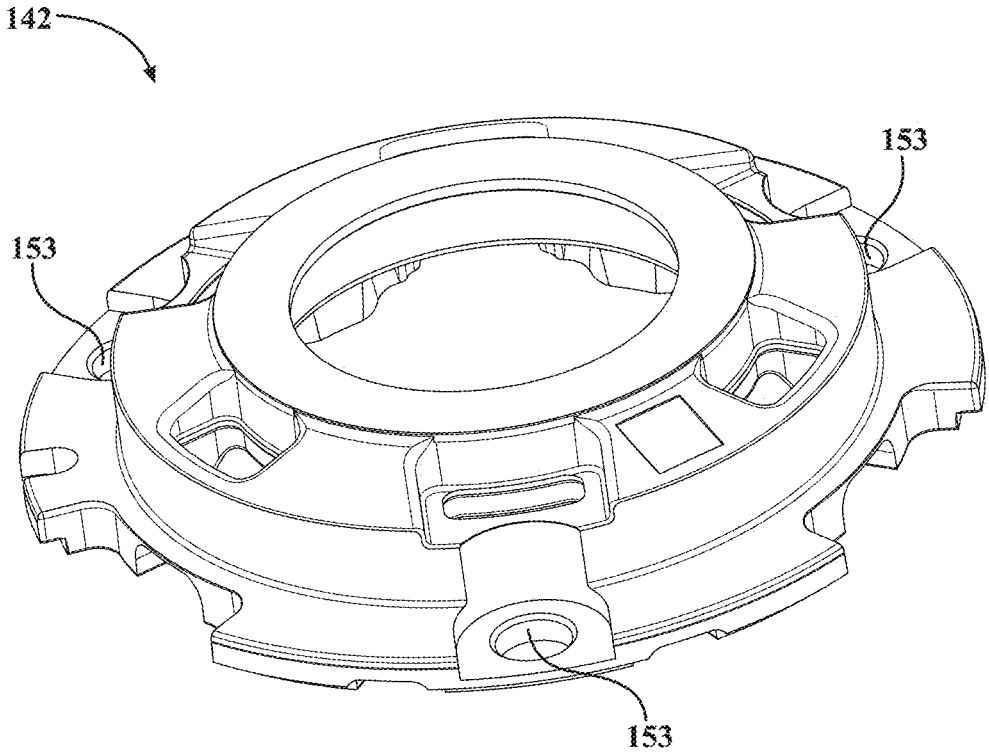
FIG. 20C is a first perspective view of a thrust body, according to an embodiment of the present invention.
Figure 20D:
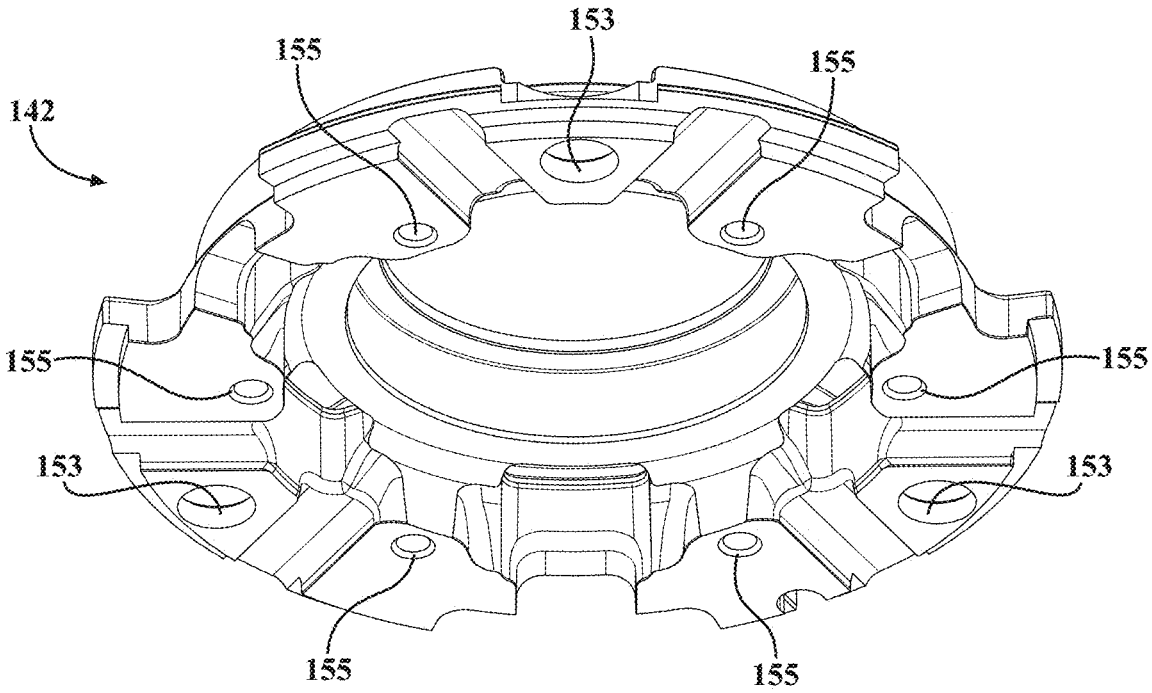
FIG. 20D is a second perspective view of the thrust body of FIG. 20C.
Figure 21:
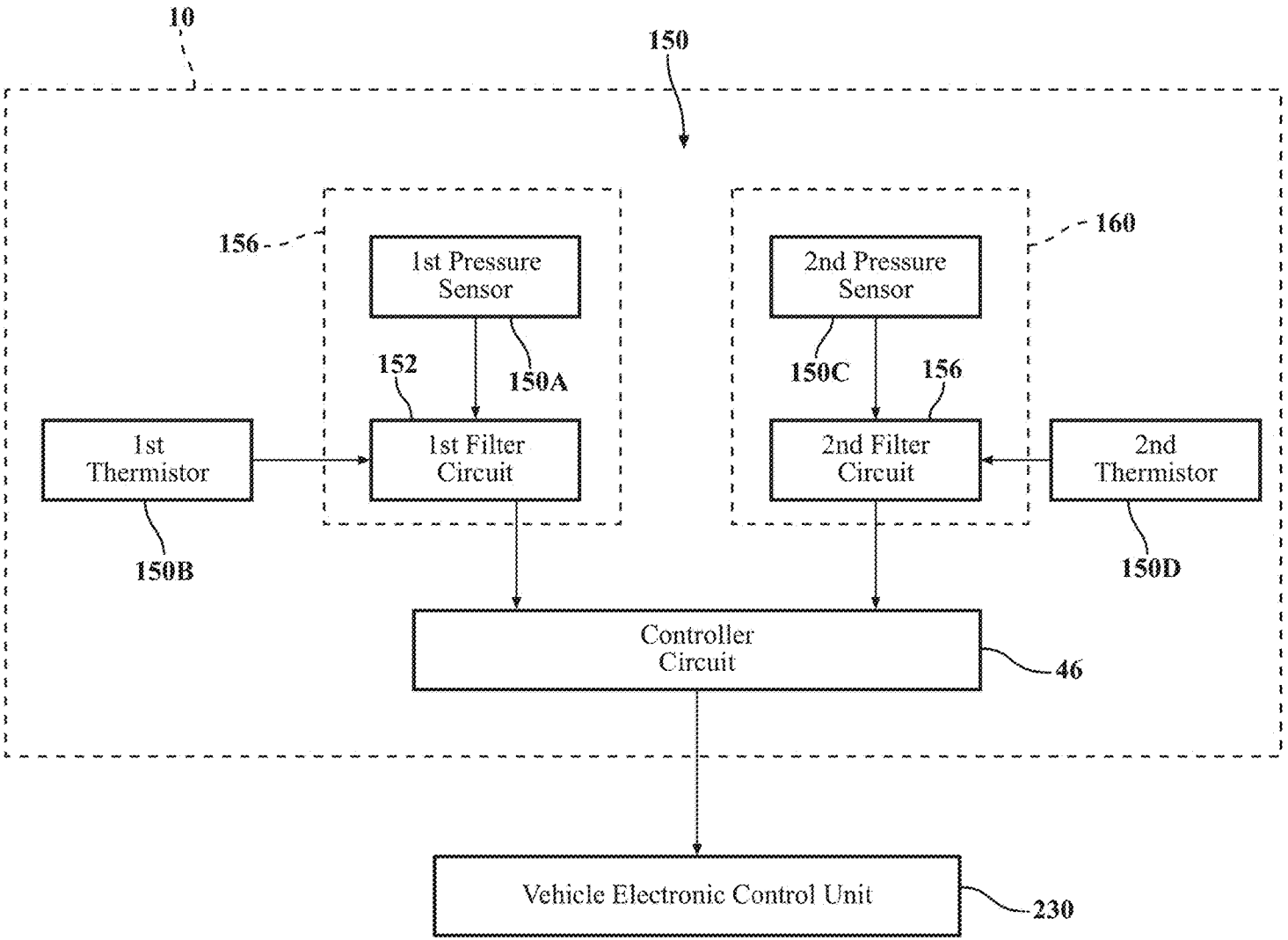
FIG. 21 is a functional block diagram of an electric compressor with an integrated pressure and temperature sensor according to an embodiment of the present invention.

As shown in FIG. 20B, in another embodiment, the thrust body end 148B of each mounting pin 148 is fully encapsulated by the flexible material using, for example, an overmolding process. The outer surface of the of the isolating sleeves 146 may be ribbed to assist with the isolation.

Electric Compressor Head Design

In a third aspect of the electric compressor 10 of the disclosure, a front cover 28 design includes an oil separator 96 and a three-reed reed mechanism 86. As discussed below, the design of the front cover 28, the fixed scroll 26 and the reed mechanism 86 define a multicavity pulsation muffler system 159.

In prior art electric compressors, refrigerant is released from the compression device once per revolution (or orbit) of the orbiting scroll. This creates a first order pulsation within the compressed refrigerant released by the electric compressor. The relative strong amplitude and low frequency of the pulsation creating in the refrigerant may excite other components (internal or external to the electric compressor) which may create undesirable noise, vibration and harshness (NVH) and low durability conditions.

With reference to FIGS. 18C-18F and FIGS. 19A-19B, the multicavity pulsation muffler system 159 compressed refrigerant is released from the compression device 18 twice during a compression cycle. As discussed in more detail below, the compression device 18 includes two smaller secondary discharge ports are placed into (adjacent) two secondary discharge chambers, The secondary discharge chambers are downstream (in the discharge head) of the pressure drop from a central discharge port. As also described further below, the front cover 28 defines a parallel discharge path for refrigerant exiting the compression device 18 to the refrigerant outlet port 70.

In the illustrated embodiment, the compressor 10 includes the housing 12, the inverter module 44, the motor 54, and a compression device 18. The housing 12 defines an intake volume 74 and a discharge volume 82. The housing 12 has a generally cylindrical shape and a central axis 90C. The inverter module 44 is mounted inside the housing 12 and adapted to convert direct current electrical power to alternating current electrical power. The motor 54 is mounted inside the housing.

The compression device 18 is coupled to the motor 54 for receiving the refrigerant from the intake volume 74 and compressing the refrigerant as the motor 54 is rotated.

The compression device 18 has a central compression device outlet orifice 84A and first and second side compression device outlet orifices 84B for controllably releasing compressed refrigerant into the discharge volume 82 during a compression cycle. The compression device 18 is configured to release compressed refrigerant into the discharge volume 82 via the first and second side compression device outlet orifices 84B earlier in the compression cycle then refrigerant is released via the central discharge orifices 84A.

In addition, the oil separator 96 utilizes two parallel paths between the compression device 18 and the refrigerant outlet port 70 to reduce the net pressure drop while maintaining the reduction in this pulsation.

In the illustrated embodiment, the oil separator 96 may be located in the discharge volume 82 and integrally formed with the discharge head or front cover 28. As discussed above, oil is used to provide lubrication between the moving components of the electric compressor 10. During operation, the oil and the refrigerant become mixed. The oil separator 96 is necessary to separate the intermixed oil and refrigerant before the refrigerant leaves the electric compressor 10.

Generally, refrigerant is released from the compression device 18 during each cycle, i.e., revolution (or orbit) of the orbiting scroll 66. In the illustrated embodiment, refrigerant leaves the compression device 18 through the central orifice 84A and two side orifices 84B in the fixed scroll 26. Release of the refrigerant through the orifices, 84A, 84B is controlled by the central reed 87A and two side reeds 87B, respectively (see below).

In the illustrated embodiment, the oil separator 96 connects the discharge chambers (see below) by relatively small channels to create pressure drops between the chambers. This acts to smooth out the flow of compressed refrigerant out of the electric compressor 10. Additionally, the oil separator 96 utilizes two parallel paths between the compression device 18 and the refrigerant outlet port 70 to reduce the net pressure drop while maintaining the reduction in this pulsation.

The oil separator 96 may include a series of walls 98A extending from an inner surface of the front cover 28. As shown, the walls 98A separate the discharge volume 82 into a central discharge chamber 82A, two side discharge chambers 82B, am upper discharge chamber 82C and the oil reservoir 98. The central discharge chamber 82A is adjacent the central reed 87A and receives intermixed pressurized refrigerant and oil from the compression device 18 through the central orifice 84A via the reed 87A. The side discharge chamber 82B is adjacent respective side reed 87B and receives intermixed pressurized refrigerant and oil from the compression device 18 through the side orifices 84B via respective reeds 87B. Generally, the pressure of the refrigerant in the chambers is: central discharge chamber 82A >side discharge chambers 82B >upper discharge chamber 82C.

The central discharge chamber 82A is in fluid communication with the two side discharge chambers 82B via respective side channels 100 which are in fluid communication with the upper discharge chamber 82C and the oil reservoir 98 via upper discharge channels 102 and lower discharge channels 104, respectively. In one embodiment, the side channels 100 extend at an acute angle through to the side discharge chambers 82B. The angle of the channels 100 further directs the impact of the discharging mixture of refrigerant and oil to further improve the separation and increase the amount of oil separated out by the oil separator 96. For example, in FIG. 19C, the side channels 100 extend through and downward into the side discharge chambers 82B at approximately a 45-degree angle relative to the inner wall of the central discharge chamber 82A. However, the angle may vary depending on the application or surface contours of the side discharge chambers 82B, and in some variations may increase to approximately 60 degrees. The angle may vary but is designed to direct the flow to create turbulence and direct the flow impact to create a tortuous path within the side discharge chambers 82B to increase the separation of oil into the lower discharge channels 104.

As shown, the oil separator 96 includes the central discharge chamber 82A and a lower baffle 132. In the illustrated embodiment, the lower baffle 132 is chevron-shaped (inverted "v") and is located between the central chamber 82 and the oil reservoir 98. The shape of the lower baffle 132 creates an area of low pressure directly underneath. Intermixed oil and refrigerant enter the central discharge chamber 82A and is drawn downward by the low-pressure area. The oil and refrigerant are separated when the intermixed oil and refrigerant comes into contact with the upper surface of the lower baffle 132. The oil drops into the oil reservoir 98.

Refrigerant may enter the side discharge chambers 82B via the side channels 100 and/or lower discharge channels 104. Refrigerant may then enter the upper discharge chamber 82C and then exit via the refrigerant outlet port 70.

The oil reservoir 98 is located below the pair of side chambers and is connected thereto via the respective lower discharge channels 104. The oil reservoir is configured to receive oil separated from the compressed refrigerant in the side chambers. Gravity acting on the oil assists in the separation and the oil falls through the lower discharge channels 104 located in the side discharge chambers 82B into the oil reservoir 98.

As discussed above, the reed mechanism 86 includes a discharge reed 86A and a reed retainer 86B which define the reeds 87A, 87B. The discharge reed 86A is used to tune the pressure at which the refrigerant is allowed to exit the compression device 18 through the central orifice 84A and two side orifices 84B, respectively.

Electric Compressor with Integrated Sensor(s)

With reference to FIGS. 21 and 22A-26C, in one aspect of the present invention, an electric scroll-type sensor 10 may include one or more integrated sensors 150. With specific reference to FIG. 21, a functional block diagram of the electric compressor 10 with the integrated sensor(s) 150 is shown. In one embodiment, the integrated sensor(s) 150 includes an integrated first pressure sensor 150A. In another embodiment, the integrated sensor(s) 150 may also include an integrated first temperature sensor 150B. As shown, the integrated first pressure sensor 150A and the integrated first temperature sensor 150B are connected to a first filter circuit 152 for conditioning and filtering the raw sensor data from the integrated sensors 150A, 150B. The filter circuit 152 is coupled to an off-board vehicle electronic control unit 230 and provides filtered/conditioned sensor signals to the off-board vehicle electronic control unit 230. The first temperature sensor 150B may be connected to the printed circuit board 48 by a pair of wires (see below) that are routed through the internal housing partition 168.

In one embodiment, the integrated first pressure sensor 150A and the filter circuit 152 are integrated into a single integrated circuit 156, e.g., a micro-electromechanical system (MEMS). In the illustrated embodiment, the first integrated pressure sensor 150A and the first integrated temperature sensor 150B are configured to measure or establish a pressure and temperature, respectively, associated with the intake volume 74.

The electric compressor 10 may also include an integrated second pressure sensor 150C and an integrated second temperature sensor 150D. The integrated second pressure and temperature sensors 150C, 150D are connected to a second filter circuit 158. As shown, the integrated second pressure sensor 150C and the second filter circuit 158 may be integrated into a second integrated circuit 160, such as a second MEMS.

As discussed in more depth below, the first pressure sensor 150A and the first temperature sensor 150B may be configured to sense or establish a pressure and a temperature, respectively, associated with the intake volume 74. The second pressure sensor 150C and the second temperature sensor 150D may be configured to sense or establish a pressure and a temperature, respectively, associated with the discharge volume 82.

With reference to FIGS. 22A-26C, several embodiments will be discussed below.

In a first embodiment shown in FIGS. 22A-22I, the electric scroll-type compressor 10 includes the integrated first pressure sensor 150A and the integrated first temperature sensor 150B. As discussed above, the inverter or controller circuit 46 is mounted to a printed circuit board 48. In the embodiment, shown in FIGS. 22A-22I, the first pressure sensor 150 is mounted directly to the printed circuit board 48.

In a second embodiment, shown in FIGS. 23A-23G, the electric scroll-type compressor 10 only includes the first pressure sensor 150A mounted to the printed circuit board 48.

As discussed in more detail below, in the third and fourth embodiments the electric compressor 10 includes a pressure sensor module 162. The pressure sensor module 162 includes a pressure sensor module housing 162A. The pressure sensor module housing 162A defines a pressure sensor cavity 162C. A pressure sensor module (or second) printed circuit board 162B is positioned within the pressure sensor cavity 162C and is electrically coupled to the printed circuit board 48 via an electrical connector 166 that is used for communications between the sensor(s) 150A, 150B. The pressure sensor 150A is mounted directly to the pressure sensor module printed circuit board 162B.

The first temperature sensor 150B may be connected or wired to the second printed circuit board 162B. The removable pressure module, including the first pressure sensor 150A and the first temperature sensor 150B, may be preassembled and installed as a preassembled unit into the electric compressor 10.

As discussed above, the electric compressor 10 has an outer housing or housing 12. The housing 12 includes an inverter housing 22 and an inverter back cover 20. The inverter housing and the inverter back cover 20 define the inverter cavity 30. An inverter module 44 is located/positioned within the inverter cavity 30. The inverter module 44 includes an inverter or controller circuit 46 mounted at least partially on a printed circuit board 48. As discussed in more detail below, each of the embodiments shown in FIGS. 22A-22I, FIGS. 23A-23G, FIGS. 24A-24H, and FIGS. 25A-25E, the electric compressor 10 includes an internal housing partition 168 separating an intake volume 74 and the inverter cavity 30. The internal housing partition 168 includes a passage 170 therethrough for receiving refrigerant from the intake volume 74. The passage 170 has an intake volume end 170A and an inverter cavity end 170B. The intake volume end 170A is open to the intake volume 74. As discussed in more detail below, the first pressure sensor 150A is positioned within the inverter cavity 30 adjacent to the inverter cavity end 170B of the passage 170 for sensing a pressure associated with the refrigerant within the passage (and thus, the intake volume 74).

Figure 26A:
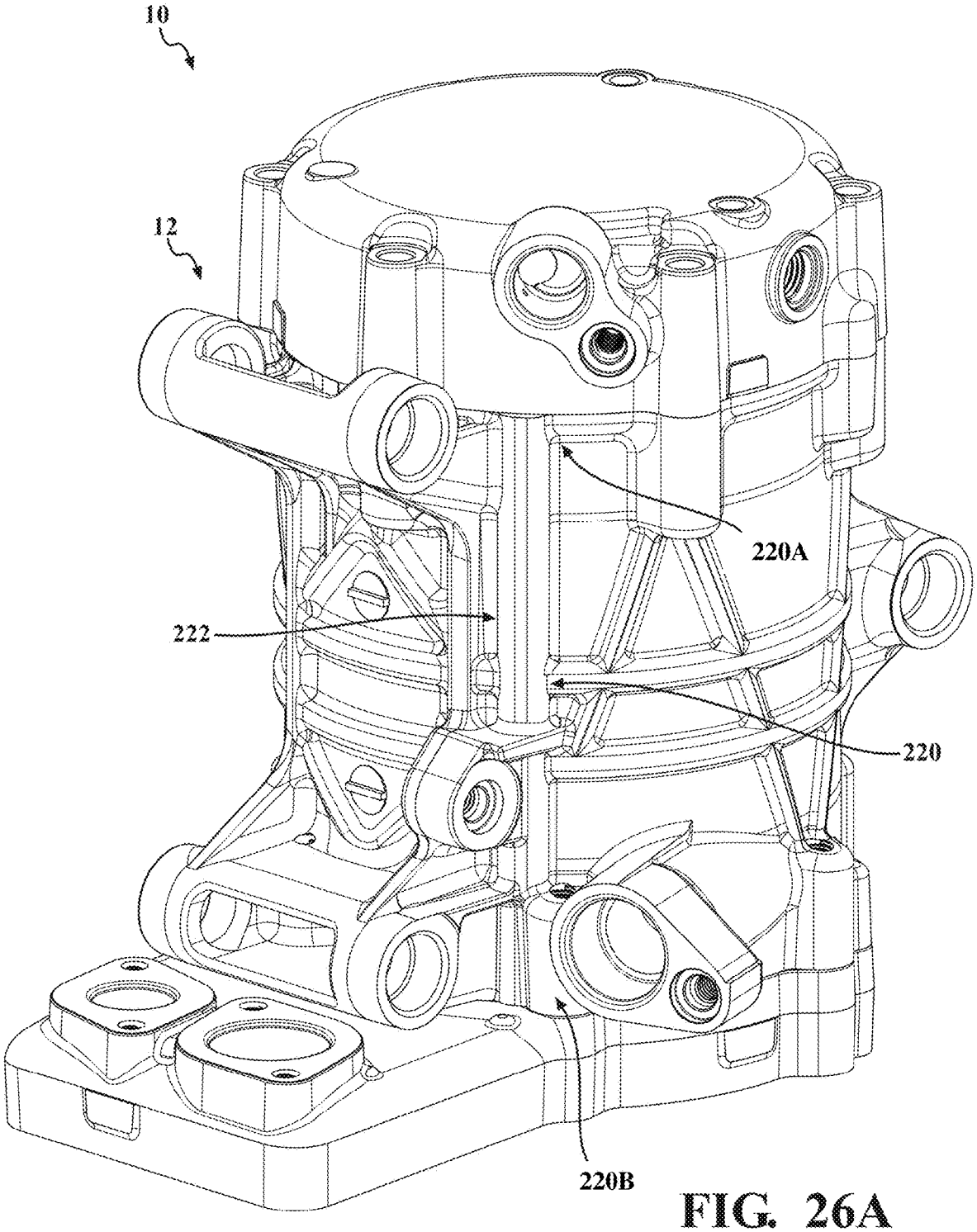
FIG. 26A is a perspective view of an electric compressor having an integrated pressure sensor and a passage from a discharge chamber to the pressure sensor, according to an embodiment of the present invention.
Figure 26B:
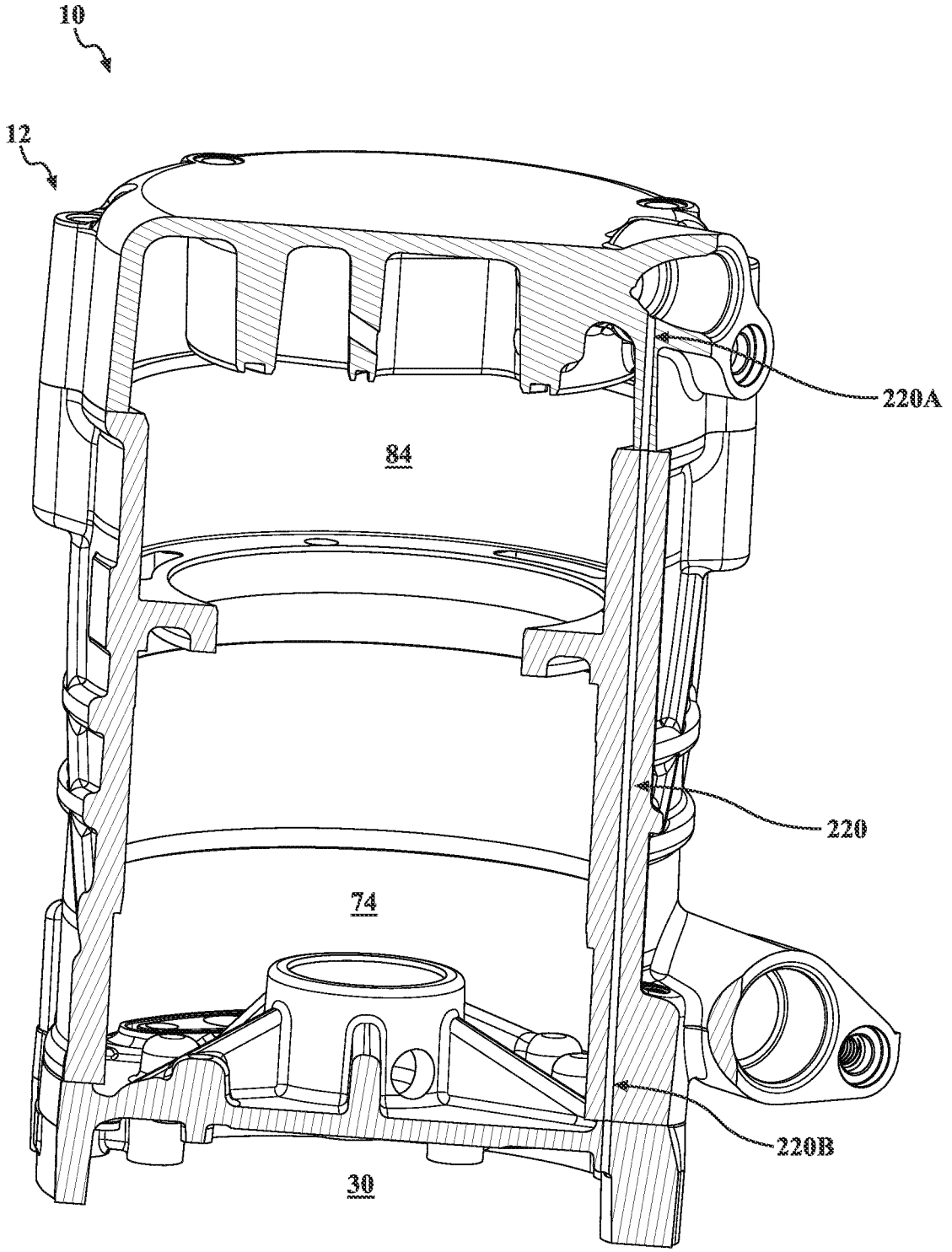
FIG. 26B is a cross-sectional view of the electric compressor of FIG. 26A.

With reference to FIGS. 26A-26C, the electric scroll-type compressor 10 includes the integrated second pressure and temperature sensors 150C, 150D. The embodiment shown in FIGS. 26A-26C may be used with, or adapted for use by, any of the first, second, third and fourth embodiments.

First Embodiment of Electric Scroll-Type Compressor with Integrated Sensor(s)

Figure 22A:
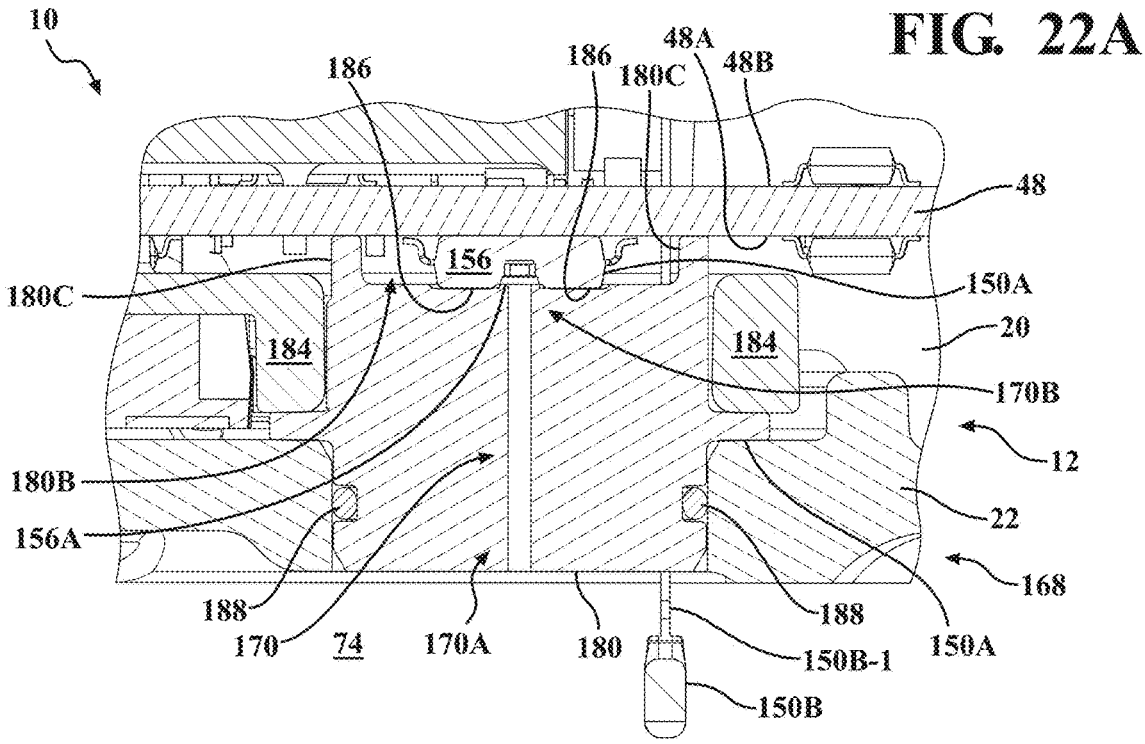
FIG. 22A is a cross-sectional view of an electric compressor with an integrated pressure and temperature sensor, according to a first embodiment of the present invention.
Figure 22B:
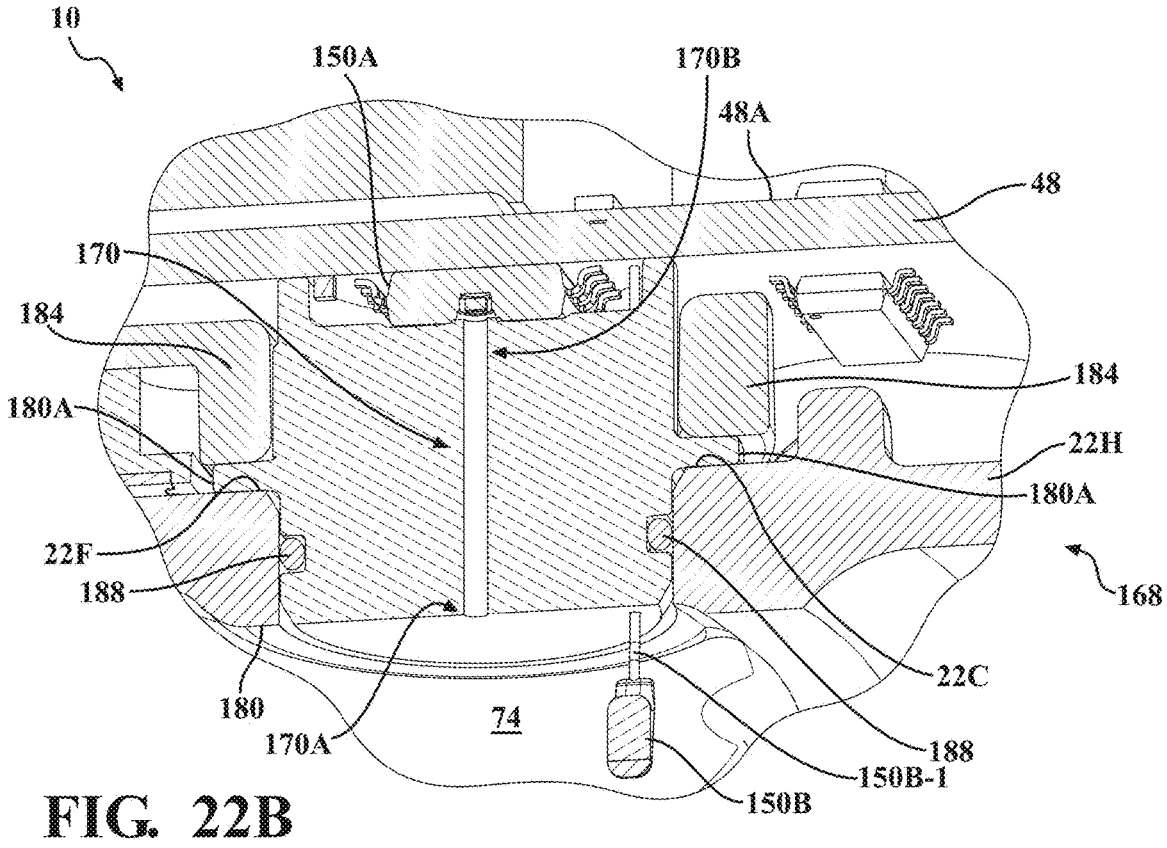
FIG. 22B is a cross-sectional perspective view of the electric compressor of FIG. 22A.
Figure 22C:
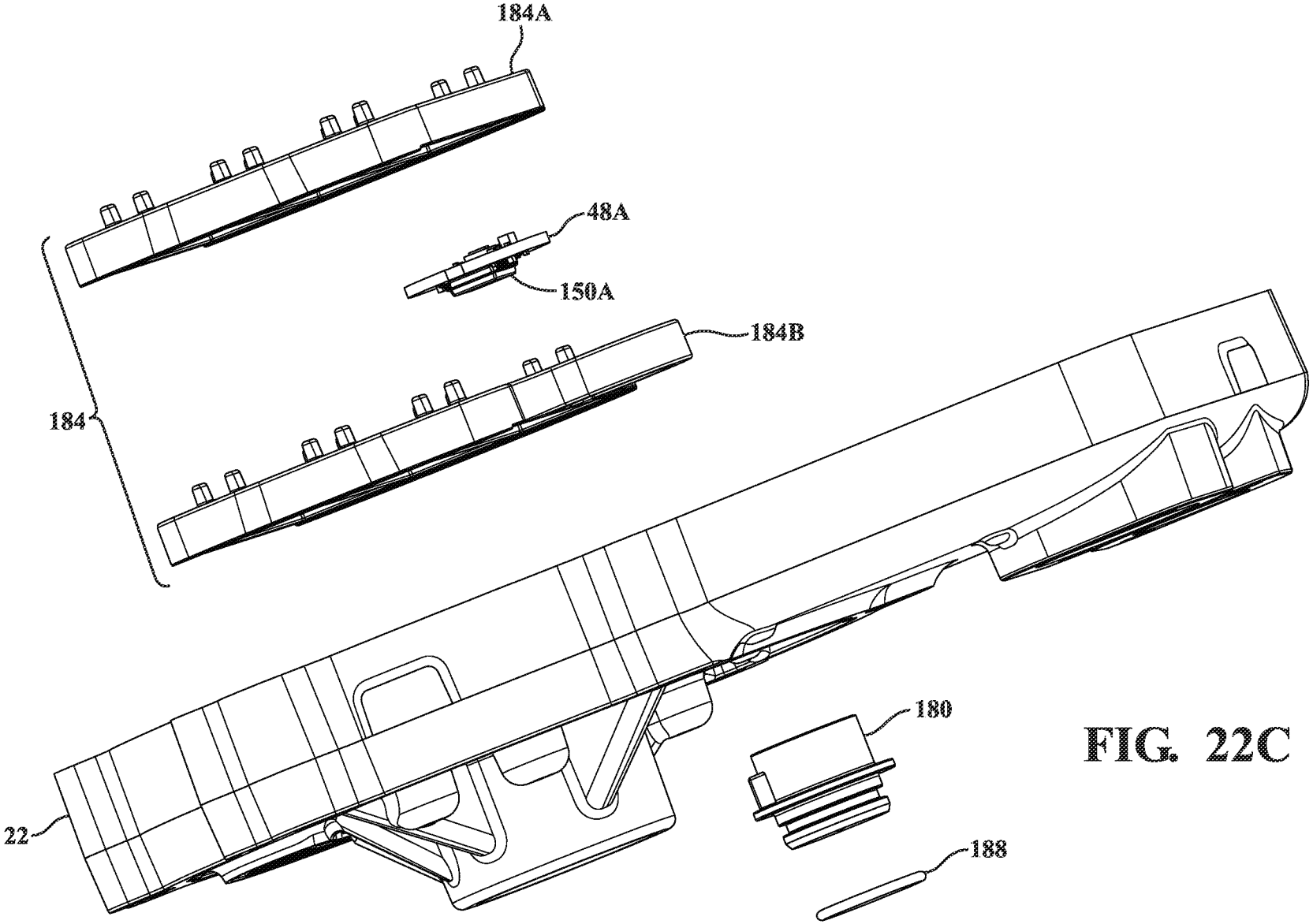
FIG. 22C is a partial exploded view of the electric compressor of FIG. 22A.
Figure 22D:
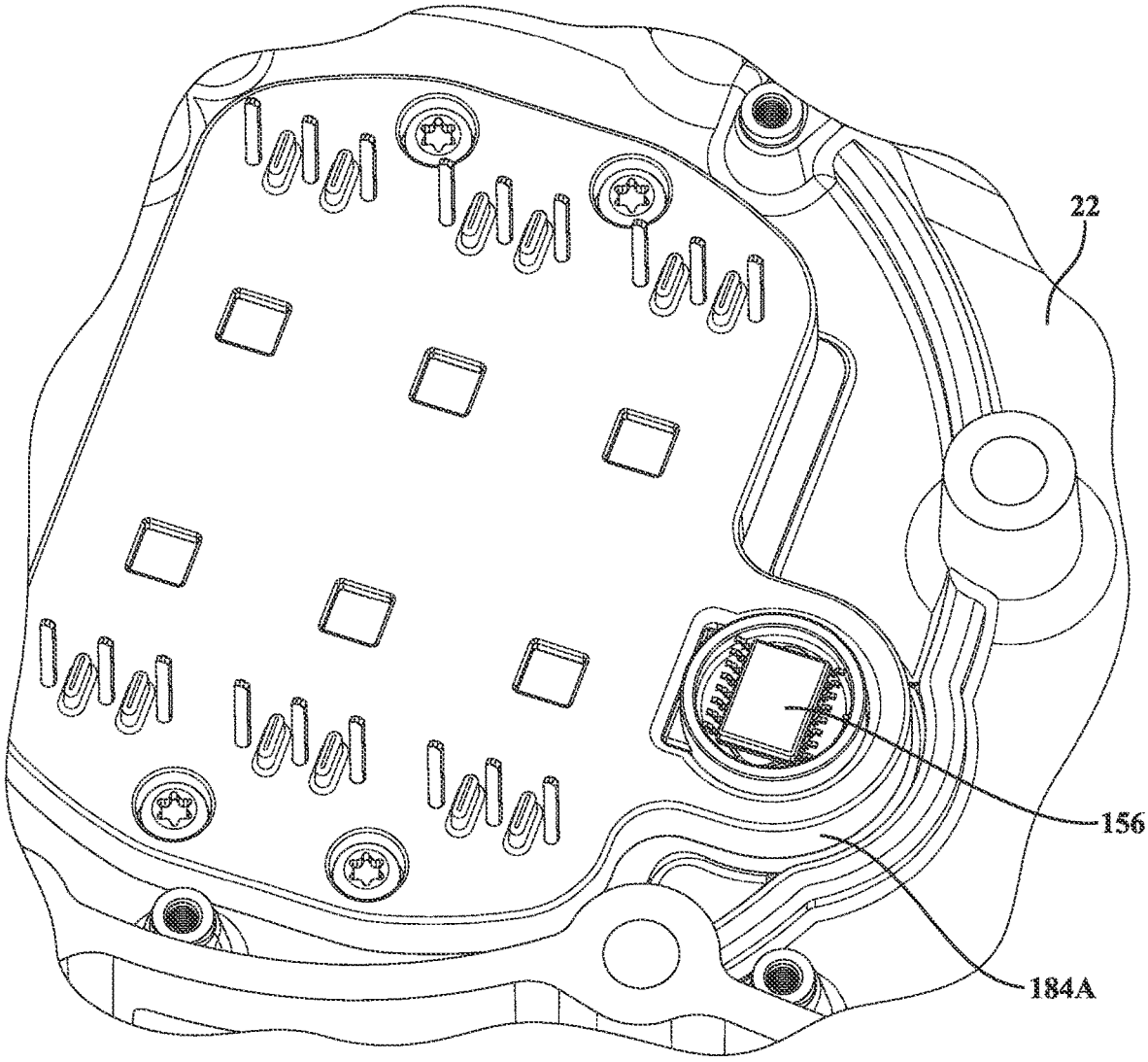
FIG. 22D is a second cross-sectional perspective view of the electric compressor of FIG. 22A.
Figure 22E:
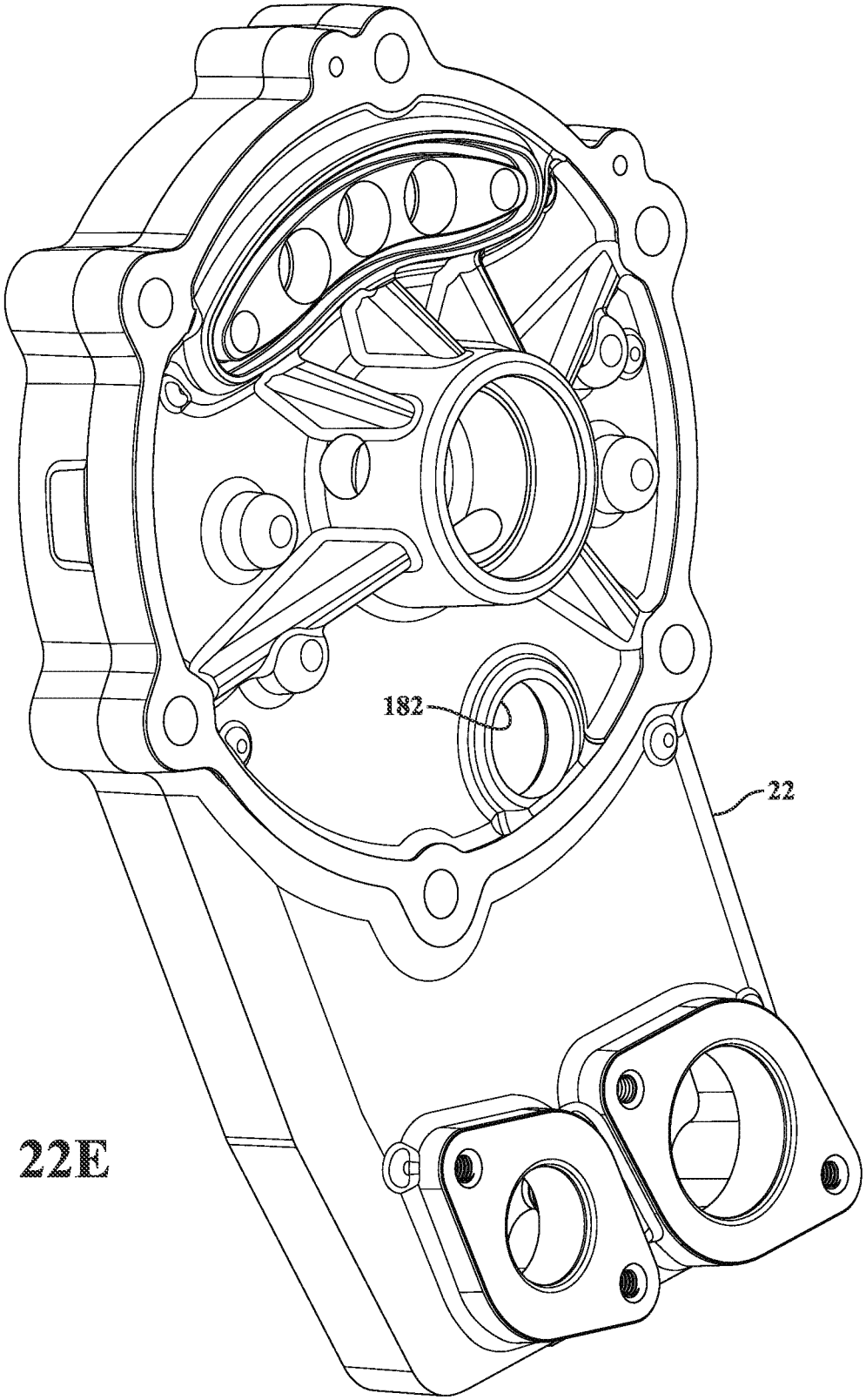
FIG. 22E is a perspective view of an inverter housing of the electric compressor of FIG. 22A.
Figure 22F:
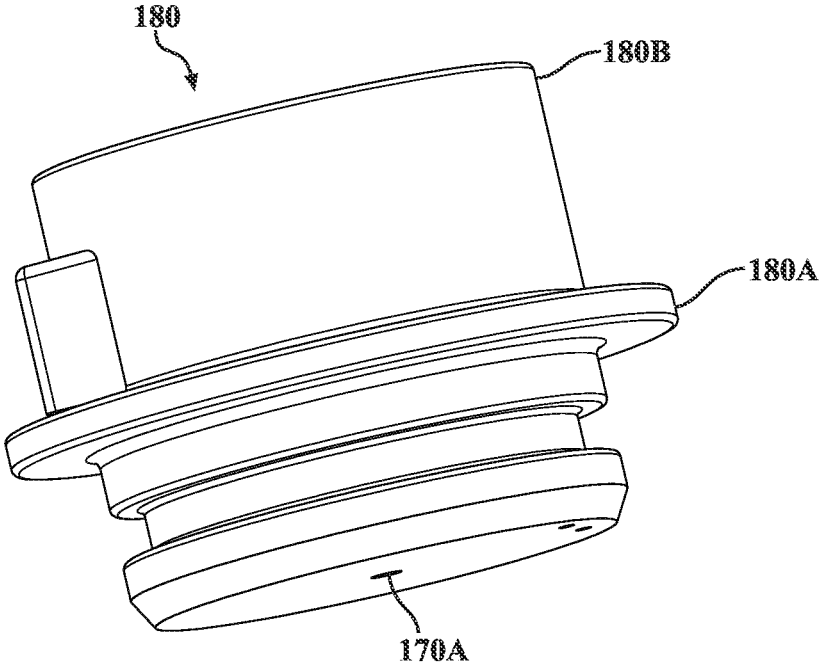
FIG. 22F is a first perspective view of a holder of the electric compressor of FIG. 22A.

With reference to FIGS. 22A-22I, a scroll-type electric compressor 10 with an integrated first pressure sensor 150A and an integrated first temperatures sensor 150B according to the first embodiment is shown. With specific reference to FIGS. 22A, 22B, 22C, and 22F-22I, in the first embodiment, the scroll-type electric compressor includes a holder 180. As best shown in FIG. 22E, the inverter housing 22 includes a holder aperture 182 for receiving the holder 180. In the illustrated embodiment, the holder 180 includes an outer edge 180A located on an outer surface of, extending away from the holder 180. The outer edge 180A is positioned between, and held in place, by a surface 22A of the inverter housing 22 and a retainer 184. Alternatively, or in addition, the holder 180 may be held in place relative to the inverter housing 22 by an interference fit. The holder 180 may be composed from a non-metallic material, for example, a plastic. As shown, the holder 180 defines at least part of the internal housing partition 168.

In the illustrated embodiment, the passage 170 is positioned or located within the holder 180. The holder 180 may be cylindrical with a generally circular outer circumference. The holder 180 may include an upper cavity 180B defined by an upper ridge 180C. As shown, in the illustrated embodiment, the upper ridge 180C encircles an outer edge of a top of the holder 180.

As shown, the pressure sensor 150A and the filter circuit 152 may be embodied in a MEMS integrated circuit or package 156 mounted directly on the printed circuit board 48. The MEMS package 156 includes a pressure sensitive plate 156A that is located adjacent the inverter cavity end 170B of the passage 170. The pressure sensitive plate 156A measures or senses a pressure associated with the refrigerant in the intake volume 74 and the passage 170. As discussed above, the filter circuit 152 conditions the signal from the pressure sensor 150A which is communicated to the controller circuit 46 which communicates a filter or conditioned pressure signal to the vehicle electronic control unit 230.

The MEMS package 156 may be sealed against a bottom surface of the upper cavity 180B of the holder 180 using adhesive 186. An O-ring 188, located between an outer surface of the holder 180 and an interior surface of the inverter housing 22 may be provided to seal the upper cavity 180B and the inverter cavity 30 from the intake volume 74 adjacent a bottom surface of the holder 180 (opposite the upper cavity 180B).

In the illustrated first embodiment, the electric compressor 10 includes the first temperature 150B. However, it should be noted that the first temperature 150B is optional.

Figure 22G:
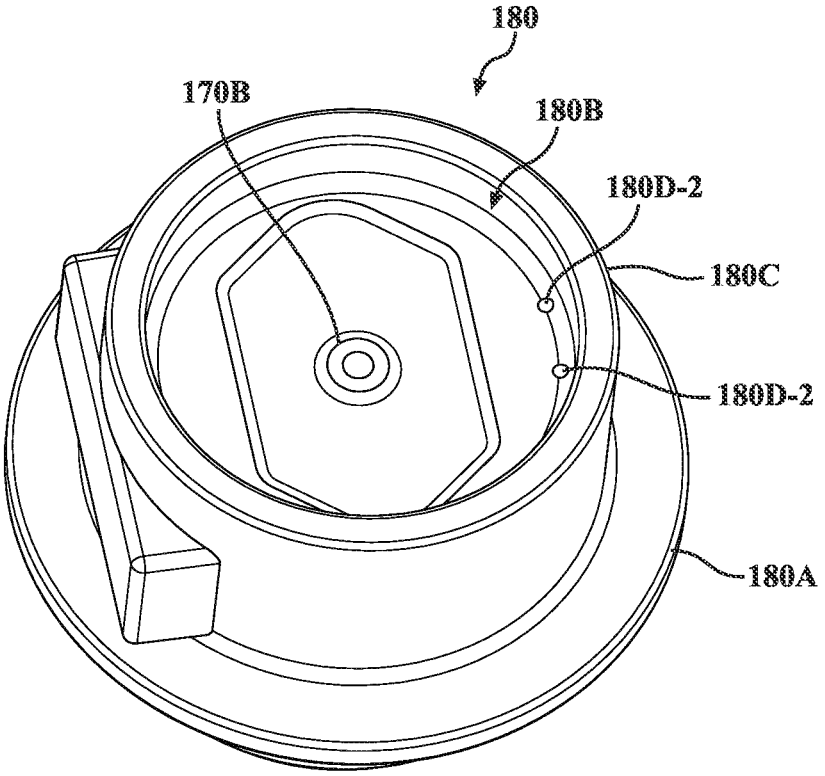
FIG. 22G is a second perspective view of the holder of FIG. 22F.
Figure 22H:
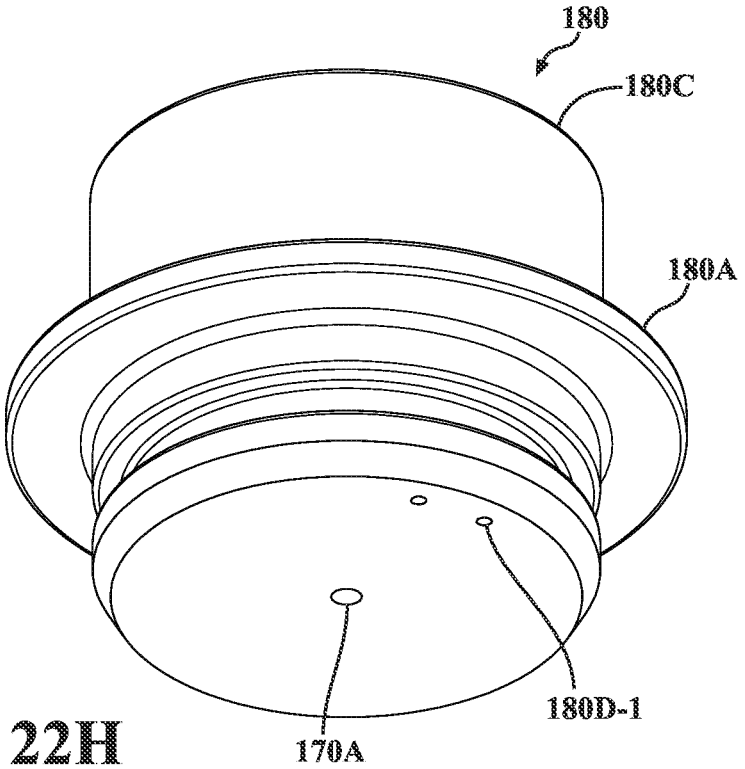
FIG. 22H is a third perspective view of the holder of FIG. 22F.
Figure 22I:
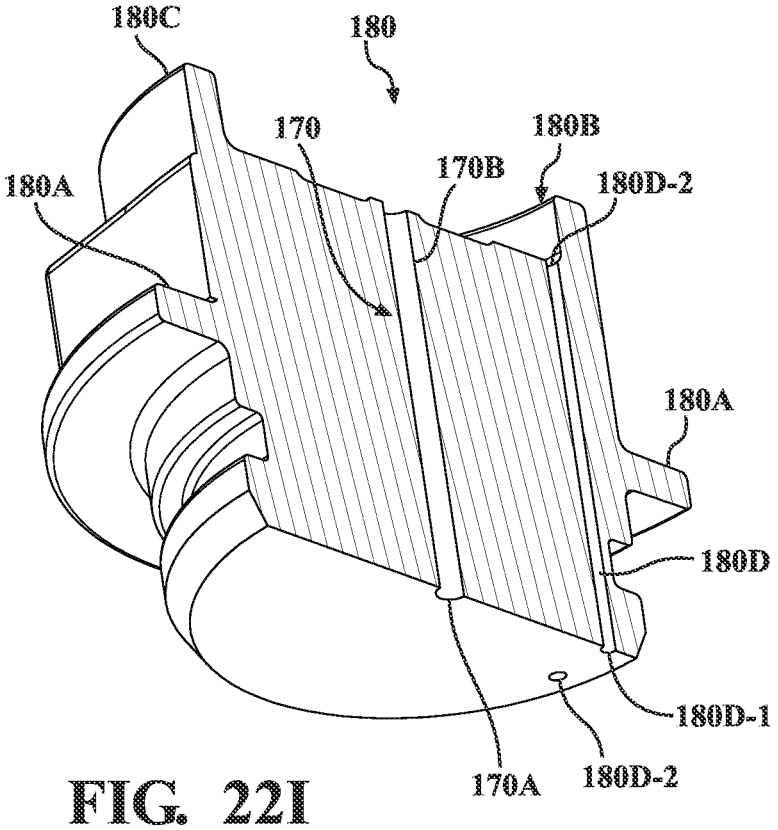
FIG. 22I is a cross-sectional view of the holder of FIG. 22F.
Figure 23A:
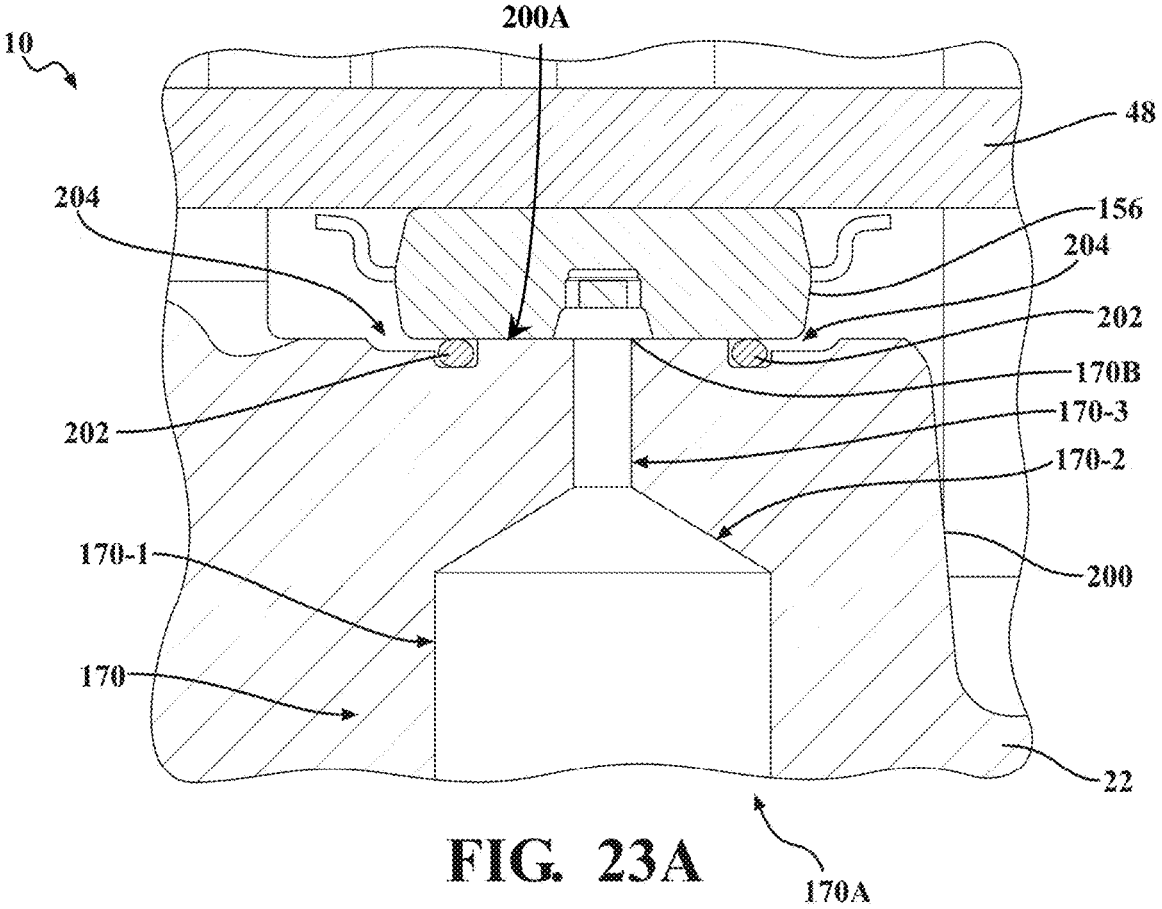
FIG. 23A is a cross-sectional view of an electric compressor with an integrated pressure sensor, according to a second embodiment of the present invention.
Figure 23B:
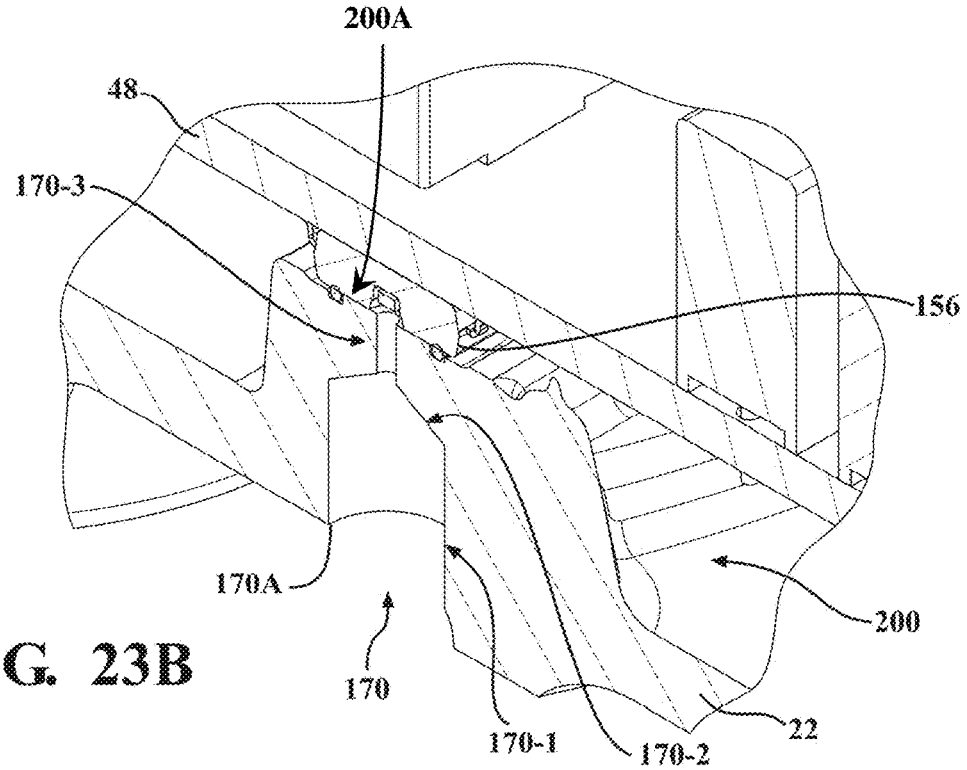
FIG. 23B is a cross-sectional perspective view of the electric compressor of FIG. 23A.
Figure 23C:
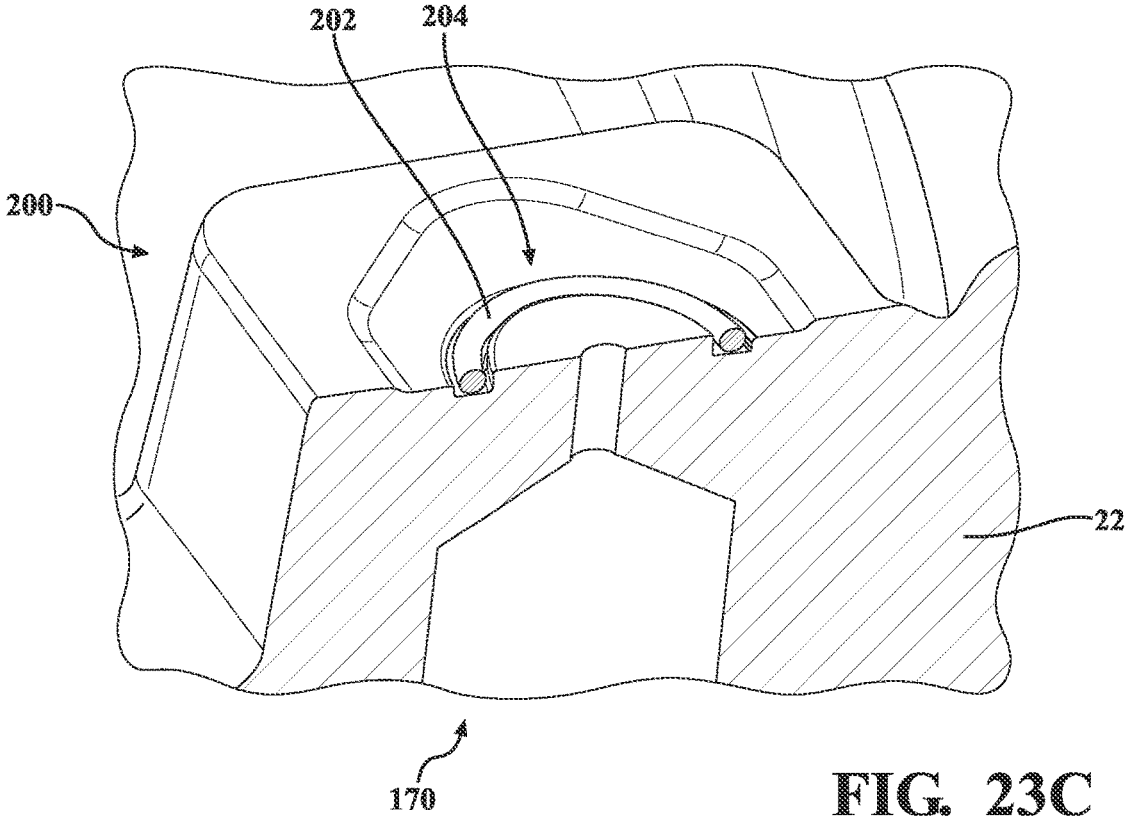
FIG. 23C is a second cross-sectional perspective view of the electric compressor of FIG. 23A.
Figure 23D:
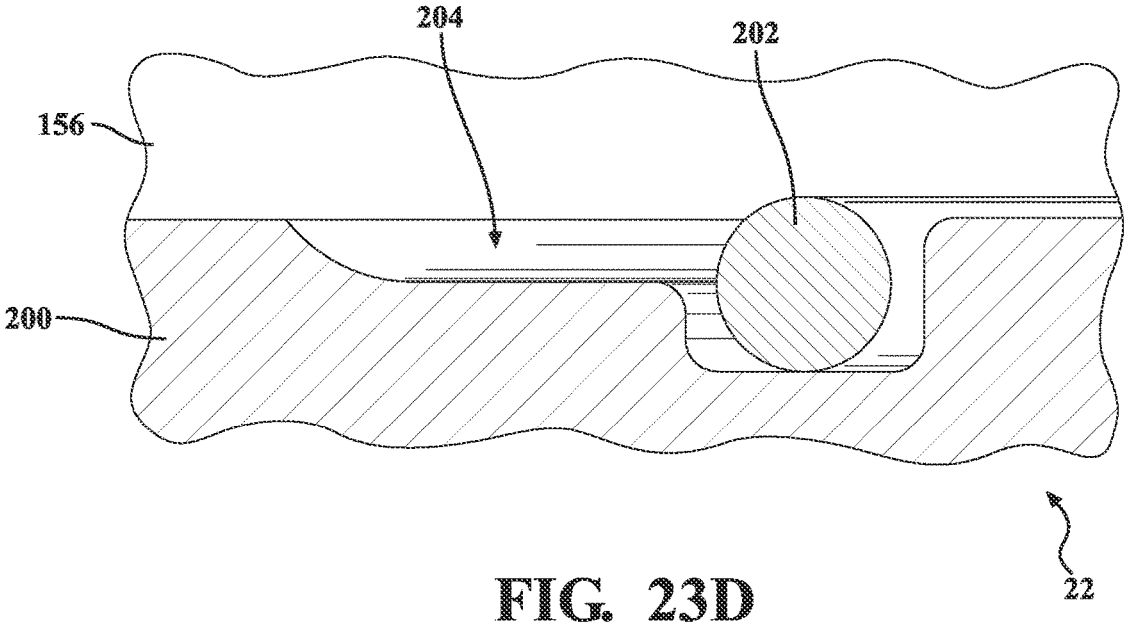
FIG. 23D is a third cross-sectional perspective view of the electric compressor of FIG. 23A.
Figure 23E:
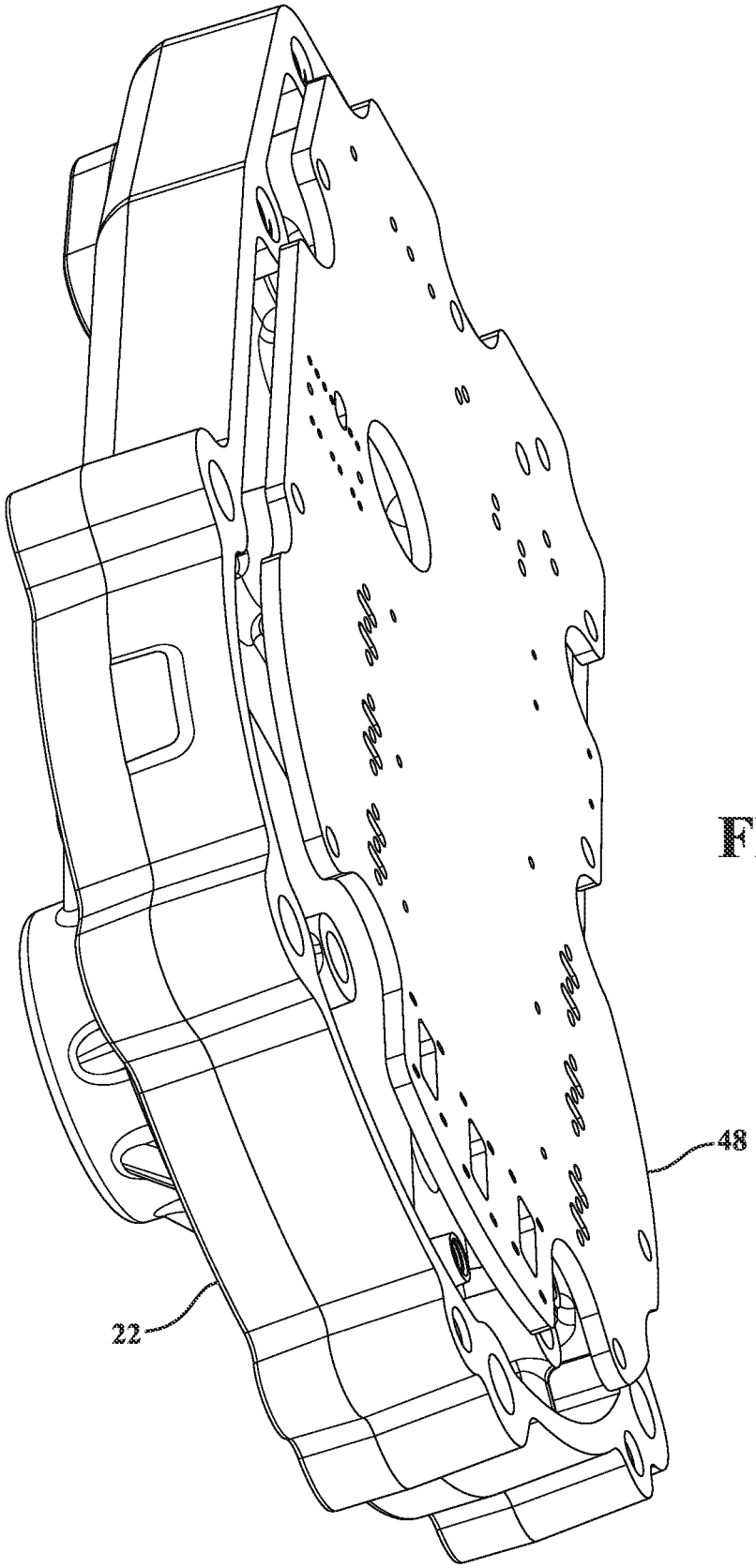
FIG. 23E is a partial perspective view of the electric compressor of FIG. 23A including an inverter housing.
Figure 23F:
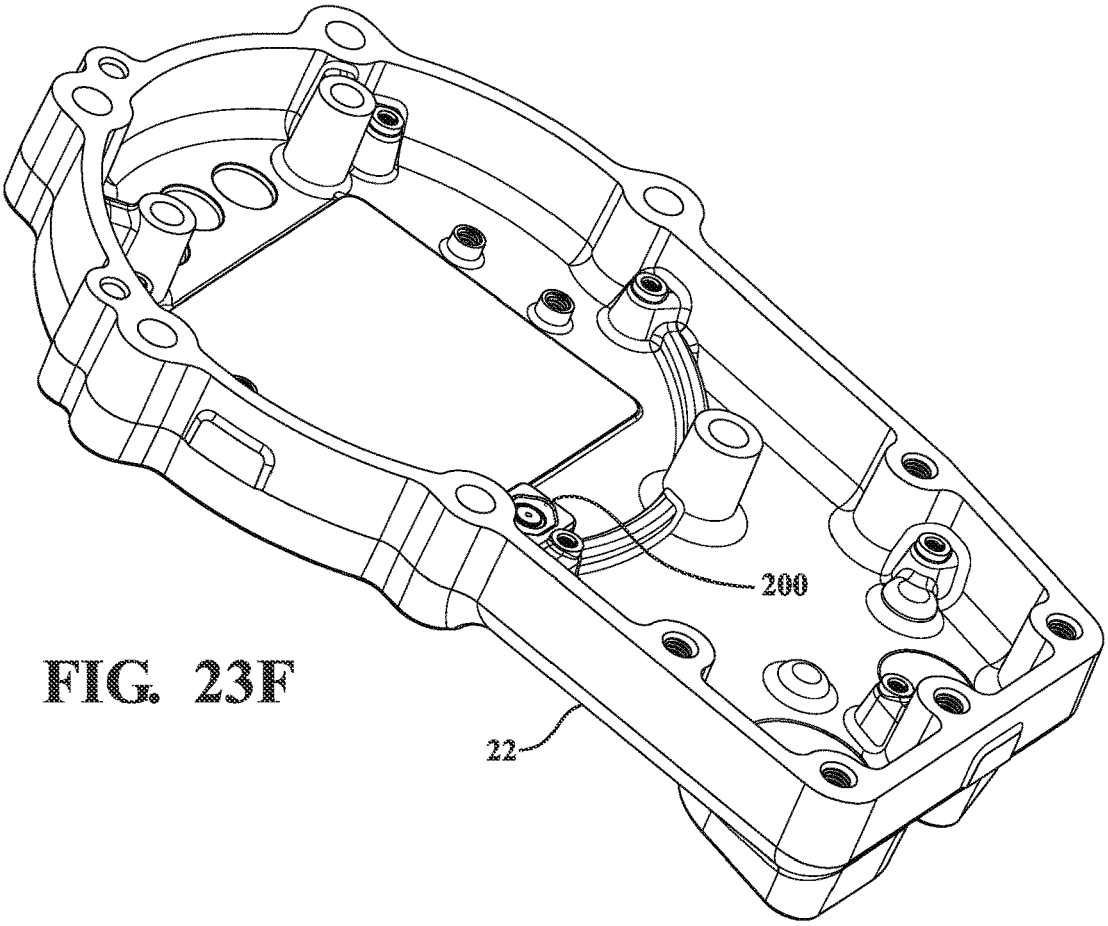
FIG. 23F is a first perspective view of the inverter housing of FIG. 23E.
Figure 23G:
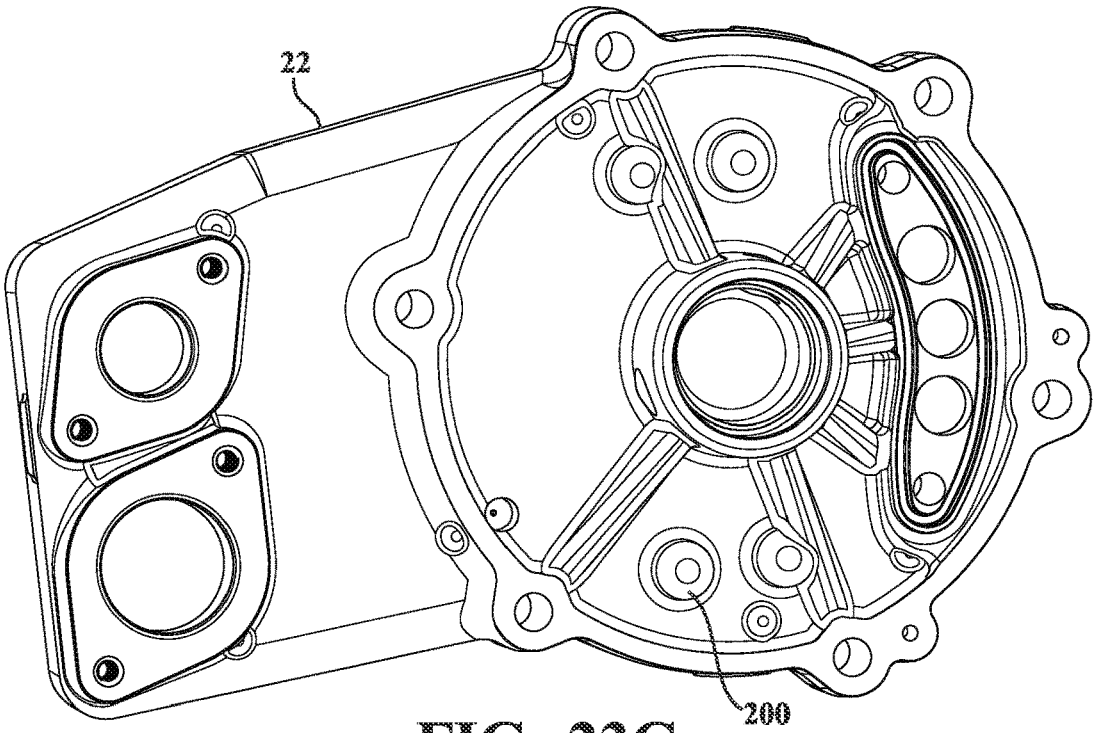
FIG. 23G is a second perspective view of the inverter housing of FIG. 23E.

As shown, the first temperature sensor 150B is positioned with the intake volume 74 near or adjacent the bottom surface of the holder 180. The first temperature sensor 150B may be a thermistor and may be connected or electrically coupled to the printed circuit board 48 by a pair of wires 150B-1. With reference to FIGS. 22G, 22H and 22I, the pair of wires 150B-1 may be routed through respective apertures 180D. Each aperture 180D includes a first end 180D-1 within the bottom surface of the holder 180 and a second end 180D-2 within the upper cavity 180B.

The printed circuit board 48 may include one or more sub-boards. For example, the printed circuit board 48 may include a sub-board 48A. The MEMS package 156 may be mounted directly to the sub-board 48A which, when the electric compressor 10 is assembled, fits within a complementary recess in the main board 48B of the printed circuit board. Suitable electrical contacts on the sub-board 48A and the main board 48B connect the MEMS package 156 to the inverter circuit 46 mounted to the main board 48B. It should also be noted that the retainer 184 may include two or more retainer portions 184A, 184B.

As mentioned above, the first temperature sensor 150B is optional. If a first temperature sensor 150B is not utilized, then the holder 180 does not include the apertures 180D.

Second Embodiment of Electric Scroll-Type Compressor with Integrated Sensor(s)

With specific reference to FIGS. 23A-23G, an electric compressor 10 according to a second embodiment is shown. In the second embodiment, the internal housing partition 168 is composed from, or is part of the, the inverter housing 22. In other words, the electric compressor 10 does not include the separate holder 180 (of the first embodiment). As with the first embodiment, the MEMS package 156 is mounted directly to the printed circuit board 48. With specific reference to FIGS. 23A-23D, the inverter housing 22 includes a raised housing feature 200 that rises from the inverter housing 22 to mate with the MEMS package 156. The raised housing feature 200 is part of, and integrally formed, with the inverter housing 22. The passage 22 is located within the raised housing feature 200 which extends from a lower surface of the inverter housing 22 towards the inverter cavity 30. The passage 170 includes an intake volume end 170A and an inverter cavity end 170B. The raised housing feature 200 includes an upper surface 200A that is adjacent to, and in contact with the MEMS package 156. The junction between the MEMS package 156 and the upper surface 200A of the raised housing feature 200 may be sealed with an O-ring 202 and/or adhesive (in cavity 204).

In the illustrated embodiment, the passage 170 includes a lower portion 170-1, an intermediate portion 170-2, and an upper portion 170-3. The lower portion 170-1 extends from lower surface of the inverter housing 22 and forms the intake volume end 170A of the passage. The intermediate portion 170-2 is located at an opposite end of the lower portion 170-1. The upper portion 170-3 is positioned above the intermediate portion 170-2 and forms the inverter cavity end 170B of the passage 170. The lower portion 170-1 has a diameter that is greater than a diameter of the upper portion 170-3. The intermediate portion 170-2 has a diameter that is equal to the diameter of the lower portion 170-1 at one end and a diameter equal to the diameter of the upper portion 170-3 at the opposite end.

As shown, the pressure sensor 150A and the filter circuit 152 may be embodied in a MEMS integrated circuit or package 156 mounted directly on the printed circuit board 48. The MEMS package 156 includes a pressure sensitive plate 156A that is located adjacent the inverter cavity end 170B of the passage 170. The pressure sensitive plate 156A measures or senses a pressure associated with the refrigerant in the intake volume 74 and the passage 170. As discussed above, the filter circuit 152 conditions the signal from the pressure sensor 150A which is communicated to the controller circuit 46 which communicates a filter or conditioned pressure signal to the vehicle electronic control unit 230.

Third Embodiment of Electric Scroll-Type Compressor with Integrated Sensor(s)

With reference to FIGS. 24A-24H, an electric compressor 10 according to the third embodiment is shown. In the third embodiment, the electric compressor 10 includes the pressure sensor module 162. In one aspect of the present invention, the pressure sensor module 162 may be preassembled and removable from the electric compressor 10.

In the illustrated embodiment, the pressure sensor module 162 of the third embodiment, includes the first pressure sensor 150A and the first temperature sensor 150B. However, it should be noted that the first temperature sensor 150B is optional. In other words, the pressure sensor module 162 of the third embodiment, may be provided with the first pressure sensor 150A only. As discussed above, the pressure sensor module 162 includes a pressure sensing housing 162A that defines a pressure sensor cavity 162C. The pressure sensing housing 162A may further include an intake volume side wall 162D. The passage 170 may be formed within the intake volume side wall 162D.

As shown, in the illustrated embodiment, the pressure sensor module housing 162A may include a first portion 162A-1 and a second portion 162A-2. The first and second portions 162A-1, 162A-2 may be composed from a non-metallic material, such as a plastic. The intake volume side wall 162D may be formed in the first portion 162A-1 of the pressure sensor module housing 162A.

Figure 24A:
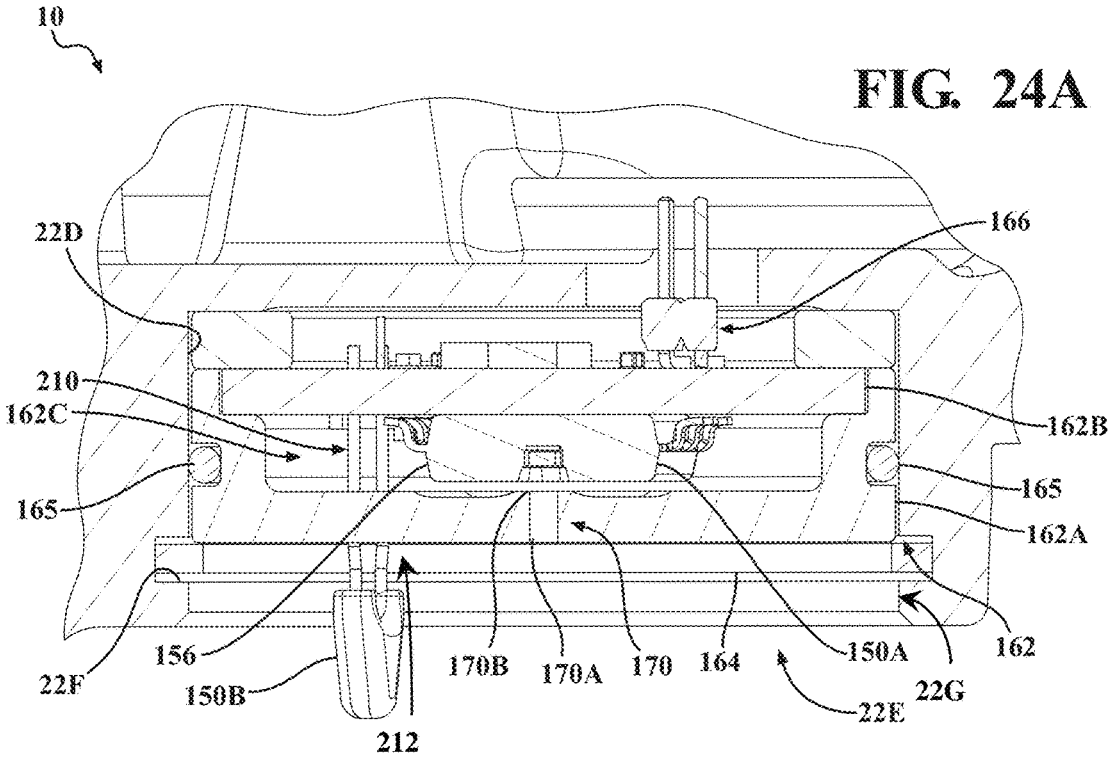
FIG. 24A is a cross-sectional view of an electric compressor with an integrated pressure sensor and an integrated temperature sensor, according to a third embodiment of the present invention.
Figure 24B:
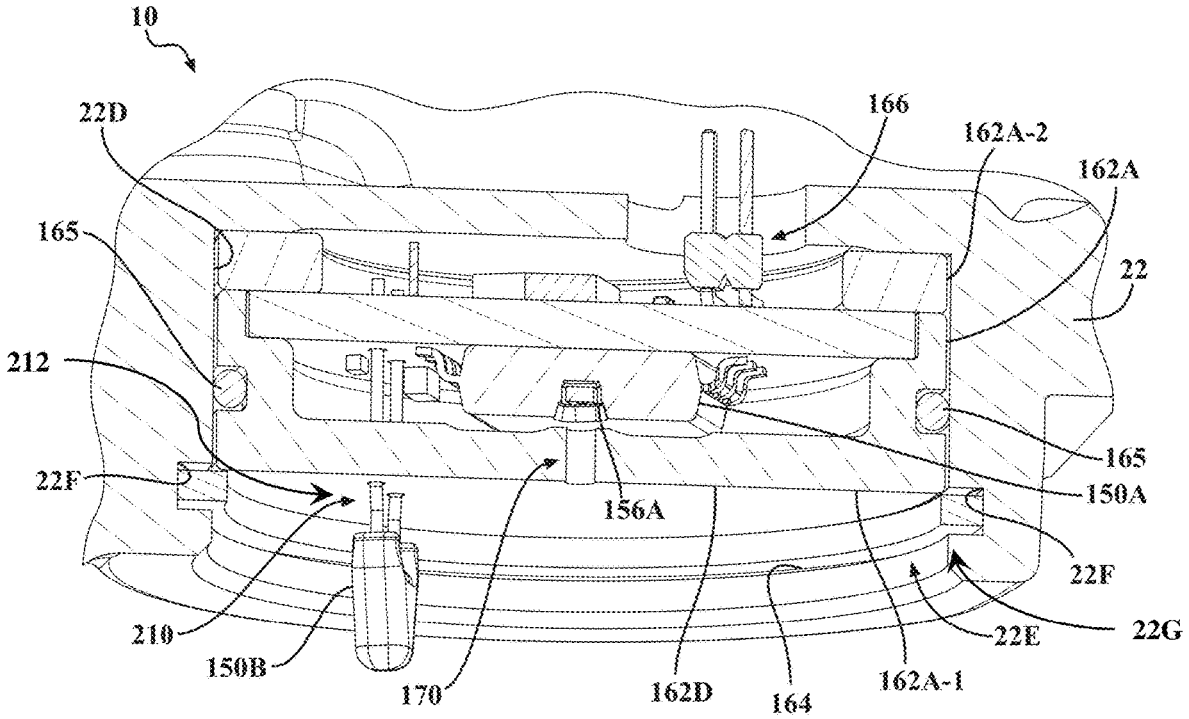
FIG. 24B is a cross-sectional perspective view of the electric compressor of FIG. 24A.
Figure 24C:
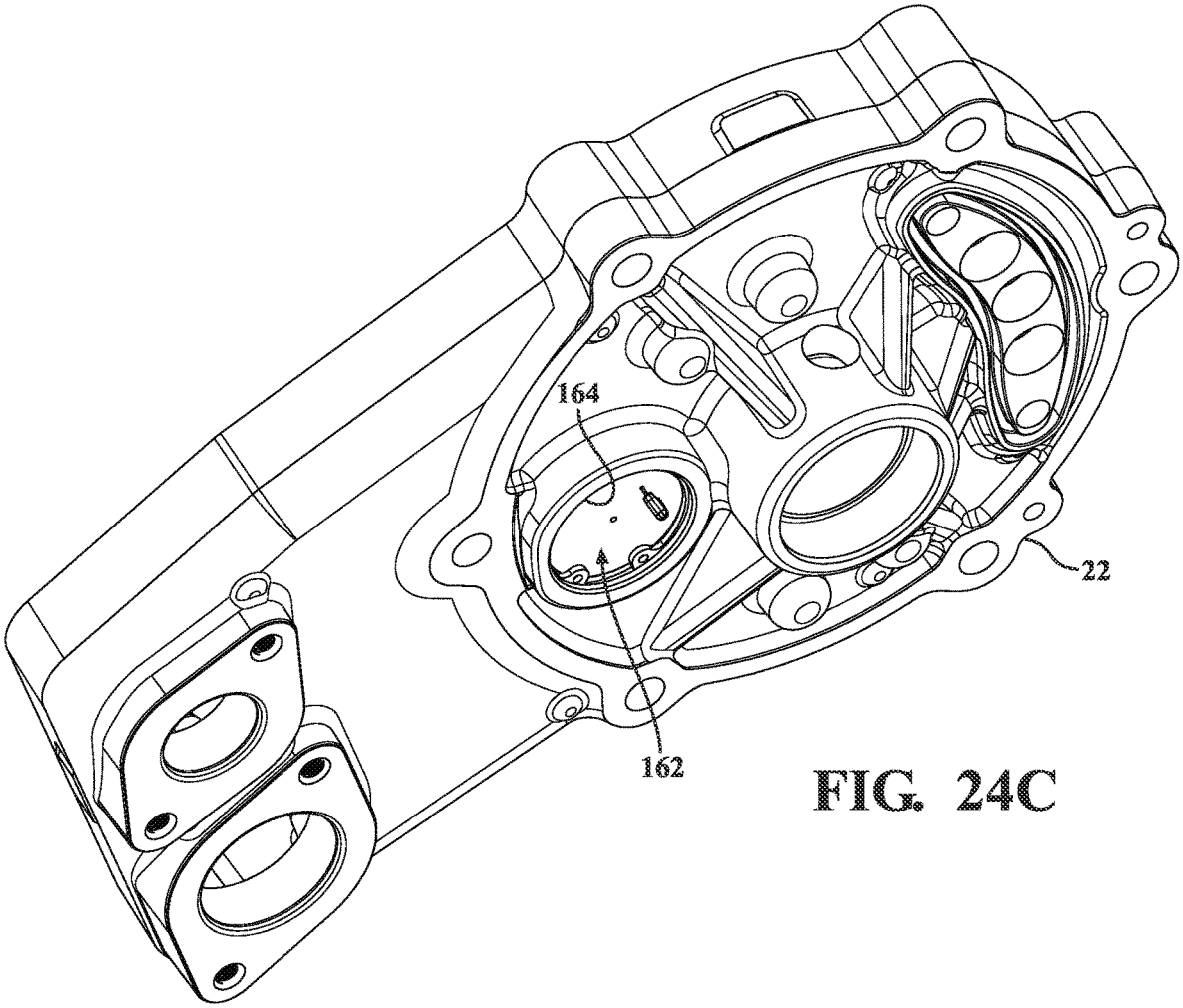
FIG. 24C is a partial perspective view of the electric compressor of FIG. 24A.
Figure 24D:
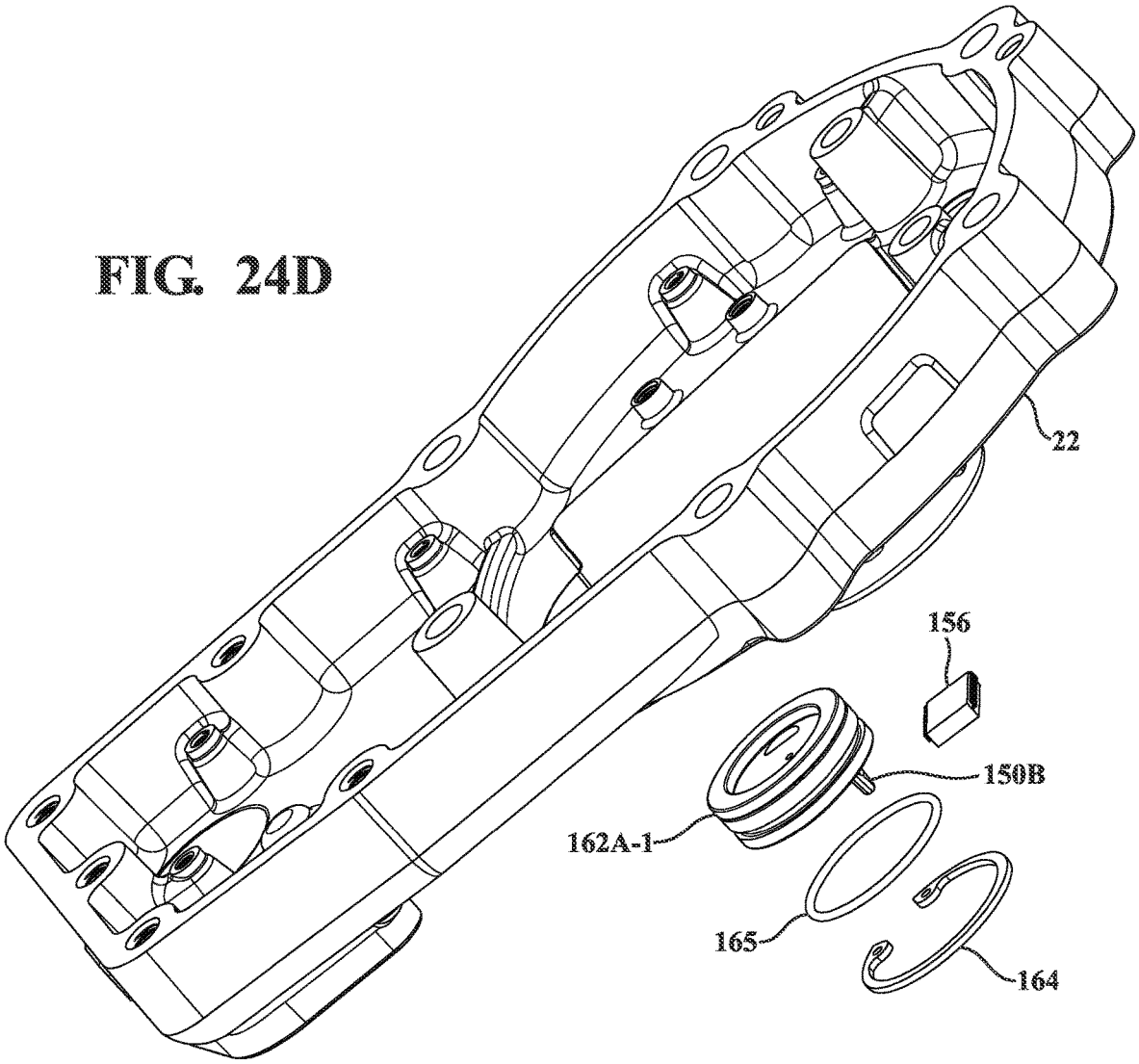
FIG. 24D is a partial exploded view of the electric compressor of FIG. 24A.
Figure 24E:
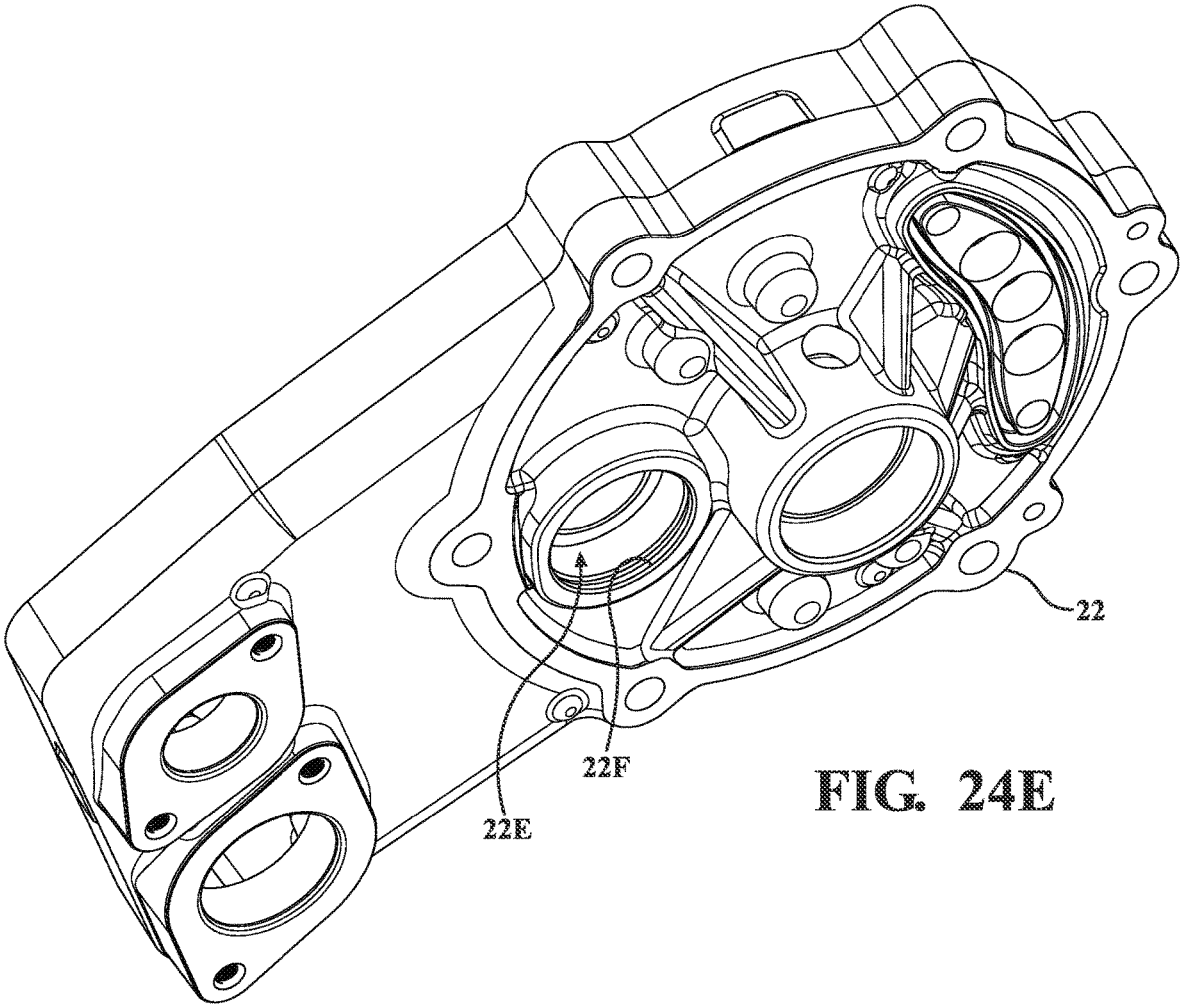
FIG. 24E is a first perspective view of an inverter housing of the electric compressor of FIG. 24A.
Figure 24F:
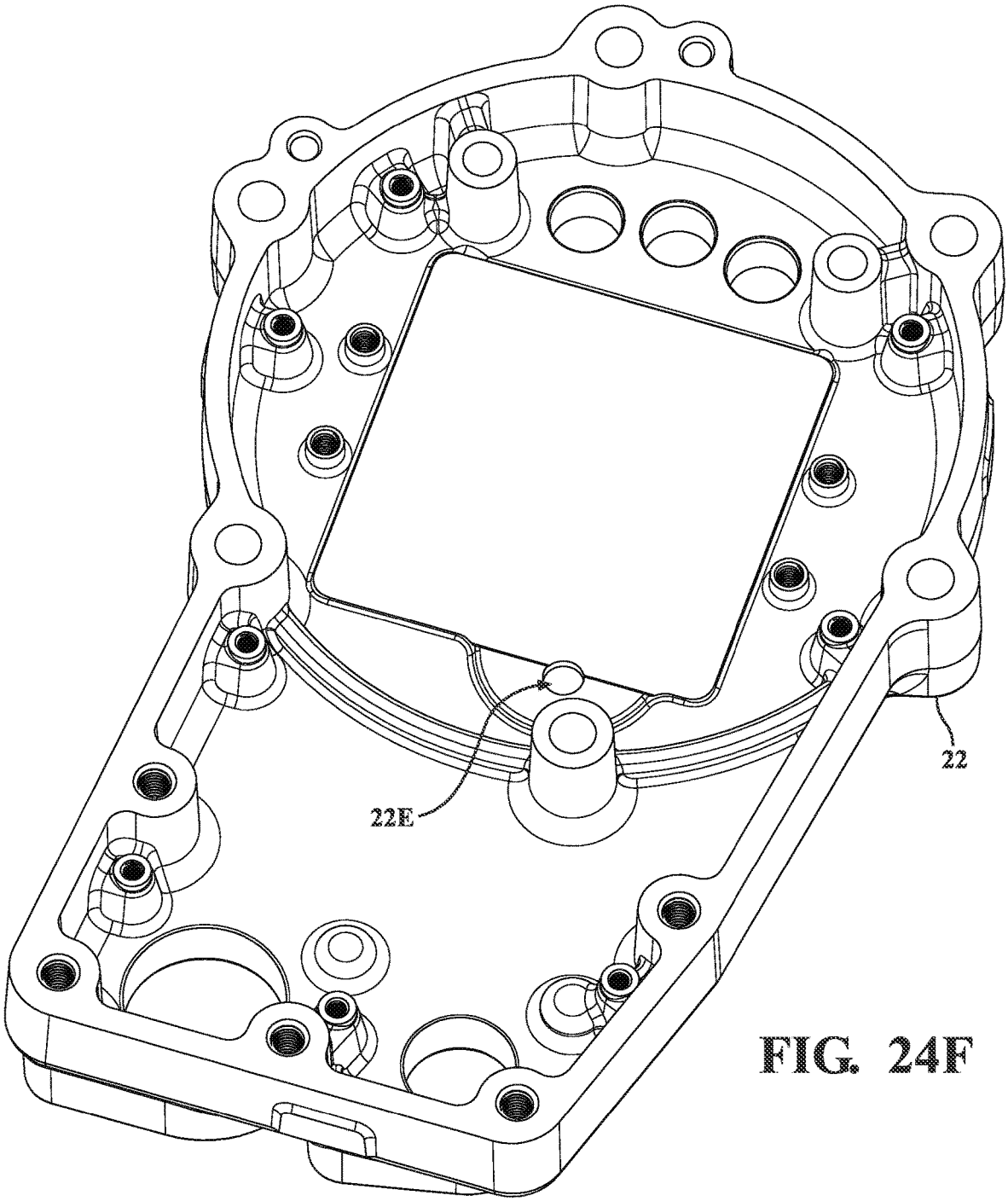
FIG. 24F is a second perspective view of an inverter housing of FIG. 24E.
Figure 24G:
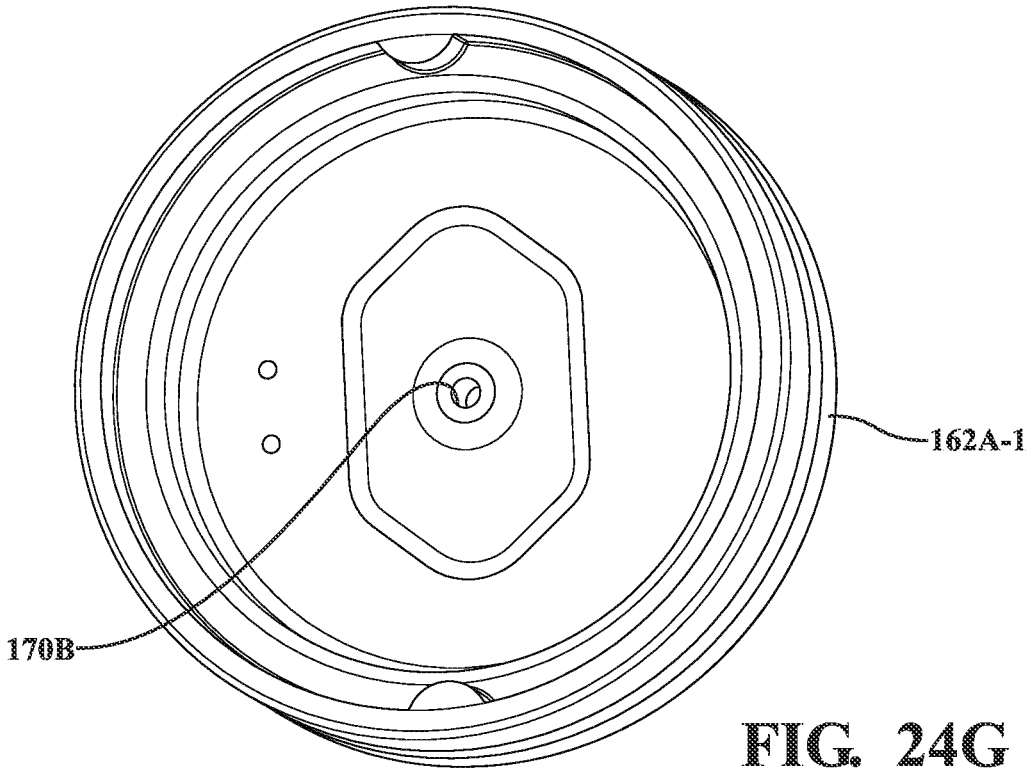
FIG. 24G is a first perspective view of a pressure sensor module housing of the electric compressor of FIG. 24A.
Figure 24H:
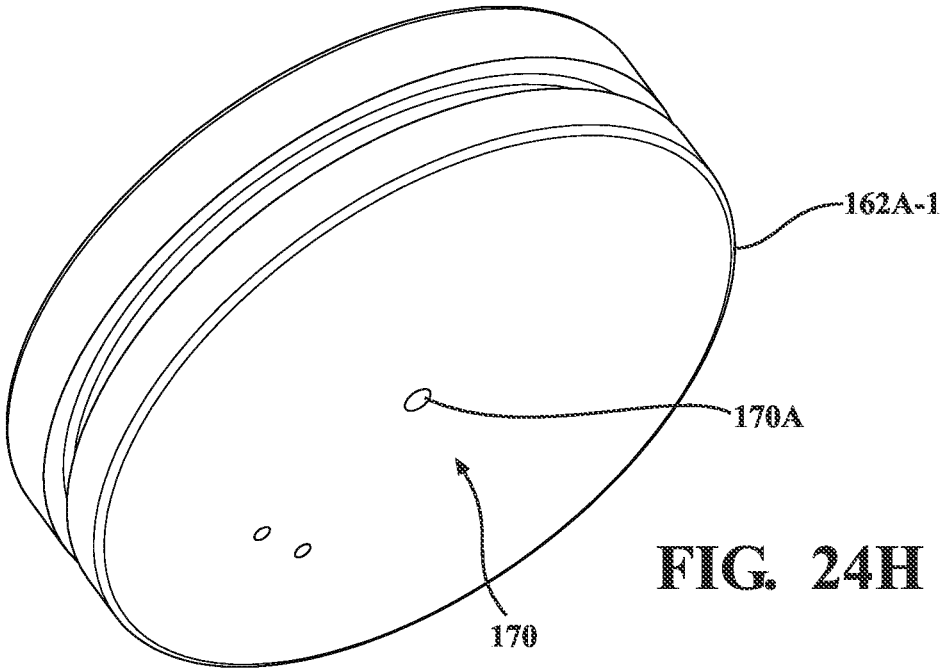
FIG. 24H is a second perspective view of the pressure sensor module housing of FIG. 24G.
Figure 25A:
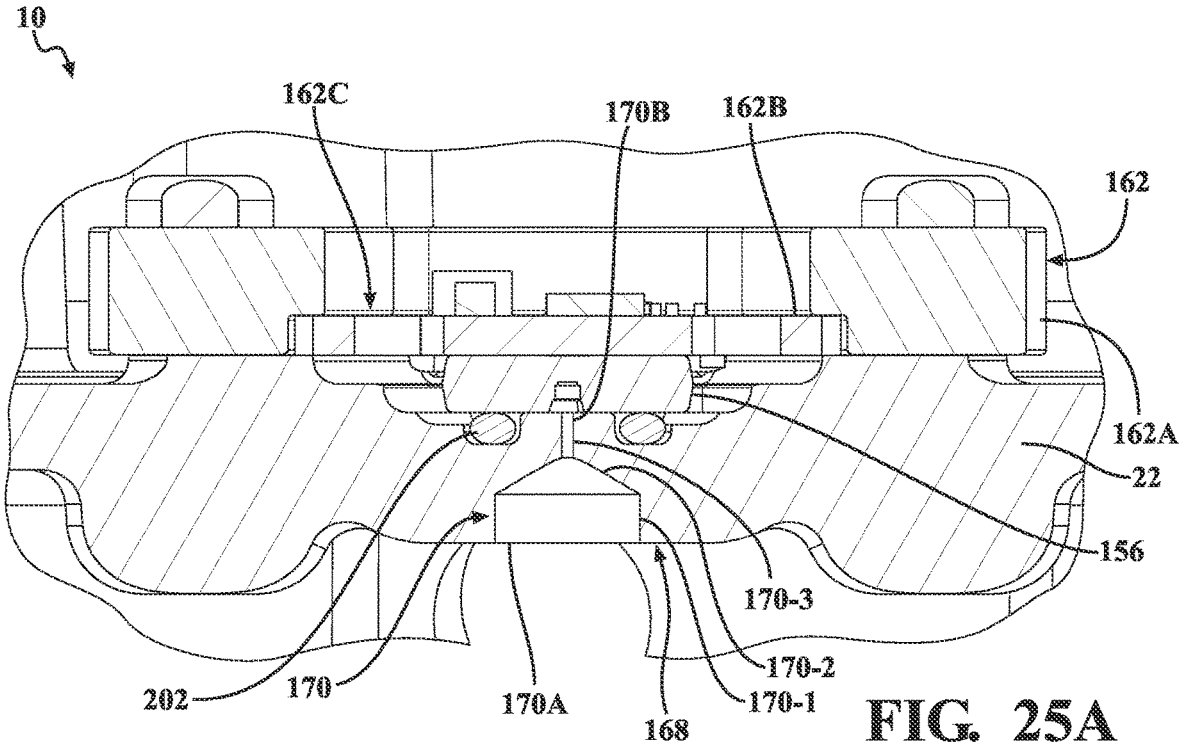
FIG. 25A is a cross-sectional view of an electric compressor with an integrated pressure sensor, according to a fourth embodiment of the present invention.
Figure 25B:
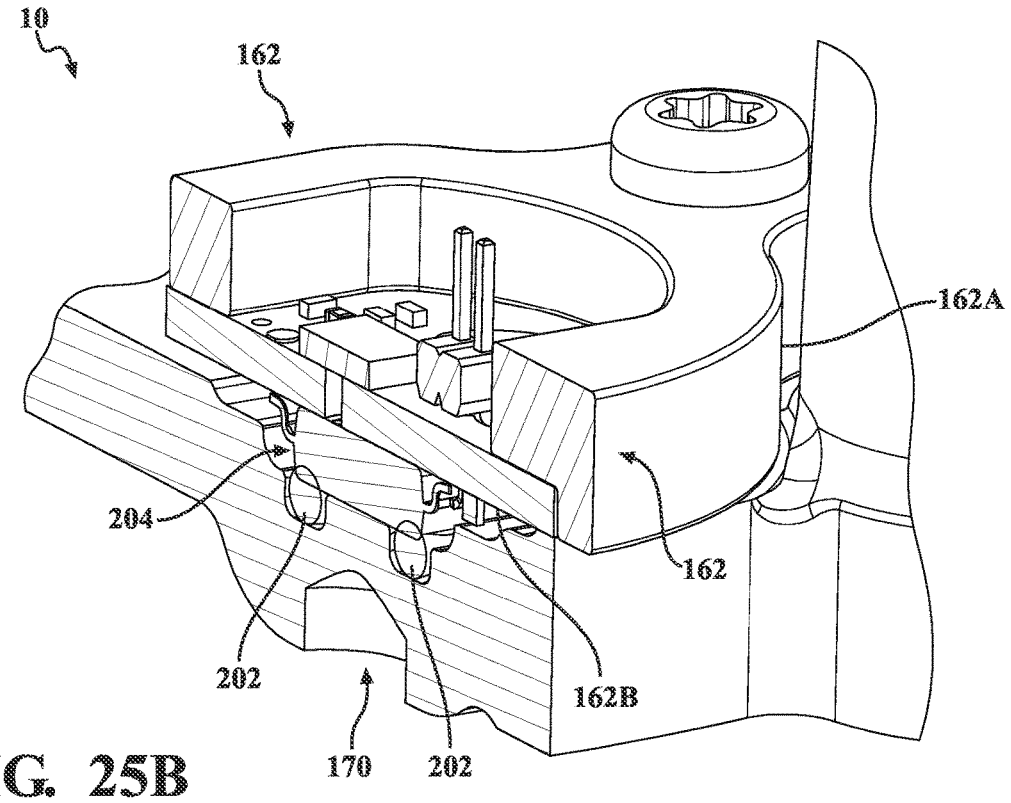
FIG. 25B is a cross-sectional perspective view of the electric compressor of FIG. 25A.
Figure 25C:
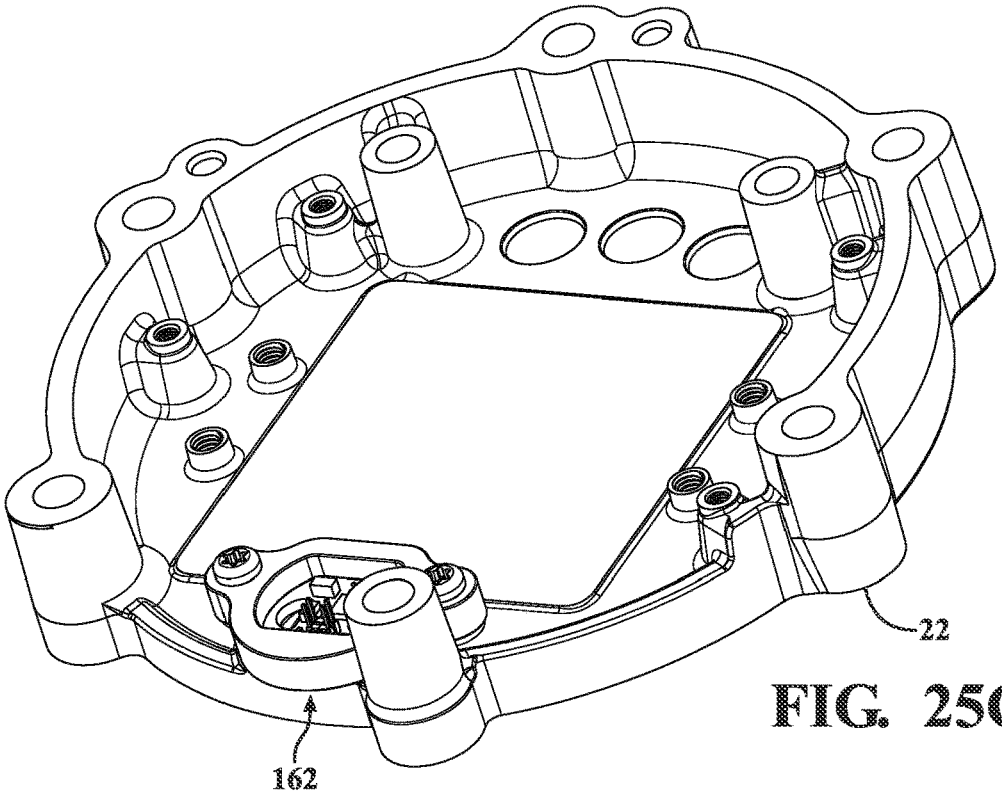
FIG. 25C is a partial perspective view of the electric compressor of FIG. 25A.
Figure 25D:
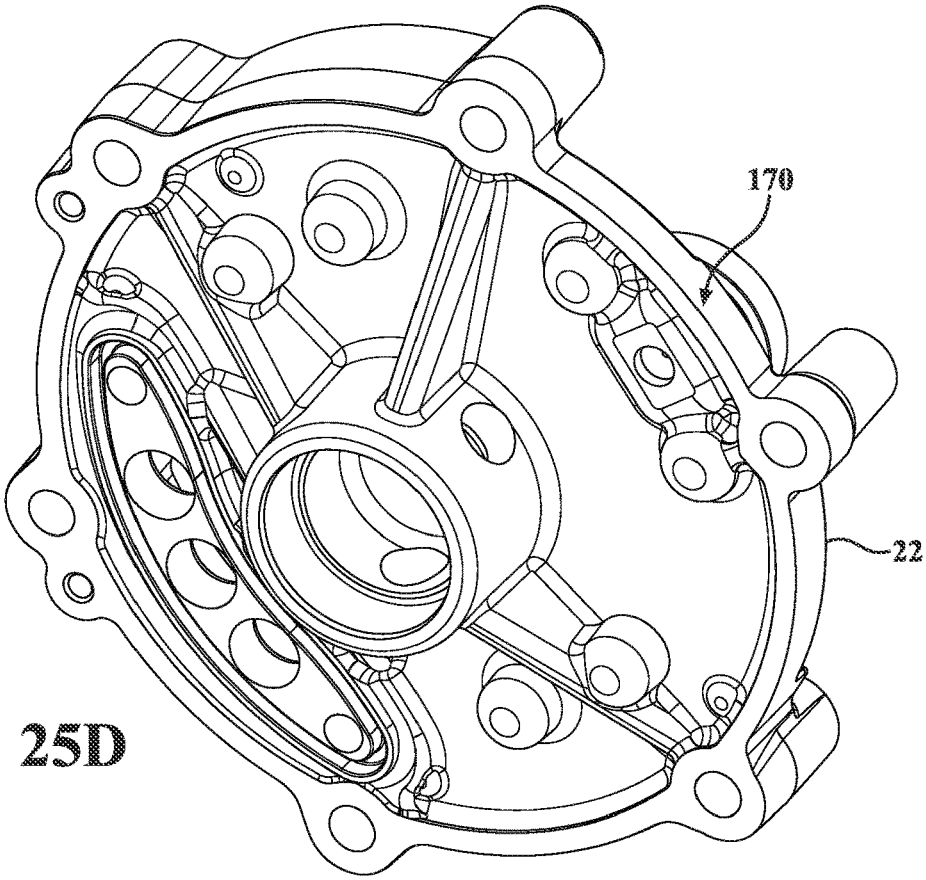
FIG. 25D is a first perspective view of an inverter housing of the electric compressor of FIG. 25A.
Figure 25E:
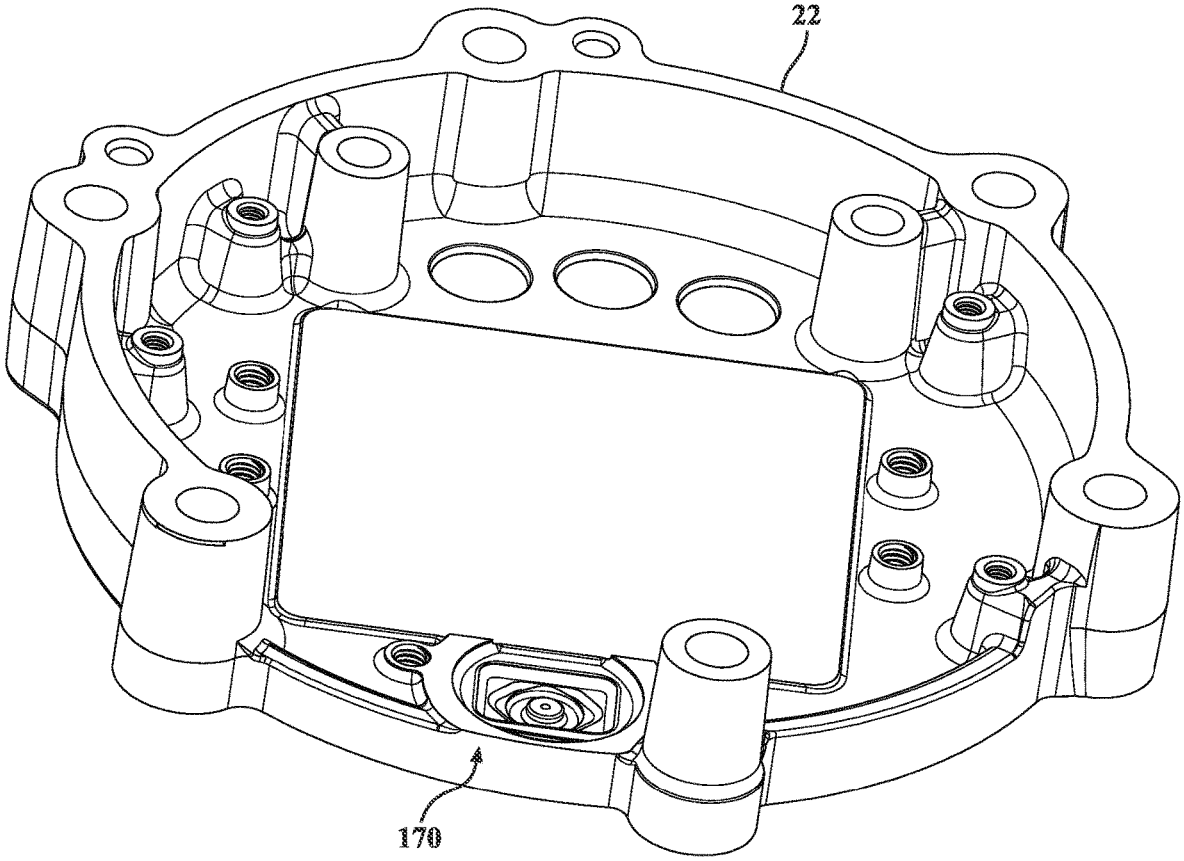
FIG. 25E is a second perspective view of the inverter housing of FIG. 25D.

As shown, the inverter housing 22 may include a slot 22F located around a periphery of the pressure sensor module aperture 22G for receiving a retainer 164 configured to retain the pressure sensor module 162 within the pressure sensor module aperture 22G. The retainer 164 may be in the form of a C clamp as shown in FIG. 24D.

As shown, the pressure sensor module 162 may also include the first temperature sensor 150B. The first temperature sensor 150B may be coupled to the pressure module printed circuit board by a plurality of wires 210. The temperature sensor 150B is located within the intake volume 74 when the scroll-type electrical compressor 10 is assembled. As shown, the pressure sensor module 162 may include one or more aperture 212 for receiving the plurality of wires 210.

Fourth Embodiment of Electric Scroll-Type Compressor with Integrated Sensor(s)

With reference to FIGS. 25A-25E, an electric compressor 10 according to the fourth embodiment is shown. In the fourth embodiment, the electric compressor 10 includes the pressure sensor module 162. In one aspect of the present invention, the pressure sensor module 162 may be preassembled and removable from the electric compressor 10.

In the illustrated embodiment, the pressure sensor module 162 of the fourth embodiment, includes the first pressure sensor 150A. As discussed above, the pressure sensor module 162 includes the pressure sensing housing 162A that defines a pressure sensor cavity 162C. The pressure sensor module circuit board 162B is positioned within the pressure sensor cavity 162C and the first pressure sensor 150A is mounted thereon. As shown, in the fourth embodiment, the pressure sensor module housing 162A is open at one end (adjacent to the inverter housing 22) and the internal housing partition 168 is formed by the inverter housing 22. The passage 170 is firmed by the internal housing partition 168 within the inverter housing 22. In the illustrated embodiment, the passage 170 includes a lower portion 170-1, an intermediate portion 170-2, and an upper portion 170-3. The lower portion 170-1 extends from lower surface of the inverter housing 22 and forms the intake volume end 170A of the passage. The intermediate portion 170-2 is located at an opposite end of the lower portion 170-1. the upper portion 170-3 is positioned above the intermediate portion 170-2 and forms the inverter cavity end 170B of the passage 170. The lower portion 170-1 has a diameter that is greater than a diameter of the upper portion 170-3. The intermediate portion 170-2 has a diameter that is equal to the diameter of the lower portion 170-1 at one end and a diameter equal to the diameter of the upper portion 170-3 at the opposite end.

As discussed above, the passage 170 includes an intake volume end 170A and an inverter cavity end 170B. An upper surface of the inverter housing 22 is adjacent to, and in contact with the MEMS package 156. The junction between the MEMS package 156 and the upper surface of the inverter housing 22 may be sealed with an O-ring 202 and/or adhesive (in cavity 204).

Electric Scroll-Type Compressor with Integrated Sensor(s) at Discharge Side

In the first, second, third and fourth embodiments, discussed above, the electric compressor 10 may include a first pressure sensor 150A and/or a first temperature sensor 150B for measuring a pressure and/or a temperature associated with the intake volume 74. In some applications, it may be desirable to establish a pressure and/or a temperature associated with the discharge side of the compressor 10, i.e., the discharge volume 82.

With specific reference to FIGS. 26A-26C, the housing 12 of the electric compressor 10 may define a second passage 220. The second passage 220 has a discharge cavity end 220A and an inverter cavity end 220B. The discharge cavity end 220A is located with the discharge cavity 82. The inverter cavity end 220B is located at/within or adjacent to the inverter housing 22. Pressurized refrigerant from the discharge volume 82. The second pressure sensor 150C may be located within the inverter cavity 30 and configured to establish a pressure associated with the pressurized refrigerant from the discharge volume 82 within the second passage 220. As shown in FIGS. 26A, the second passage 220 may be embodied in a rib 222 positioned along an outer surface of the housing 12. The second temperature sensor 150D, if used/provided, may be positioned within the discharge volume 82 and coupled to the printed circuit board 48 by a plurality of wires routed through the second passage 220.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A scroll-type electric compressor configured to compress a refrigerant, comprising:

a housing defining an intake volume, a discharge volume and an inverter cavity, the housing having a generally cylindrical shape and having a central axis;

an inverter module mounted inside the inverter cavity of the housing and adapted to convert direct current electrical power to alternating current electrical power;

a motor mounted inside the housing;

a compression device, coupled to the motor, for receiving the refrigerant from the intake volume and compressing the refrigerant as the motor is rotated;

an internal housing partition separating the intake volume and the inverter cavity, the internal housing partition including a passage therethrough for receiving refrigerant from the intake volume, the passage having an intake volume end and an inverter cavity end, the intake volume end being open to the intake volume;

a pressure sensor positioned within the inverter cavity adjacent the inverter cavity end of the passage for sensing a pressure associated with the refrigerant within the passage and the intake volume; and, a sealing device adjacent the inverter cavity end of the passage configured to seal the intake volume from the inverter cavity.

2. The scroll-type electric compressor, as set forth in claim 1, the housing includes an inverter housing and an inverter back cover, the inverter housing and the inverter back cover defining the inverter cavity, the inverter module includes a printed circuit board, wherein the pressure sensor is mounted to the printed circuit board.

3. The scroll-type electric compressor, as set forth in claim 2, further comprising a holder, wherein the inverter housing includes a holder aperture for receiving the holder, wherein the holder defines at least a portion of the internal housing partition, the passage being located within the holder.

4. The scroll-type electric compressor, as set forth in claim 3, further comprising a temperature sensor positioned within the intake volume and being coupled to the printed circuit board by a plurality of wires.

5. The scroll-type electric compressor, as set forth in claim 4, wherein the holder includes at least one aperture for receiving the plurality of wires.

6. The scroll-type electric compressor as set forth in claim 2, wherein the internal housing partition is formed by the inverter housing.

7. The scroll-type compressor, as set forth in claim 6, wherein the inverter housing includes a raised housing feature extending from, and being integral with, the inverter housing, the raised housing feature forming the internal housing partition.

8. The scroll-type compressor, as set forth in claim 7, the passage being located within the raised housing feature and extending from a lower surface of the inverter housing.

9. The scroll-type compressor, as set forth in claim 8, the raised housing feature including an upper surface adjacent to, and in contact with a package.

10. The scroll-type compressor, as set forth in claim 9, including a sealing device device configured to seal a junction between the upper surface and the package.

11. The scroll-type compressor, as set forth in claim 10, wherein the sealing device includes an O-ring and/or adhesive.

12. The scroll-type electric compressor, as set forth in claim 1, further comprising a temperature sensor positioned within the intake volume and being coupled to a printed circuit board by a plurality of wires.

13. The scroll-type electric compressor, as set forth in claim 12, wherein the internal housing partition includes at least one aperture for receiving the plurality of wires.

14. The scroll-type electric compressor, as set forth in claim 1, the housing defining a second passage therethrough for receiving pressurized refrigerant from the discharge volume, the second passage having a discharge volume end and an inverter cavity end, the scroll-type electric compressor further comprising a second pressure sensor positioned within the inverter cavity adjacent the inverter cavity end of the second passage for sensing a pressure associated with the refrigerant within the second passage.

15. The scroll-type electric compressor, as set forth in claim 14, wherein the second passage is within a rib positioned along an outer surface of the housing.

16. The scroll-type electric compressor, as set forth in claim 15, further comprising a temperature sensor positioned within the discharge volume and being coupled to a printed circuit board by a plurality of wires.

17. The scroll-type electric compressor, as set forth in claim 16, wherein the plurality of wires is routed through the second passage.

18. The scroll-type electric compressor, as set forth in claim 1, further comprising a pressure sensor module including:

a pressure sensor module housing having a pressure sensor cavity, the pressure sensor module including a pressure sensor module printed circuit board electrically coupled to a printed circuit board and being located within the pressure sensor cavity;

the pressure sensor mounted to the pressure sensor module printed circuit board and being positioned within the pressure sensor cavity adjacent the inverter cavity end of the passage for sensing a pressure associated with the refrigerant within the passage.

19. The scroll-type electric compressor, as set forth in claim 18, wherein the pressure sensor module includes at least one aperture for receiving the plurality of wires.

20. The scroll-type electrical compressor, as set forth in claim 18, further comprising an inverter housing including a pressure sensor module aperture, the pressure sensor module positioned with the pressure sensor cavity and including an intake volume side wall defining at least a portion of the internal housing partition, the passage being located within the intake volume side wall.

21. The scroll-type electrical compressor, as set forth in claim 20, wherein the inverter housing includes a slot located around a periphery of the pressure sensor module aperture for receiving a retainer configured to retain the pressure sensor module with the pressure sensor module aperture.

22. The scroll-type electric compressor, as set forth in claim 21, wherein the pressure sensor module includes a temperature sensor coupled to the pressure module printed circuit board by a plurality of wires, the temperature sensor being located within the intake volume when the scroll-type electrical compressor is assembled.

23. The scroll-type electric compressor, as set forth in claim 20, wherein the internal housing partition is formed by the inverter housing.

24. The scroll-type electric compressor, as set forth in claim 18, wherein the housing includes an inverter housing and an inverter back cover, the inverter housing and the inverter back cover defining the inverter cavity, the inverter module includes a printed circuit board, wherein the pressure sensor module printed circuit board is electrically coupled to the printed circuit board.

25. The scroll-type electrical compressor, as set forth in claim 24, wherein the inverter housing includes a pressure sensor module aperture for receiving the pressure sensor module, wherein the inverter housing includes a slot located around a periphery of the pressure sensor module aperture for receiving a retainer configured to retain the pressure sensor module with the pressure sensor module aperture.

26. The scroll-type electric compressor, as set forth in claim 24, wherein the pressure sensor module includes a temperature sensor coupled to the pressure module printed circuit board by a plurality of wires, the temperature sensor being located within the intake volume when the scroll-type electrical compressor is assembled.

27. The scroll-type electric compressor, as set forth in claim 26, wherein the pressure sensor module includes at least one aperture for receiving the plurality of wires.

28. A scroll-type electric compressor configured to compress a refrigerant, comprising:

a housing defining an intake volume, a discharge volume and an inverter cavity, the housing having a generally cylindrical shape and having a central axis, the housing includes an inverter housing and an inverter back cover, the inverter housing and the inverter back cover defining the inverter cavity, the inverter housing includes a holder aperture;

an inverter module mounted inside the inverter cavity of the housing and adapted to convert direct current electrical power to alternating current electrical power, the inverter module includes a printed circuit board;

a motor mounted inside the housing;

a compression device, coupled to the motor, for receiving the refrigerant from the intake volume and compressing the refrigerant as the motor is rotated;

an internal housing partition separating the intake volume and the inverter cavity, the internal housing partition including a passage therethrough for receiving refrigerant from the intake volume, the passage having an intake volume end and an inverter cavity end, the intake volume end being open to the intake volume;

a holder being located within the holder aperture and defining at least a portion of the internal housing partition, the passage being located within the holder;

a pressure sensor mounted to the printed circuit board and being positioned within the inverter cavity adjacent the inverter cavity end of the passage for sensing a pressure associated with the refrigerant within the passage and the intake volume;

a temperature sensor positioned within the intake volume and being coupled to the printed circuit board by a plurality of wires; and, a sealing device adjacent the inverter cavity end of the passage configured to seal the intake volume from the inverter cavity.

29. The scroll-type electric compressor, as set forth in claim 28, wherein the holder includes at least one aperture for receiving the plurality of wires.

30. The scroll-type electric compressor, as set forth in claim 29, the housing defining a second passage therethrough for receiving pressurized refrigerant from the discharge volume, the second passage having a discharge volume end and an inverter cavity end, the scroll-type electric compressor further comprising a second pressure sensor positioned within the inverter cavity adjacent the inverter cavity end of the second passage for sensing a pressure associated with the refrigerant within the second passage.

31. The scroll-type electric compressor, as set forth in claim 30, wherein the second passage is within a rib positioned along an outer surface of the housing.

32. The scroll-type electric compressor, as set forth in claim 31, further comprising a temperature sensor positioned within the discharge volume and being coupled to the printed circuit board by a plurality of wires.

33. The scroll-type electric compressor, as set forth in claim 32, wherein the plurality of wires is routed through the second passage.

34. A scroll-type electric compressor configured to compress a refrigerant, comprising:

a housing defining an intake volume, a discharge volume and an inverter cavity, the housing having a generally cylindrical shape and having a central axis, the housing including an inverter housing and an inverter back cover, the inverter housing and the inverter back cover defining the inverter cavity;

an inverter module including a printed circuit board and being mounted inside the inverter cavity of the housing, the inverter module being adapted to convert direct current electrical power to alternating current electrical power;

a motor mounted inside the housing;

a compression device, coupled to the motor, for receiving the refrigerant from the intake volume and compressing the refrigerant as the motor is rotated;

an internal housing partition separating the intake volume and the inverter cavity, the internal housing partition including a passage therethrough for receiving refrigerant from the intake volume, the passage having an intake volume end and an inverter cavity end, the intake volume end being open to the intake volume;

a pressure sensor module housing having a pressure sensor cavity and a pressure sensor module including a pressure sensor module printed circuit board electrically coupled to the printed circuit board and being positioned with the pressure sensor cavity;

a pressure sensor mounted to the pressure sensor module printed circuit board and being positioned within the pressure sensor cavity adjacent the inverter cavity end of the passage for sensing a pressure associated with the refrigerant within the passage and the intake volume; and, a sealing device adjacent the inverter cavity end of the passage configured to seal the intake volume from the inverter cavity.

35. The scroll-type electrical compressor, as set forth in claim 34, the inverter housing including a pressure sensor module aperture, the pressure sensor module being positioned with the pressure sensor cavity and including an intake volume side wall defining at least a portion of the internal housing partition, the passage being located within the intake volume side wall.

36. The scroll-type electrical compressor, as set forth in claim 35, wherein the inverter housing includes a slot located around a periphery of the pressure sensor module aperture for receiving a retainer configured to retain the pressure sensor module with the pressure sensor module aperture.

37. The scroll-type electric compressor, as set forth in claim 36, wherein the pressure sensor module includes a temperature sensor coupled to the pressure module printed circuit board by a plurality of wires, the temperature sensor being located within the intake volume when the scroll-type electrical compressor is assembled.

38. The scroll-type electric compressor, as set forth in claim 37, wherein the pressure sensor module includes at least one aperture for receiving the plurality of wires.

39. The scroll-type electric compressor, as set forth in claim 34, wherein the internal housing partition is formed by the inverter housing.

40. The scroll-type electric compressor, as set forth in claim 34, the housing defining a second passage therethrough for receiving pressurized refrigerant from the discharge volume, the second passage having a discharge volume end and an inverter cavity end, the scroll-type electric compressor further comprising a second pressure sensor positioned within the inverter cavity adjacent the inverter cavity end of the second passage for sensing a pressure associated with the refrigerant within the second passage.

41. The scroll-type electric compressor, as set forth in claim 40, wherein the second passage is within a rib positioned along an outer surface of the housing.

42. The scroll-type electric compressor, as set forth in claim 41, further comprising a temperature sensor positioned within the discharge volume and being coupled to the printed circuit board by a plurality of wires.

43. The scroll-type electric compressor, as set forth in claim 42, wherein the plurality of wires is routed through the second passage.

* * * * *